US006438345B1

(12) United States Patent
Ban et al.

(10) Patent No.: US 6,438,345 B1
(45) **Date of Patent: *Aug. 20, 2002**

(54) TONER SUPPLYING CONTAINER AND IMAGE FORMING APPARATUS

(75) Inventors: Yutaka Ban, Tokyo; Tatsuya Goto, Numazu; Akihito Kanamori, Numazu; Fumio Tazawa, Numazu, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/536,302

(22) Filed: Mar. 27, 2000

(30) Foreign Application Priority Data

Mar. 29, 1999 (JP) ..... 11-085095
Nov. 2, 1999 (JP) ..... 11-311744

(51) Int. Cl.[7] ..... G03G 15/08

(52) U.S. Cl. ..... 399/262; 399/106; 399/111; 222/DIG. 1

(58) Field of Search ..... 399/262, 258, 399/111, 119, 120, 106, 260; 222/DIG. 1

(56) References Cited

U.S. PATENT DOCUMENTS

| | | | | |
|---|---|---|---|---|
| 4,827,307 | A | 5/1989 | Zoltner | |
| 4,878,603 | A | 11/1989 | Ikesue et al. | |
| 4,937,628 | A | 6/1990 | Cipolla et al. | |
| 5,268,722 | A | 12/1993 | Ikkatai et al. | 355/260 |
| 5,385,181 | A | 1/1995 | Bhagwat et al. | |
| 5,526,101 | A | 6/1996 | Weed | |
| 5,548,384 | A | 8/1996 | Weed | |
| 5,579,101 | A | 11/1996 | Omata et al. | |
| 5,669,044 | A | 9/1997 | Cuthbert | |
| 5,708,925 | A | 1/1998 | Kobayashi et al. | |
| 5,870,652 | A | 2/1999 | Kanamori et al. | |
| 5,970,291 | A | * 10/1999 | Miller | 399/262 |
| 6,185,401 | B1 | 2/2001 | Kanamori et al. | |

FOREIGN PATENT DOCUMENTS

| | | |
|---|---|---|
| EP | 0 616 268 A1 | 9/1994 |
| EP | 0 631 206 A2 | 12/1994 |
| EP | 0 668 546 A2 | 8/1995 |
| EP | 0 905 577 A2 | 3/1999 |
| JP | 01-108581 | 4/1989 |
| JP | 05-241443 | 9/1993 |
| JP | 06-035321 | 2/1994 |
| JP | 7-225514 | 8/1995 |
| JP | 07-306578 | 11/1995 |
| JP | 08-234552 | 9/1996 |
| JP | 09-179363 | 7/1997 |

OTHER PUBLICATIONS

Patents Abstracts of Japan, vol. 13, No. 349 (P–911), Aug. 7, 1989.
Patent Abstracts of Japan, vol. 18, No. 256 (P–1738), May 16, 1994.

* cited by examiner

*Primary Examiner*—Robert Beatty
(74) *Attorney, Agent, or Firm*—Fitzpatrick, Cella, Harper & Scinto

(57) ABSTRACT

A toner supply container, detachably mountable to a main assembly of an image forming apparatus, for supplying toner to the main assembly of the image forming apparatus. The toner supply container includes a main body for accommodating the toner; a discharging opening for permitting discharging of the toner accommodated in the main body of the container; a container shutter member for opening and closing the discharging opening, the container shutter member being provided with an engaging portion engageable with a main assembly shutter member provided in the main assembly of the apparatus, wherein the main assembly shutter member is openable and closable relative to a toner reception opening of the main assembly of the apparatus while the container shutter member and the main assembly shutter member are interrelated with each other, and wherein the engaging portion is capable of passing by a position corresponding to the discharging opening; cover seals covers the engaging portion relative to the discharging opening.

26 Claims, 39 Drawing Sheets

(a)

(b)

TONER SUPPLYING CONTAINER AND IMAGE FORMING APPARATUS

FIELD OF THE INVENTION AND RELATED ART

The present invention relates to an image forming apparatus such as an electrophotographic copying machine, a printer or the like and a toner supply container for supplying toner to the image forming apparatus. Here, typical examples of the image forming apparatus include an apparatus which forms an image on a recording material through an electrophotographic image formation process. Examples of the electrophotographic image forming apparatus include an electrophotographic copying machine, an electrophotographic printer (laser beam printer, LEDprinter, for example), a facsimile machine, a word processor or the like. In the image forming apparatus such as the electrophotographic copying machine, the printer or the like, a developer in the form of fine powdery toner is used. When the developer (toner) in the main assembly of the image forming apparatus, is used up, the toner is supplied into the main assembly of the image forming apparatus using a toner supply container. Since the toner is very fine particles, the toner which is being supplied or the toner remaining in the toner supply container might scatter with the result of contamination of the operator or the environment around the apparatus.

In the case that toner discharging opening of the toner supply container is covered by film welded therearound, the toner supply container having been used up cannot be resealed. In order to avoid this problem, a proposal has been made in which a shutter for openably sealing the toner discharging opening, and it has been put into practice.

On the other hand, the toner supply opening of the toner supply device provided to receive toner is provided with a shutter for openably sealing it. By doing so, the toner supply device is sealed except when the toner is supplied and so that no foreign matter such as clip or the like is prevented to enter, or erroneous toner is prevented from supplied.

Moreover, another proposal has been made in which it is combined with the above-described toner supply container so that they are integrally opened and closed, by which the toner scattering during the toner supply operation can be prevented, and this system has also been put into practice.

However, such a system involves following problems.

The toner enters between the container shutter and the main assembly shutter, by which the toner is deposited on an outer surface of the shutter of the toner supply container which has been used and removed. Particularly in a system in which the toner supply container is installed in the main assembly of the image forming apparatus,this problem is significant when the toner supply container is taken out before the absence of the is detected, that is, during the toner is being discharged.

In such a case, a quite a large amount of the toner remains in the toner supply container, and the neighborhood of the toner discharging opening is filled with toner. In such a state, the container shutter and the main assembly shutter are integrally wedged to effect the sealing, and therefore, the toner enters between the two shutters with the result that outer surface of the shutter of the toner supply container taken out and the neighborhood therefore are contaminated with the toner.

Moreover, the toner between the two shutters is deposited and remains more in the main assembly shutter. Therefore, by repeating in the removing operations, the contamination gradually increases. Such an accumulation tendency exists in the case that it is taken out after the detection of the absence of the toner, that is, after the toner supply container becomes substantially empty. After the exchange of the toner supply container is repeated several tens times, the competition becomes remarkable.

In an example, the toner supply container has a cylindrical shape, and a relatively small toner discharging opening is formed in a part of the surface thereof; the inside of the toner supply container is provided with toner feeding means for feeding the toner bidding to the toner discharging opening. Such a ton, container is inserted in the direction of the axis of the cylindrical shape into the image forming apparatus, and is used in the inserted state. However, the toner discharge opening is relatively small, and the toner supply opening of the toner supply device which receives the toner, and therefore, the access thereto from outside is very difficult. In such a system, it is difficult to remove periodically the accumulated toner in the toner supply device.

Accordingly, it is a principal object of the present invention to provide a toner supply container and an image forming operators wherein the toner deposition to the outer surface of the container at and adjacent to the shutter of the toner supply container. These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 21 is a sectional view as seen in a direction perpendicular to the direction in which FIG. 20 is drawn.

DESCRIPTION OF THE PREFERRED EMBODIMENTS

Presented below are the embodiments of the present invention. First, a preferable embodiment of the present invention will be described, followed by the others.

The embodiments of the present invention, which will be described below, relates to a toner supply container used for supplying the main assembly of an electrophotographic image forming apparatus with toner. This toner supply container comprises a toner containing portion, a toner outlet for discharging the toner contained in the toner containing portion, a shutter for opening or closing the toner outlet, and a driving force receiving portion for receiving the driving force for moving the shutter to open the toner outlet.

Electrophotographic Image Forming Apparatus

Figure 28:
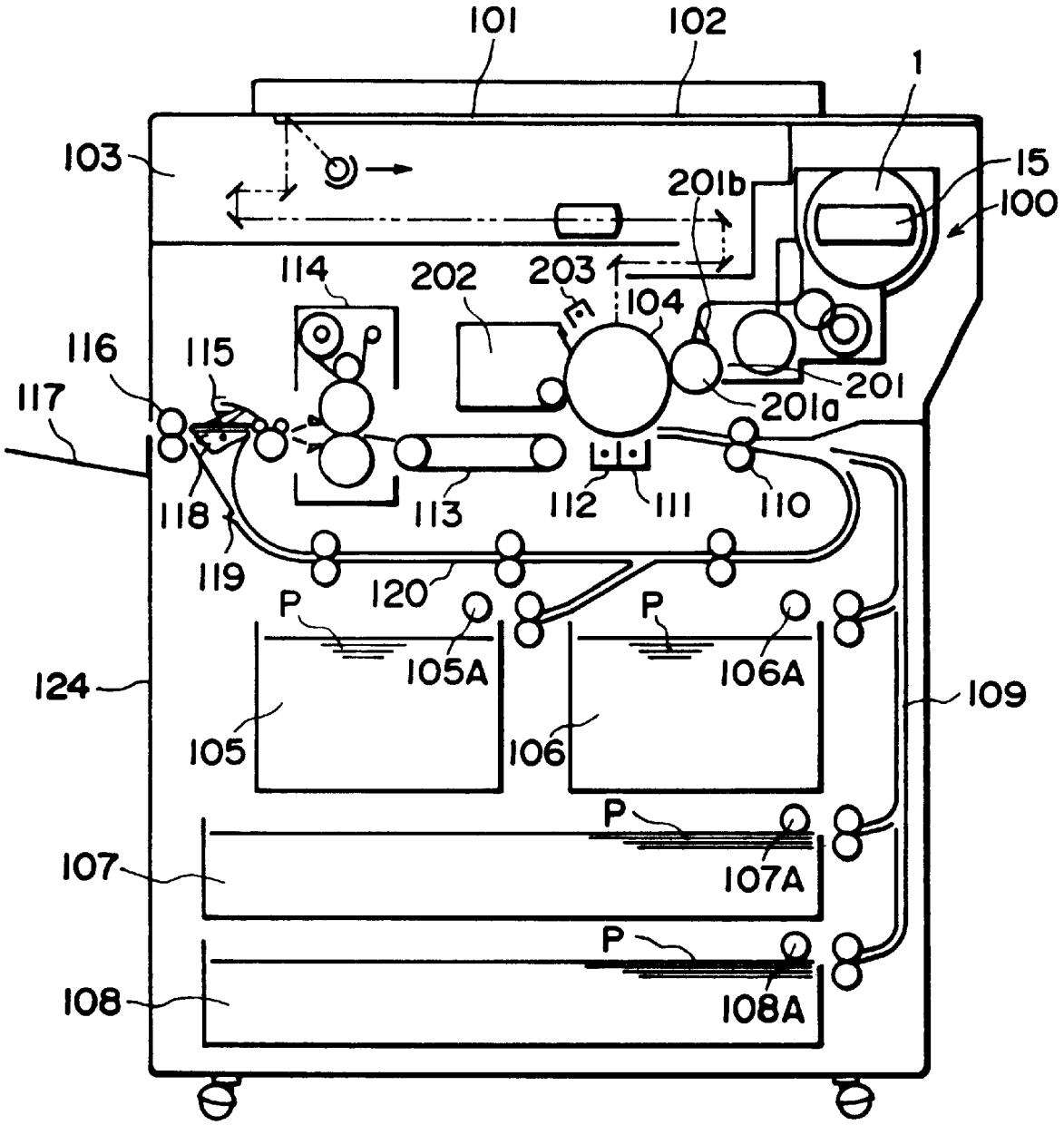
FIG. 28 is a longitudinal sectional view of an electrophotographic image forming apparatus.

FIG. 28 is a vertical sectional view of an electrophotographic image forming apparatus in which there is a toner supply container in accordance with the present invention.

An original 101 is placed on a glass plate 102 for an original, by an operator. As a result, an optical image of the original 101 is formed on a photosensitive drum 104 as an image bearing member by the plurality of mirrors and lenses which an optical portion 103 comprises. Meanwhile, one of the feeder cassettes 105–108 in which recording media P (for example, paper, OHP sheet, or the like; hereinafter, "sheet") are stored in layers is selected on the basis of the sheet size information inputted through a control panel (unillustrated) by the operator. Then, among the feeder rollers 105A–108A, the roller of the selected feeder cassette is rotated to feed out a single sheet of recording medium P. After being fed out of the feeder cassette, the recording sheet P is conveyed to a registration roller 110 through a conveyance path 109. The registration roller 110 conveys the recording sheet P to the photosensitive drum 104 in synchronism with the rotational timing for the photosensitive drum 104 and the scanning timing for the optical portion 103. To this recording sheet P, the toner image on the photosensitive drum 104 is transferred by a transferring means 111. Thereafter, the recording sheet P is separated from the photosensitive drum 104 by a separating means 112. Then, the recording sheet P is conveyed to a fixing portion 114 by a conveying portion 113. In the fixing portion 114, the toner image on the recording sheet P is fixed to the recording sheet P with the application of heat and pressure.

Next,

1) In the single side copy mode, the recording sheet P is discharged into a delivery tray 117 by a discharge roller pair 16 through a reversing path 115.
2) In the multiple layer copy mode, the recording sheet P is directed toward conveying portions 119 and 120 by a flapper 118 of the reversing path 115, and is conveyed to the registration roller 110. Thereafter, the recording sheet P is passed through the image forming portion, conveying portion, and fixing portion as it was in the immediately preceding image formation cycle, and then, is discharged into the delivery tray 117.

3) In the two sided copy mode, the recording sheet P is passed through the reversing path 115, and is partially extended outward of the apparatus by the discharge roller pair 16 until its trailing edge passes the flapper 118. Then, as soon as the trailing edge of the recording sheet P passes the flapper 118, the discharge roller pair 116 is rotated in reverse to convey the recording sheet P back into the apparatus. Thereafter, the recording sheet P is conveyed to the conveying portions 119 and 120, and to the registration roller 110. Then, it is passed through the image forming portion, conveying portion, and fixing portion as it was in the immediately preceding image forming cycle, and is discharged into the delivery tray 117.

In an electrophotographic image forming apparatus structured as described above, a developing apparatus 201, a cleaning means 202, and a primary charging means 203 are disposed around the photosensitive drum 104. The developing apparatus 201 develops, with the use of toner, an electrostatic latent image formed on the photosensitive drum 104. A toner supplying apparatus 100 for supplying the developing apparatus 201 with toner is removably installed in the apparatus main assembly 124.

The developing apparatus 201 comprises a development roller 201*a* which maintains a microscopic gap (approximately 300 $\mu$m) from the photosensitive drum 104. During development, a thin layer of toner is formed on the peripheral surface of the development roller 201*a* by the development blade 201*b*. Then, as development bias is applied to the development roller 201*a*, the electrostatic latent image which has been formed on the photosensitive drum 104 is developed.

The charging means 203 is a means for charging the photosensitive drum 104. The cleaning means 202 is a means for removing the toner which remains on the photosensitive drum 104. The reduction in the amount of the toner in the developing apparatus 201 caused by development is compensated for by a fresh supply of toner gradually delivered by a toner supplying apparatus 100 with which the main apparatus of the image forming apparatus is provided.

Here, the exchanging of the toner supply container 301 will be described.

Figure 38:
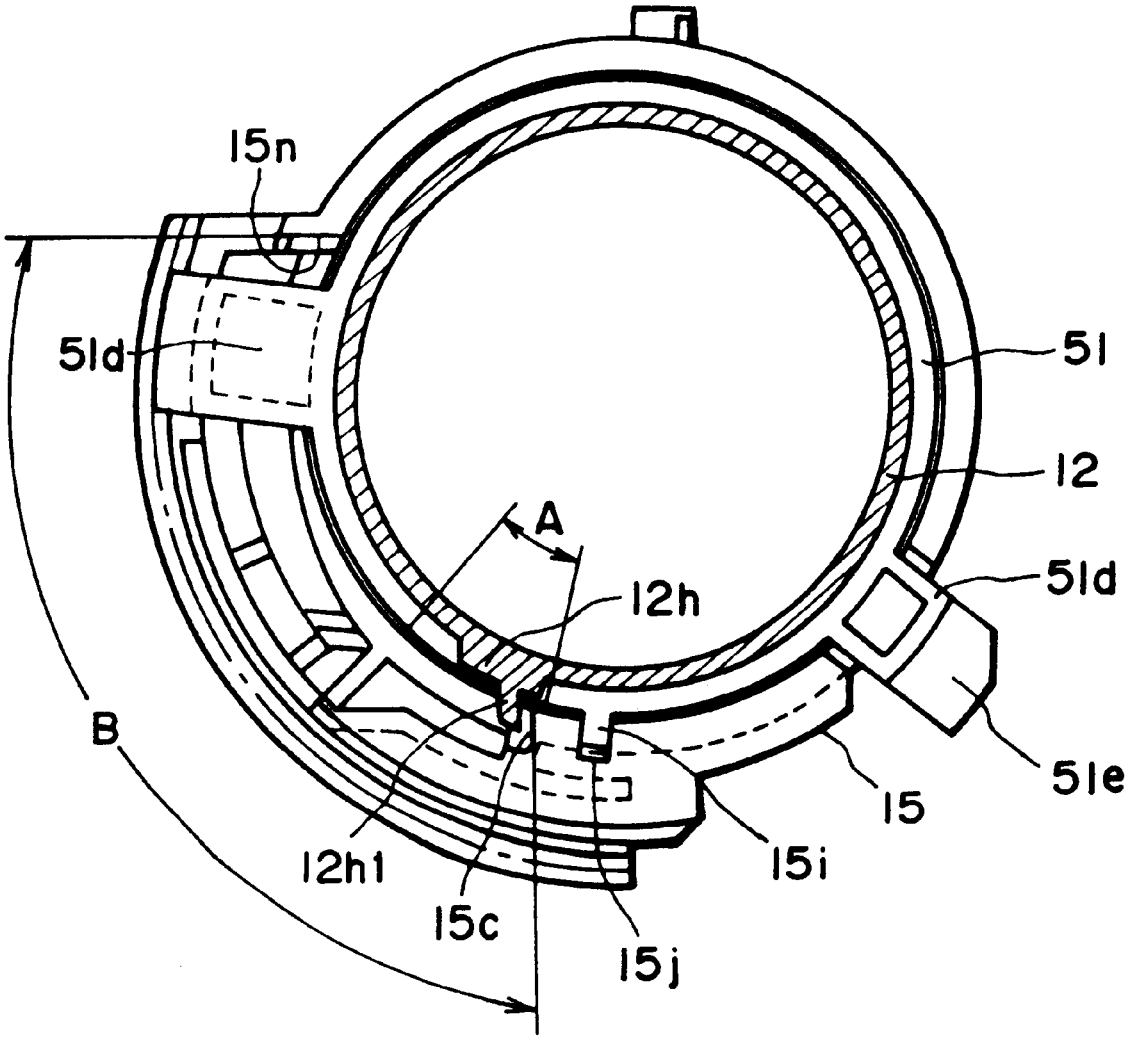
FIG. 38 is a front sectional view of the toner supply container at the position of the handle locking member.

As the toner within the toner supplying apparatus 100 is depleted, the depletion of the toner is reported to a warning section 124*a*. Then, an operator opens the lid 121, which covers the opening 122 with which the main assembly 124 is provided, as shown in FIG. 38. Inside the opening 122, a holder 31 (installing means, more specifically, main assembly 54 of toner supplying apparatus) in which the toner supply container 1 is removably installable is provided. Into this holder 31, the toner supply container 1 is inserted in its longitudinal direction. During this operation, the toner supply container 1 is guided in its longitudinal direction by a guide, with which the holder 31 is provided, and which extends in the longitudinal direction of the holder 31, until the leading end of the toner supply container 1 reaches a predetermined point. Then, as the operator rotates the handle 15 of the toner supply container 1 after the leading end of the toner supply container 1 reaches the predetermined point, the toner within the toner supply container 1 is supplied to the developing apparatus 201. Then, as the operator closes the lid 121, the power switch is turned on, readying the image forming apparatus for image formation.

Figure 12:
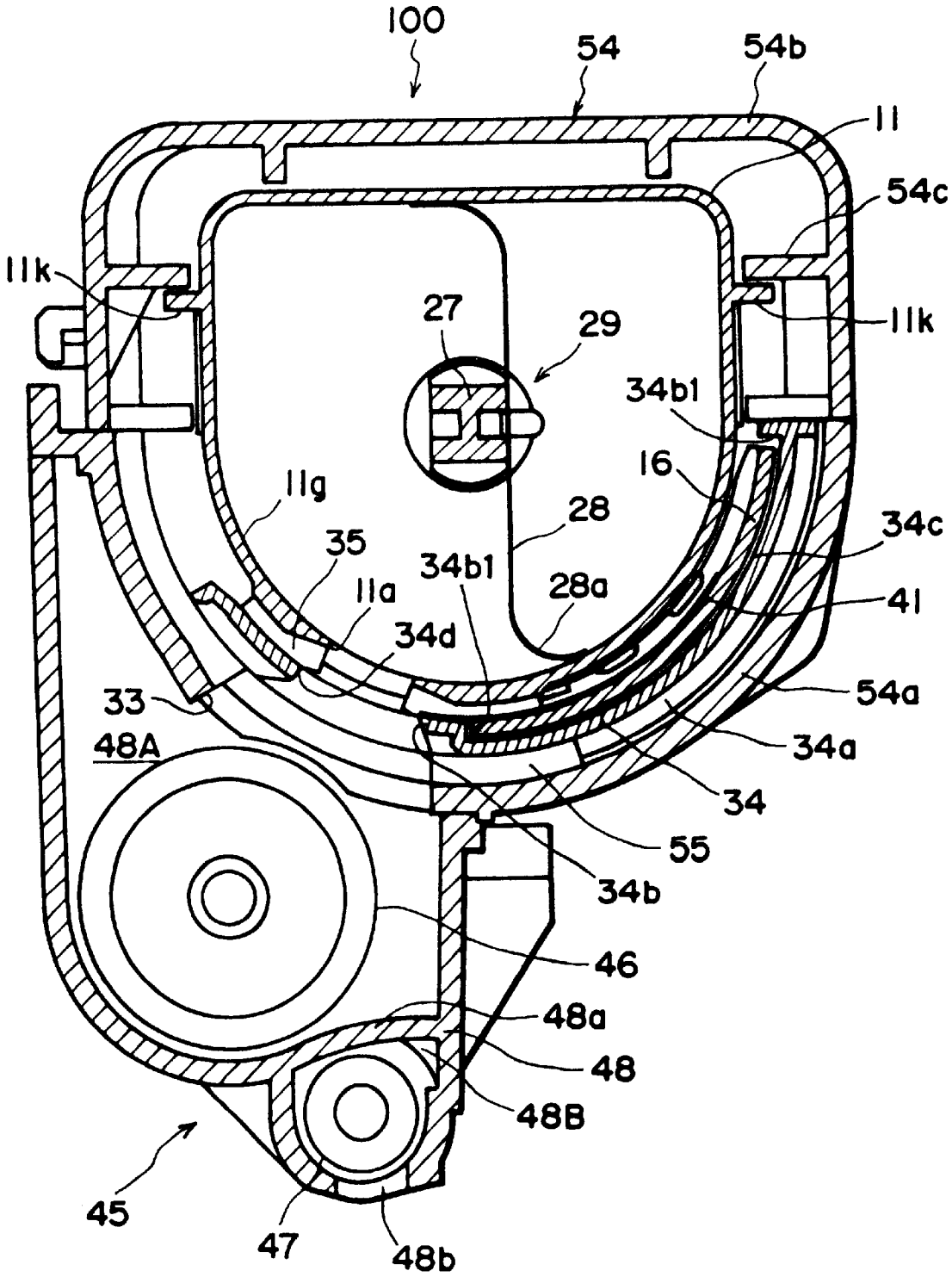
FIG. 12 is a front sectional view of the toner supply device wherein the shutter is in the open position.

More specifically, as a signal which indicates that the amount of the toner in the developing apparatus 201 has become too small is sent out by a sensor (unillustrated) in the developing apparatus 201, toner conveying screws 46 and 47, illustrated in FIG. 12, rotate. As a result, the toner within a case 48 is gradually supplied to the developing apparatus 201. Then, as the amount of the toner within the developing apparatus 201 reaches a predetermined level, the toner conveying screws 46 and 47 stop. This process is repeated. Eventually, the amount of the toner within the case 48 becomes too small. Then, a signal which indicates that the amount of the toner within the case 48 has become too small is sent out by a sensor (unillustrated) within the case 48. As a result, a conveying member 29 (which will be described later) within the toner supply container 1 rotates to send the toner into the case 48. Then, as the amount of the toner within the case 48 reaches a predetermined level, the conveying member 29 stops. The process is repeated. If the toner is not supplied even though the sensor within the case 48 sends out the aforementioned signal, a message which suggests the exchange of the toner supply container 1 is displayed by the warning section 124*a*.

Toner Supply Container

Figure 1:
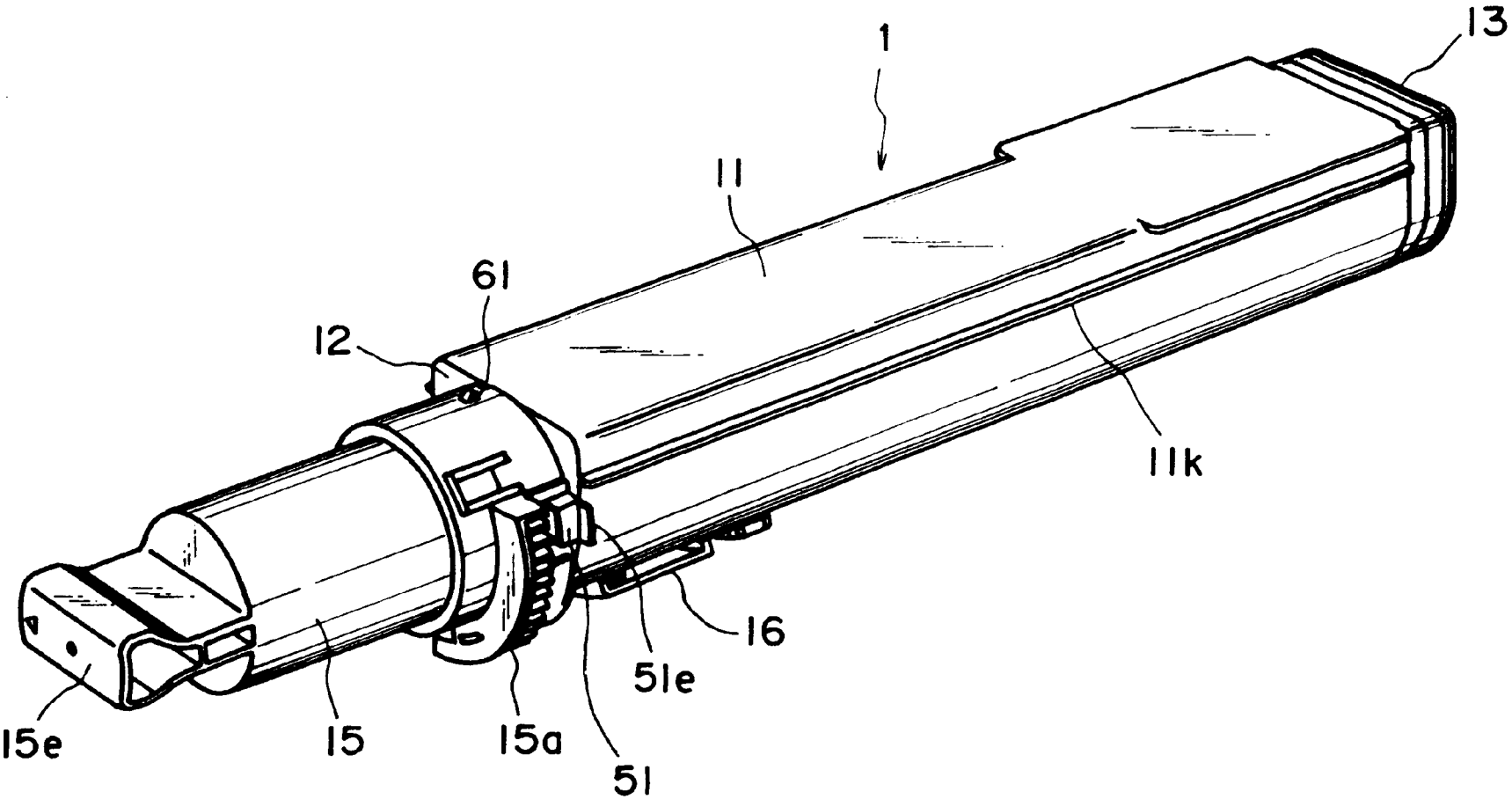
FIG. 1 is a perspective view of a toner supply container as seen from a front side in a mounting direction.
Figure 2:
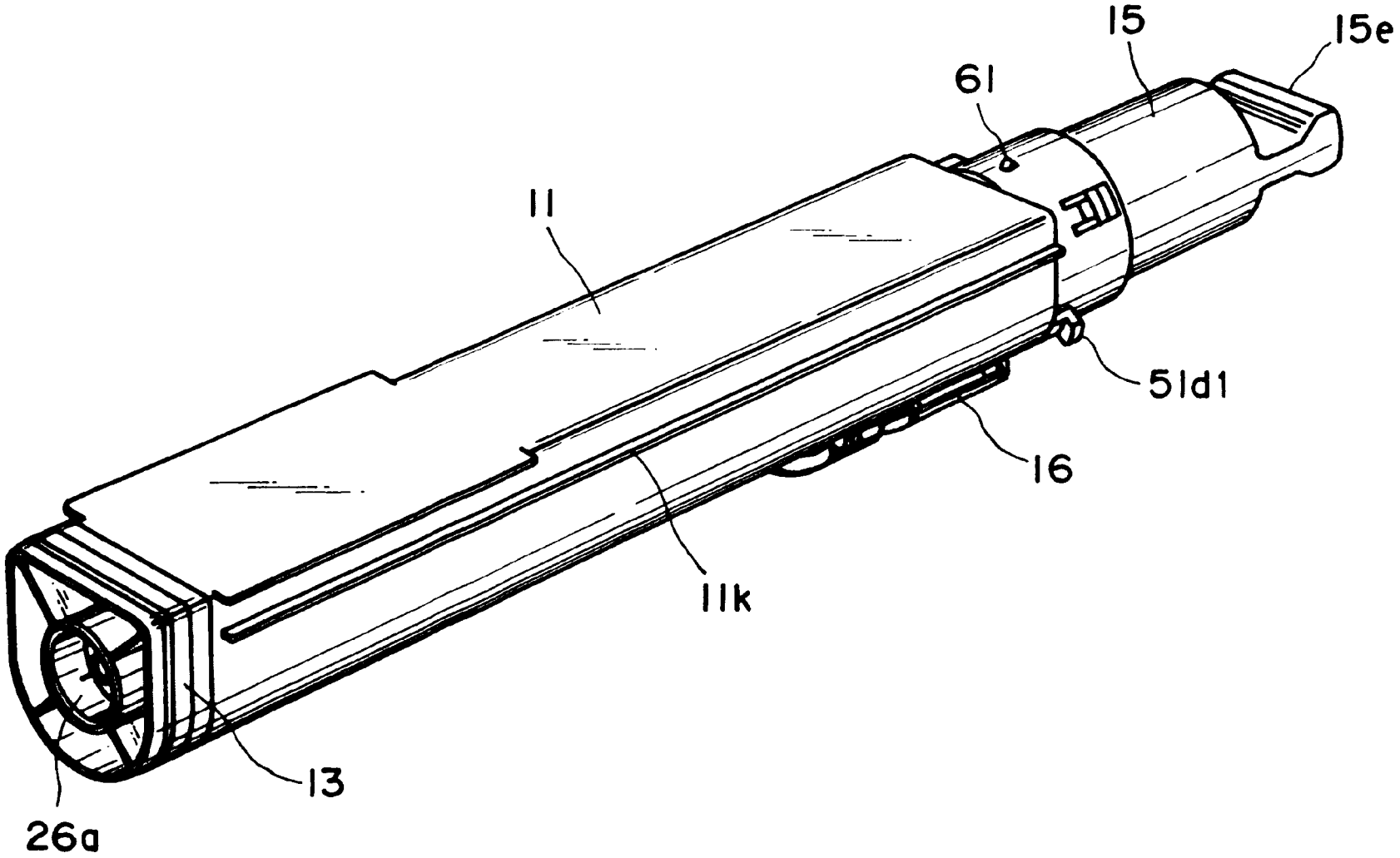
FIG. 2 is a perspective view of the toner supply container,s seen from the opposite side.

The toner supply container 1 in this embodiment (FIGS. 1–3) is installed in the toner supplying apparatus 100 in an image forming apparatus, and is left there so that the toner within the toner supply container 1 is gradually supplied to the development station until the toner within the toner supply container 1 is depleted. In other words, it is of the so-called built-in type. However, the present invention does not require that the type of the toner supply container 1 is limited to the one described above; the present invention is also applicable to, for example, a toner supply container of the so-called integral type, which not only holds toner but also supplies it to the development station.

Figure 4:
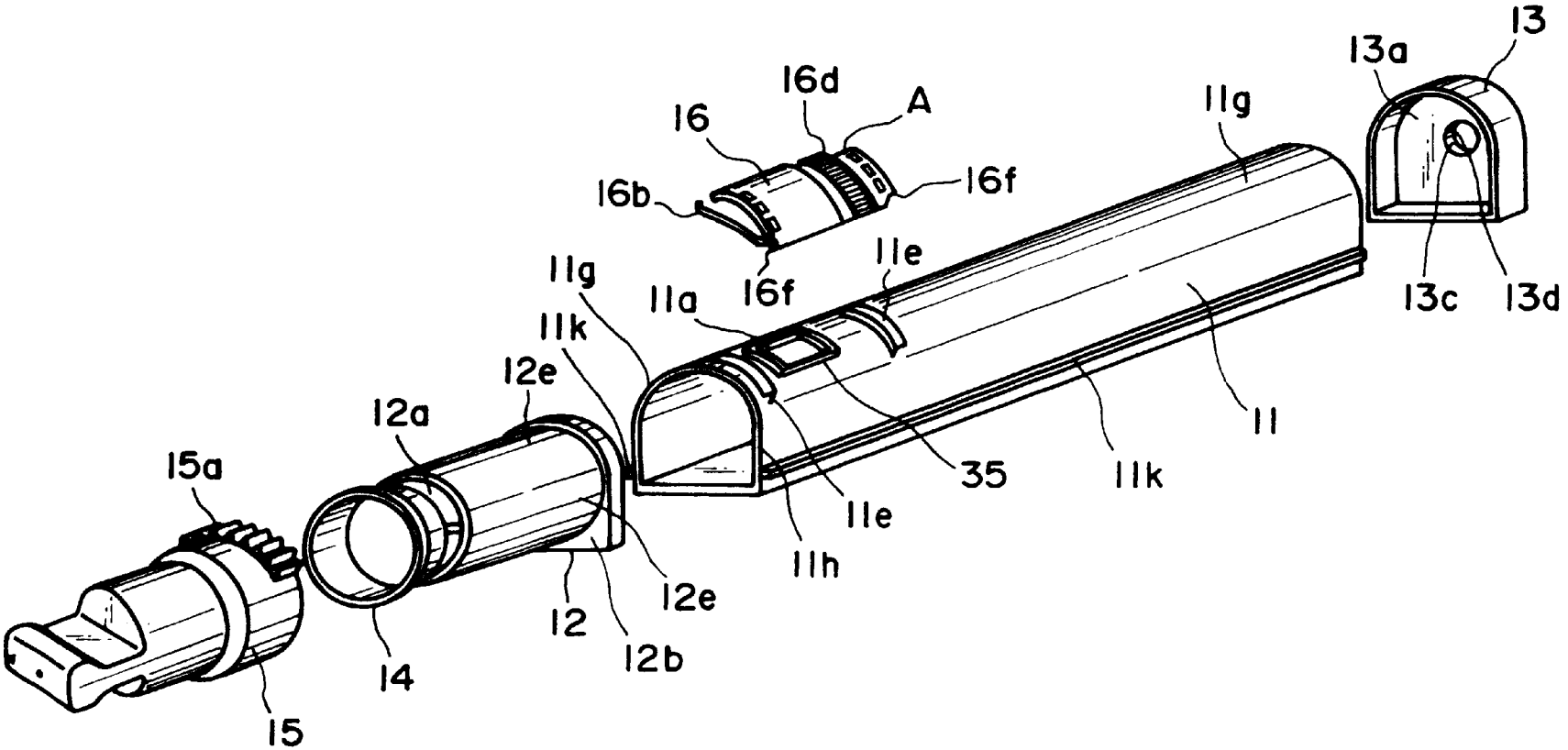
FIG. 4 is an exploded perspective view of the toner supply container.
Figure 5:
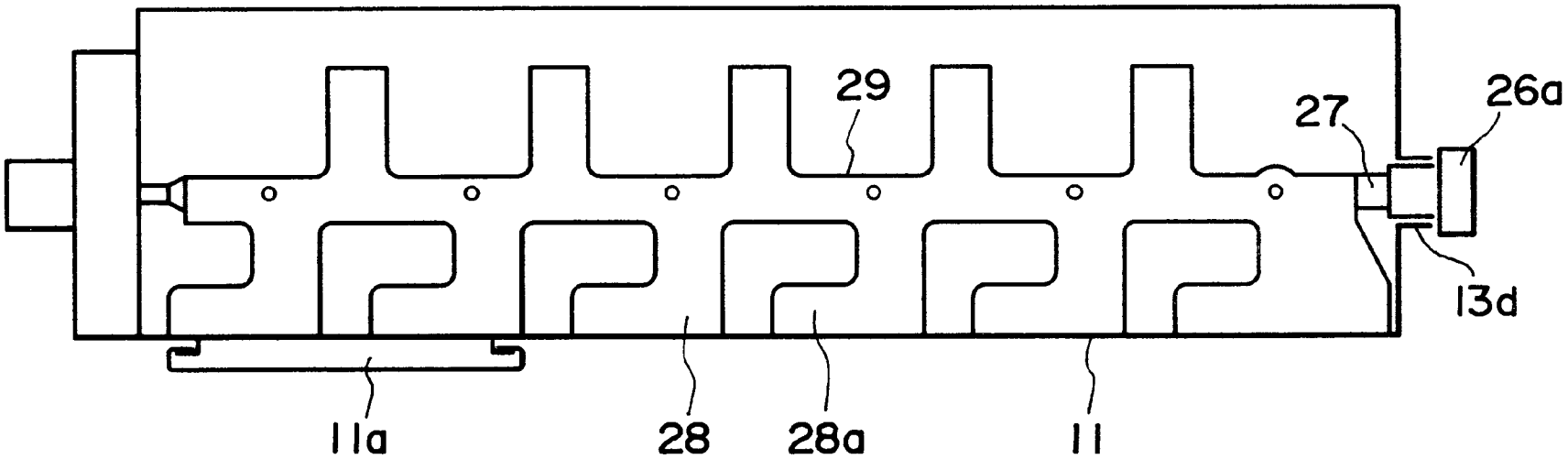
FIG. 5 is a longitudinal sectional view of the toner supply container.

Referring to FIG. 4, a schematic exploded view of the aforementioned toner supply container 1, the toner supply container 1 has a toner containing portion 11 which is the main portion, and first and second flanges 12 and 13, respectively, which are attached to the corresponding longitudinal ends of the toner containing portion 11. It also has a cap 14 which is inserted into the first flange 12, and a handle 15, a rotational member, which is rotationally fitted around the first flange 12. Further, it has a container shutter 16 which exposes or covers the toner outlet 11*a* of the toner containing portion 11. Within the toner containing portion 11, a toner conveying member 29 is disposed as a toner conveying means (FIG. 5).

Toner Container

Referring to FIG. 4, the toner containing portion 11 is shaped so that its cross section perpendicular to its longitudinal direction becomes a combination of an approximately semi-circular portion 11*g* and a rectangular portion 11*h*. It is in the form of a hollow tube with the above described cross section, and the toner is stored within this toner containing portion 11. The toner containing portion 11 is provided with a toner outlet 11*a*, which is in the curved wall portion of the toner containing portion 11. The toner containing portion 11 is also provided with a pair of shutter supporting members 11*e*, which are located on the curved wall portion of the toner containing portion 11, one on the front side of the toner outlet 11*a* and the other on the rear side, in terms of the longitudinal direction of the toner containing portion 11, and extend in the circumferential direction of the toner containing portion 11. The container shutter 16 is supported by the supporting members 11*e* so that the container shutter 16 can take a closing position (FIG. 11) at which the container shutter 16 seals the toner outlet 11*a*, or an exposing position (FIG. 12) to which the container shutter 11 retreats to expose the toner outlet 11*a*.

Further, the toner containing portion 11 is provided with a pair of guiding portions 11*k*, which run in the longitudinal direction of the toner containing portion 11 along the lateral longitudinal edges of the toner containing portion 11. These guiding portions 11*k* are members which regulate the toner supply container 1 so that the toner supply container 1 moves in a straight line when the toner supply container 1 is installed into, or removed from, the toner supplying apparatus 100.

As described above, in this embodiment, the toner containing portion 11 is in the form of a tube, the cross section of which is such that its top half is semicircular and its bottom half is rectangular. However, the shape of the toner containing portion 11 does not need to be limited to the above described one. For example, the toner containing portion 11 may be shaped so that its cross section perpendicular to its longitudinal direction is circular, elliptical, or square. Further, there is no specific restriction regarding the structure and component count of the toner containing portion 11.

The toner containing portion 11 is filled with toner in the powder form (hereinafter, all toners are in the powder form). There are various classifications of toner: black toner, color toner, single component magnetic toner, single component nonmagnetic toner, and the like. From among these various classifications of toners, toner is selected as appropriate.

Structures of First and Second Flanges 12 and 13

The first and second flanges 12 and 13 are in the form of a hollow tube, which exactly fits into the corresponding longitudinal ends of the toner containing portion 11. After being exactly fitted into the corresponding longitudinal ends of the toner containing portion 11, they are fixed to the toner containing portion 11 with the use of adhesive to seal the toner containing portion 11. The first flange 12 comprises an end plate 12*b* and a cylindrical portion 12*e*. The axial line of the cylindrical portion 12*e* coincides with the longitudinal center line of the semicylindrical portion 11*g* of the toner containing portion 11. The first flange 12 comprises a toner inlet 12*a*, which runs within the cylindrical portion 12*e*. The second flange 13 comprises an end plate 13*a*.

The first and second flanges 12 and 13 may be integral with the toner containing portion 11, or a part of the toner containing portion 11. In other words, the main section of the toner containing portion 11 may be a single piece component.

Figure 36:
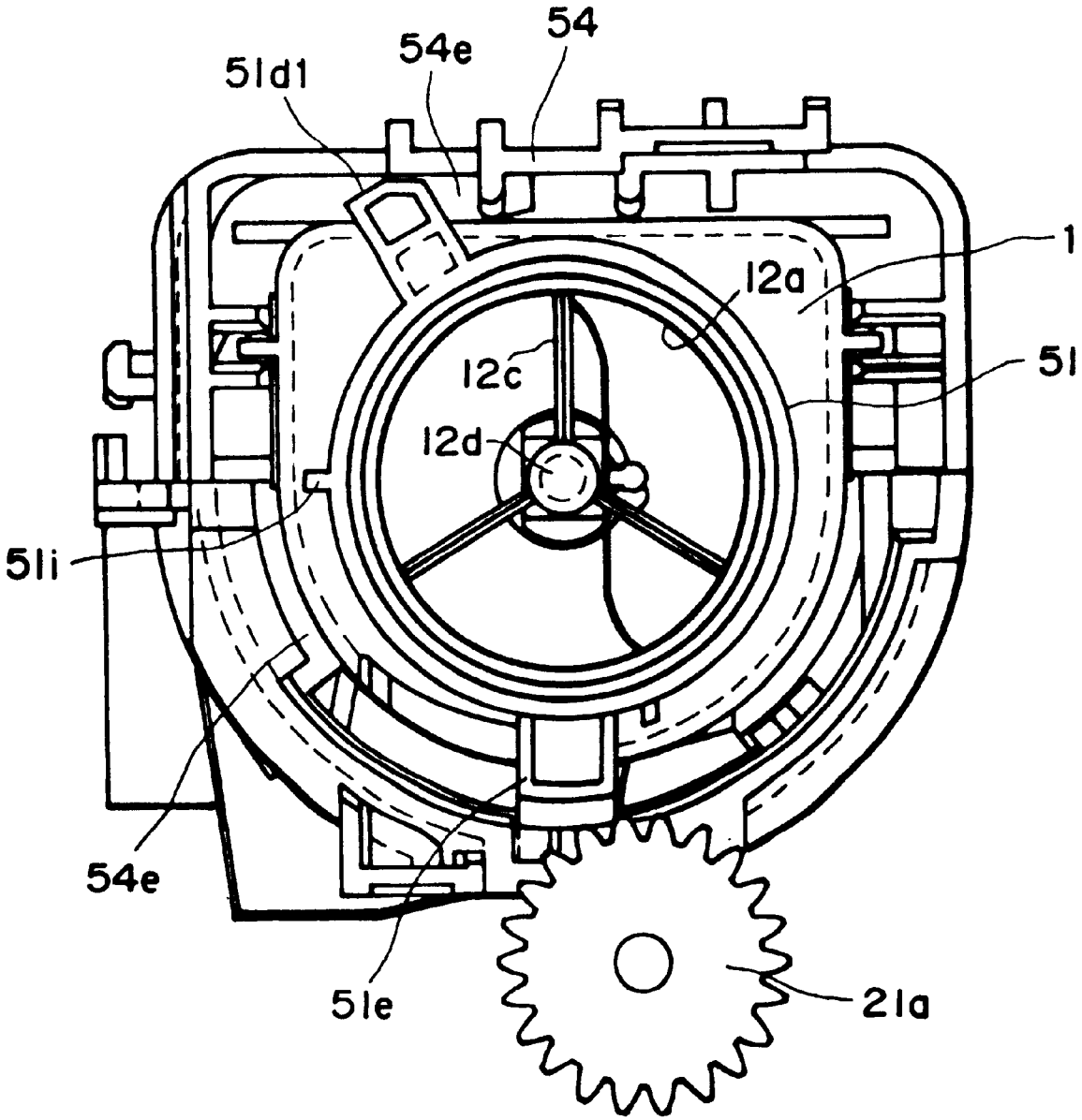
FIG. 36 is a front view illustrating a state in which the toner supply container from which the handle has been demounted, is mounted to the toner supply device.
Figure 37:
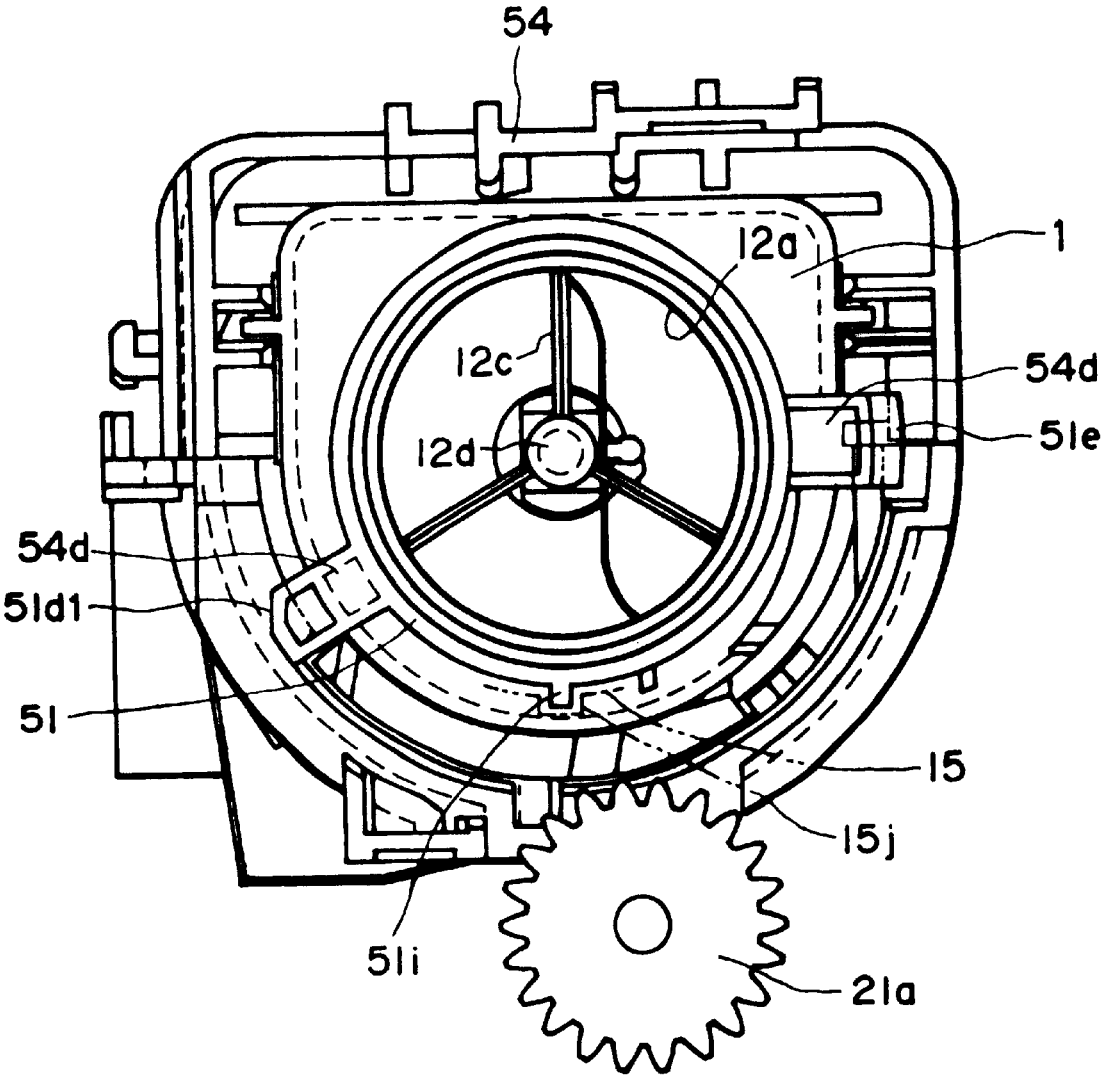
FIG. 37 is a front view illustrating a state in which the toner supply container from which the handle has been removed, is inserted into the toner supply device.

As described above, the first flange 12 is provided with the toner inlet 12*a*, the opening of which is located at the longitudinal end, on the upstream side in terms of the direction in which the toner containing portion 11 is inserted. The toner inlet 12*a* is provided with internal ribs 12*c*, which radially fit within the toner inlet 12*a* (FIGS. 36 and 37). Also, the toner inlet 12*a* is provided with a cylindrical hollow shaft, the axial line of which coincides with that of the toner inlet 12*a*, and which supports the axle of the toner conveying member which will be described later. Around the cylindrical portion 12*e*, i.e., the cylindrical wall of the toner outlet 12*a*, a handle 15, which will be described later, is fitted. After the toner is filled, the toner inlet 12*a* is sealed by fitting a cap 14 into the toner inlet 12*a*. Then, the first flange 12 is unitized with the toner containing portion 11 by an appropriate joining means.

The end plate 13*a* of the second flange 13 is provided with a hole 13*c*, into which a driving force transmitting bearing (for example, coupling) for bearing the axle of the toner conveying member 29 and also transmitting the driving force, is fitted from outside the toner containing portion 11. Further, the end plate 13*a* is provided with a cylindrical portion 13*d* (FIGS. 4 and 5), which projects outward from the outer edge of the hole 13*c* and supports the peripheral surface of the aforementioned coupling.

Handle

Figure 7:
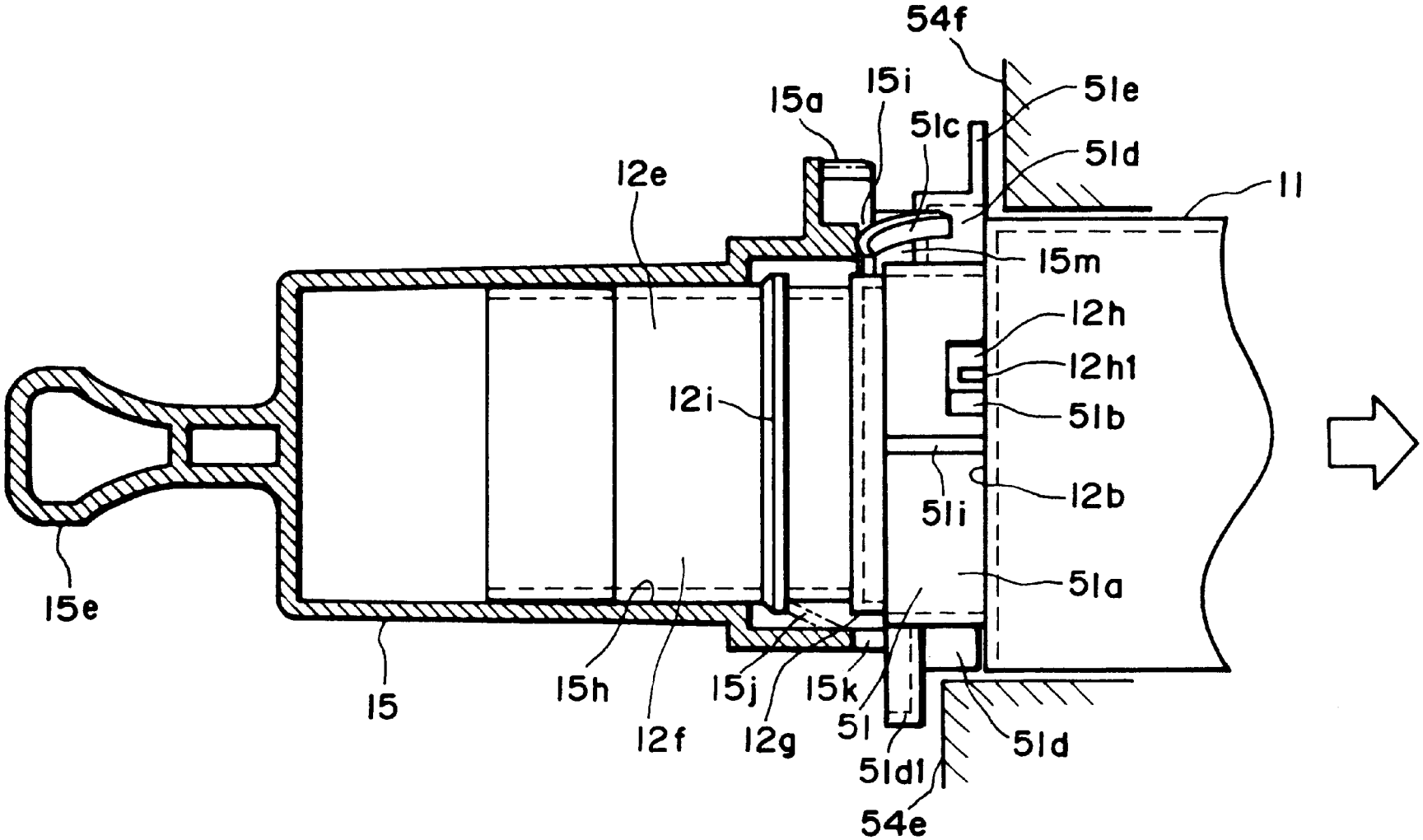
FIG. 7 is a side view illustrating a handle locking state (locked state).
Figure 8:
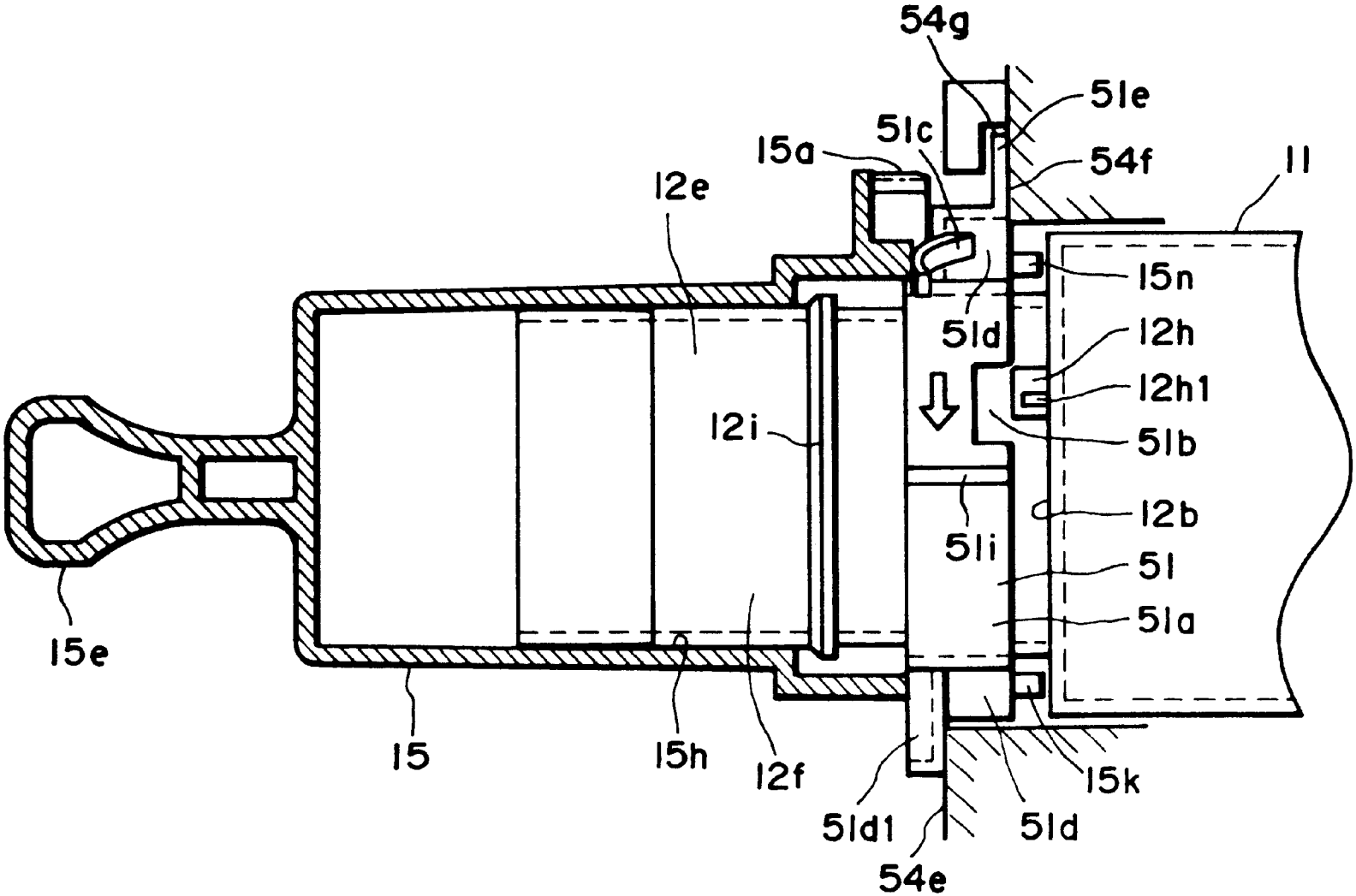
FIG. 8 is a side view of the handle locking (released state).

The handle 15, a rotational member, basically comprises three sections: a knob section 15*e*, a cylindrical hollow section 15*h* (middle section) with a smaller diameter, and a cylindrical hollow section with a larger diameter. The knob section 15*e* is the outward end of the handle 15, and is in the form of a thick plate with a thicker end. The cylindrical hollow section with a larger diameter is the inward end of the handle 15, and is open on the inward side. The handle 15 is rotationally attached to the toner containing portion 11 by manually fitting the middle section 15*h* around a handle supporting portion 12*f*, which is a part of the cylindrical portion 12*e* located at one of the longitudinal ends of the toner containing portion 11 (FIGS. 7 and 8). The handle 15 also comprises an engaging portion 15*a*, which is a driving force transmitting portion, for transmitting the driving force. The engaging portion 15*a* is on the outward facing surface of the handle 15.

Figure 6:
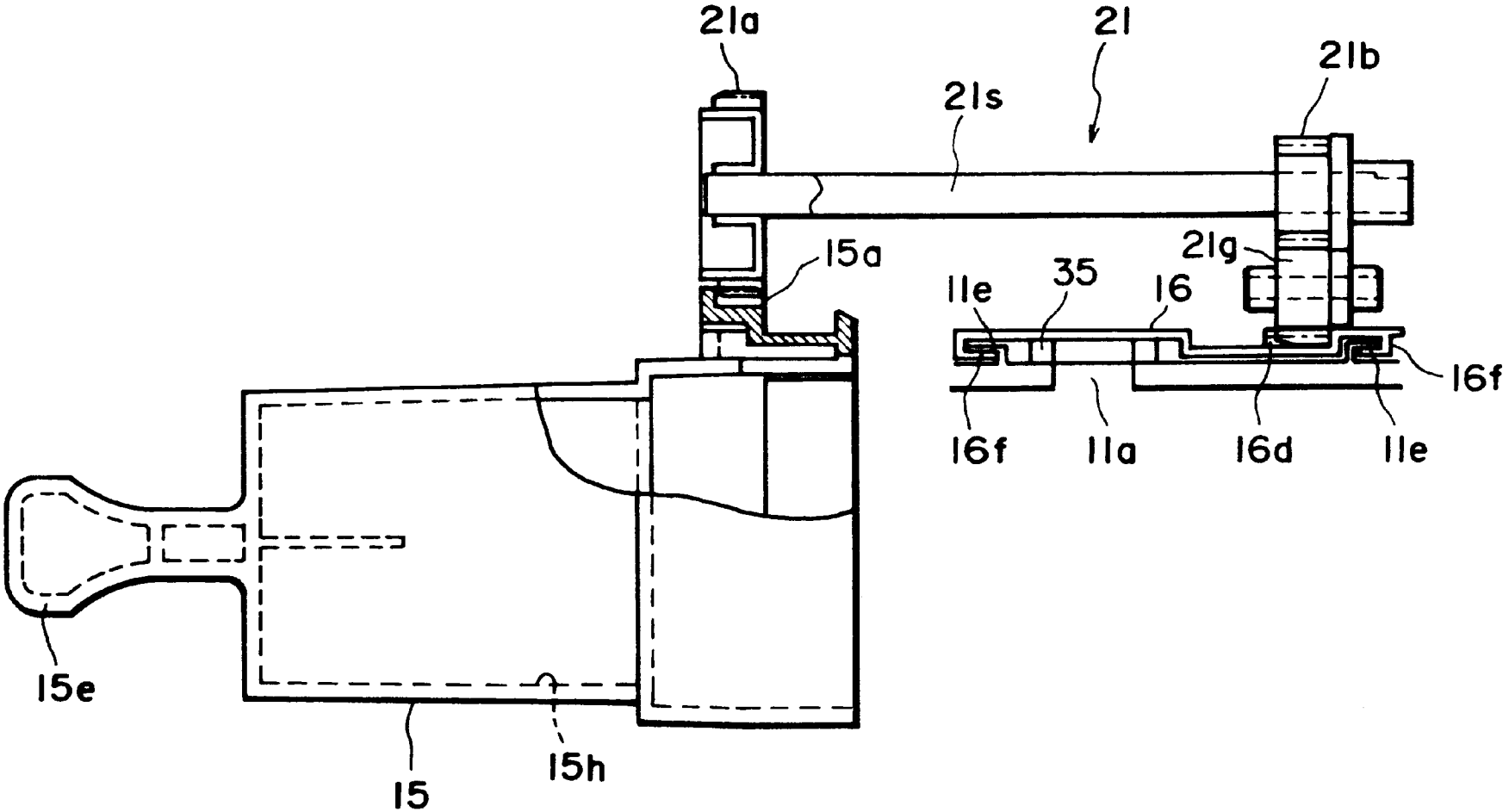
FIG. 6 is a development of a side of a container shutter illustrating a driving system therefor.
Figure 10:
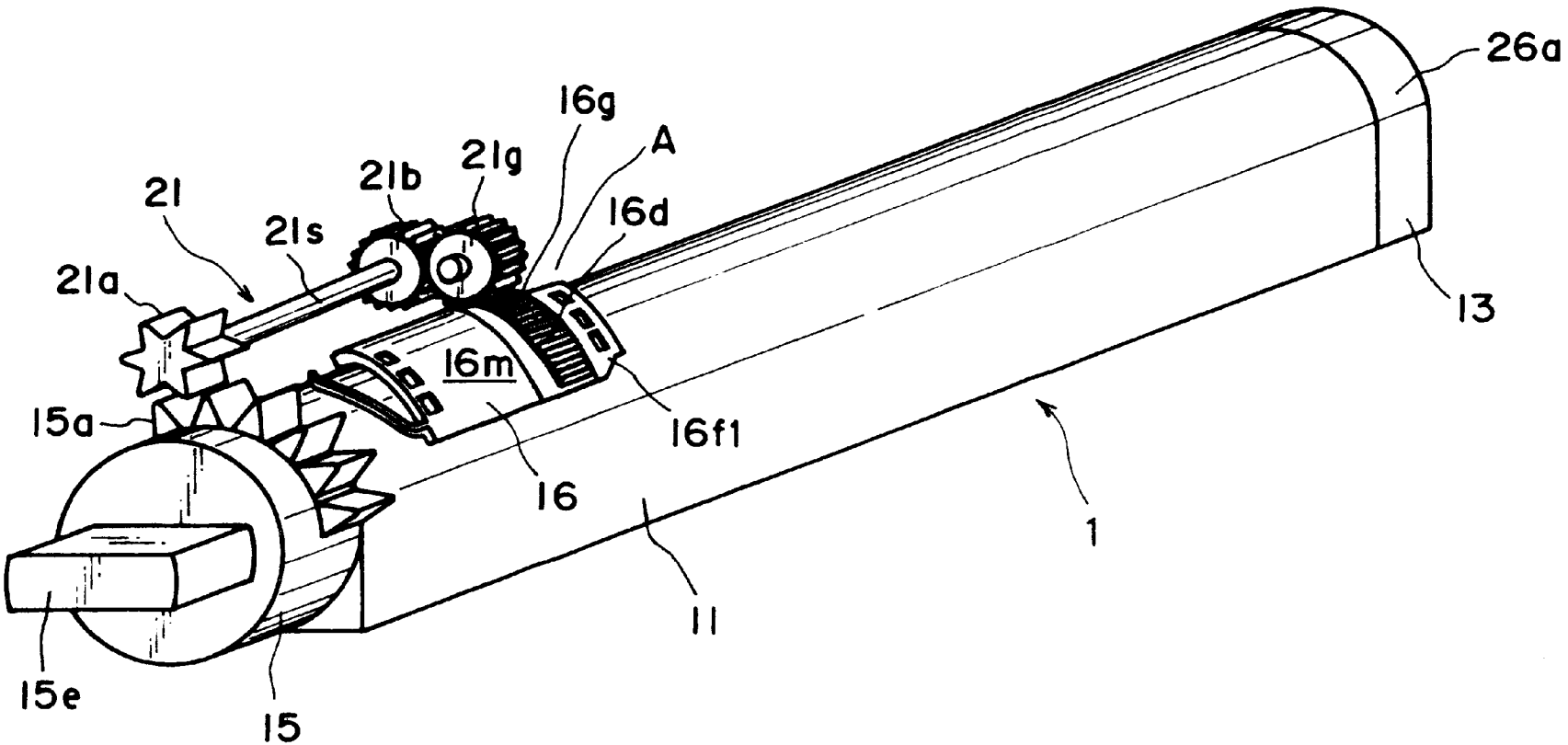
FIG. 10 is a perspective view illustrating a driving force transmission member of the toner supply container.

Referring to FIGS. 6 and 10, the engaging portion 15*a* is in the form of a segment gear so that when the toner supply container 1 is inserted into the toner supplying apparatus 100, the engaging portion 1*a* can engage with the engaging portion 21*a* of a driving force transmitting member 21 with which the toner supplying apparatus 100 is provided. The engaging portion 15*a* is engageable with the engaging portion 21*a* through a sequential operation for inserting the toner supply container 1.

Also referring to FIGS. 6 and 10, the diving force transmitting member 21 as a rotational force transmitting means comprises a shaft 21*s*, the engaging portion 21*a* for receiving the driving force, and an engaging portion 21*b* for transmitting the driving force. The shaft 21*s* is fitted with the engaging portions 21*a* an 21*b*, one for one at its longitudinal ends, and is rotationally supported by the toner supplying apparatus 100. The engaging portions 21*a* and 21*b* comprise gears with multiple teeth. The engaging portion 21*a* on the driving force reception side in this embodiment comprises a single gear. However, there is no specific restriction regarding the structure or gear count of the engaging portion 21*a* as long as it is structured to function as a mechanism for receiving the driving force. The engaging portion 21*b* on the driving force transmission side is meshed with the engaging portion 21*g* on the driving force transmission side as an idler gear which is meshed with the engaging portion 16*d*, a segment gear, on the driving force reception side. In this embodiment, the driving force transmitting member 21, a member comprising the shaft 21*s*, and engaging portions 21*a*, 21*b* and 21*g*, is provided on the apparatus main assembly 124 side of the image forming apparatus.

Toner Conveying Member

Referring to FIG. 5, one end of a shaft 27 for supporting the toner conveying member 29 is rotationally borne by the hole 12*d* (FIG. 37), and the other end of the shaft is borne by the bearing 13*d* fitted in the shaft hole 12*d* so that the rotational driving force is transmitted through the coupling 26*a* fixed to this end of the shaft 27. Further, the toner conveying member 29 comprises a toner conveying wing 28, which is a flexible member fixed to the shaft 27. The coupling 26*a* is rotationally supported by the toner containing portion 11.

The toner conveying wing 28 rubs against the inward surface of the toner containing portion 11. The toner conveying wing 28 comprises a plurality of segments with a winglet 28*a*. The toner outlet 11*a* side of the winglet 23*a* is bent away from the rotational direction of the toner conveying wing 28 so that the toner in the toner containing portion 11 can be conveyed toward the toner outlet 11*a*. The toner outlet 11*a* is located on the upstream side in terms of the direction in which the toner supply container 1 is inserted into the apparatus main assembly 124. Thus, all winglets 28*a* extend in the same direction. However, it is not mandatory that all winglets 28*a* extend in the same direction; the winglets 28*a* may be different in their extending direction, depending on the positioning of the toner outlet 11*a*. After the toner supply container 1 is inserted into the toner supplying apparatus 100, the aforementioned coupling 26*a* receives the driving force by meshing with the coupling 44 (FIG. 19) provided on the toner supplying apparatus 100 side, and rotates the toner conveying member 29.

As long as the toner within the toner containing portion 11 can be conveyed to the toner outlet 11*a*, the provision of the toner conveying member 29 is not mandatory. However, the provision of the toner conveying member 29 assures reliable suppliance of the toner.

Figure 9:
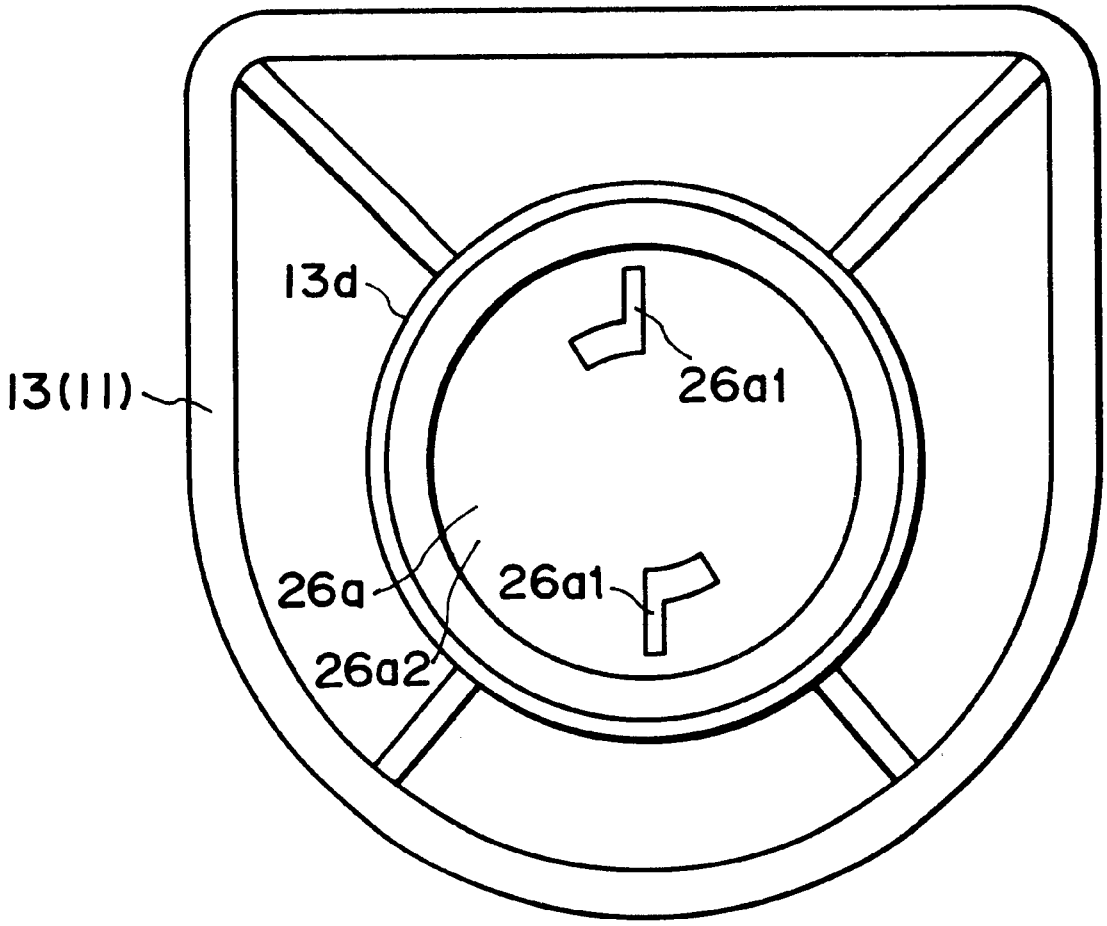
FIG. 9 is a back side view of the toner supply container.

Next, referring to FIG. 9 which depicts the driving force receiving end portion of the toner supply container 1, a coupling 26*a* as a driving force receiving member is rotationally supported by the end plate of the toner containing portion 11. Both ends of the coupling 26*a* in the axial direction are in the form of a shaft coupler. One end of the coupling 26*a* is positioned within the toner containing portion 11, and is coupled with one end of the shaft 27 of the toner conveying member 29, whereas the other end of the coupling 26*a*, which is positioned outside the toner containing portion 11, is provided with a rotational force receiving portion. As the toner supply container 1 is installed into the apparatus main assembly 124, this rotational force receiving portion couples with the coupling 44 provided on the toner supplying apparatus 100 side to transmit the rotational force. Referring to FIG. 9, the rotational force receiving portion is in the form of a projection 26*a*1, a part of which extends in the radial direction of the coupling 26*a*. The couplings 26 and 44 couple with each other as the projections 44*a* of the coupling 44 fit into the two spaces 26*a*2 between the two projections 26*a*1, one for one.

Container Shutter

Referring to FIG. 4, the container shutter 16 is provided with a pair of sliding portions 16*f*, which are located at the longitudinal ends, in terms of inserting direction of the toner supply container 1, of the container shutter 16, one for one. The sliding portions 16*f* engage, one for one, with a pair of shutter supporting members 11*e* as guiding members which extend on the toner containing portion 11 in the circumferential direction of the toner containing portion 11 along the curved edges of the toner outlet 11*a*, one on the front side and the other on the back side of the outlet 11*a*, in terms of the inserting direction of the container 1. The container shutter 16 slides in the circumferential direction of the toner containing portion 11 to expose or seal the toner outlet 11*a*. More specifically, the cross section of the container shutter 16 perpendicular to the longitudinal direction of the toner supply container 1 is in the form of an arc, the curvature of which is such that the container shutter 16 perfectly fits along the outer surface of the cylindrical portion 11*g* of the toner containing portion 11. As for the sliding portions 16*f* and shutter supporting members 11*e*, their cross section at a plane which includes the axial line of the theoretical hollow cylinder to which the container shutter 16 belongs, are in the form of an interlocking hook (FIG. 6). The shape of the cross section of shutter supporting member 11*e*, i.e., the interlocking hook, is the same across the entire length of the member.

Figure 20:
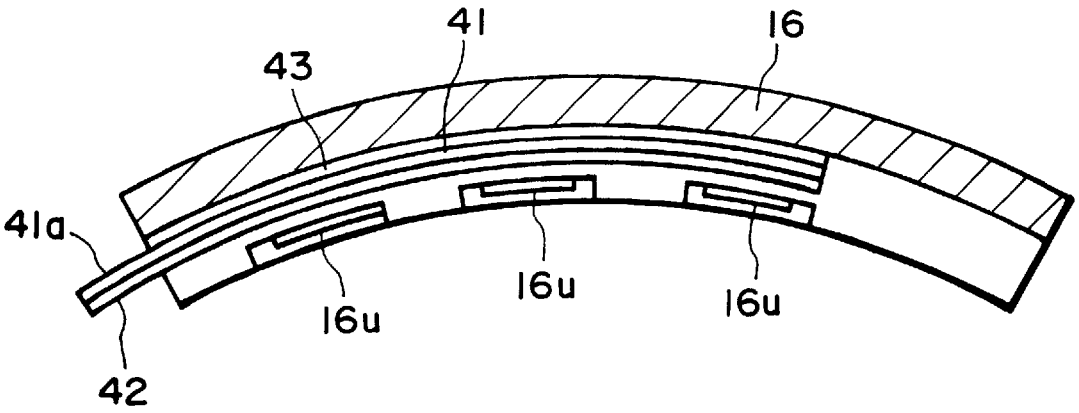
FIGS. 20(*a*) and 20(*b*) are sectional views of container shutters.
Figure 20:
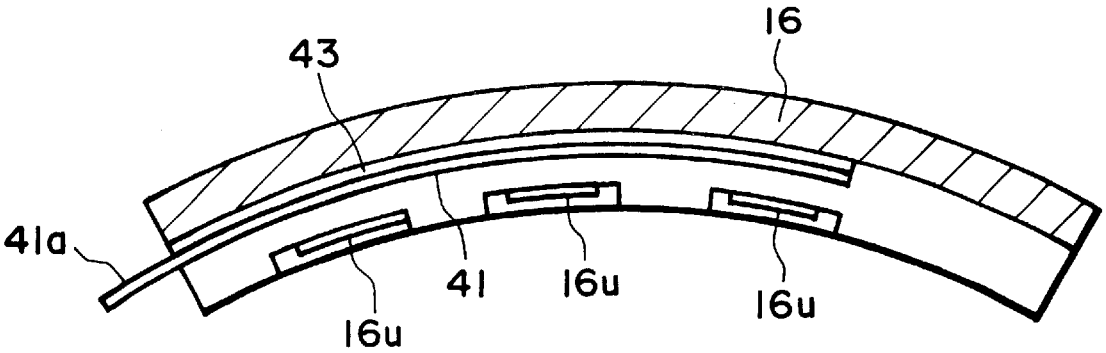
Figure 21:
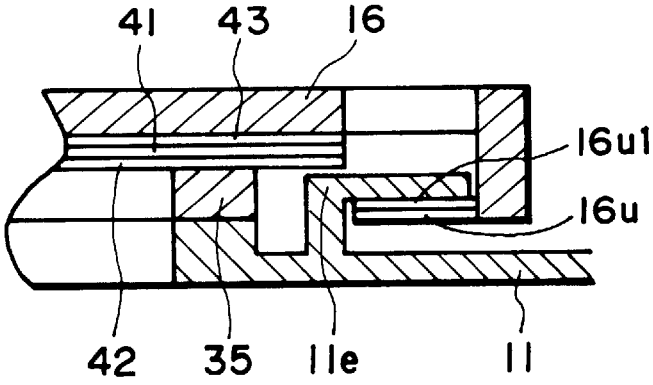
Figure 44:
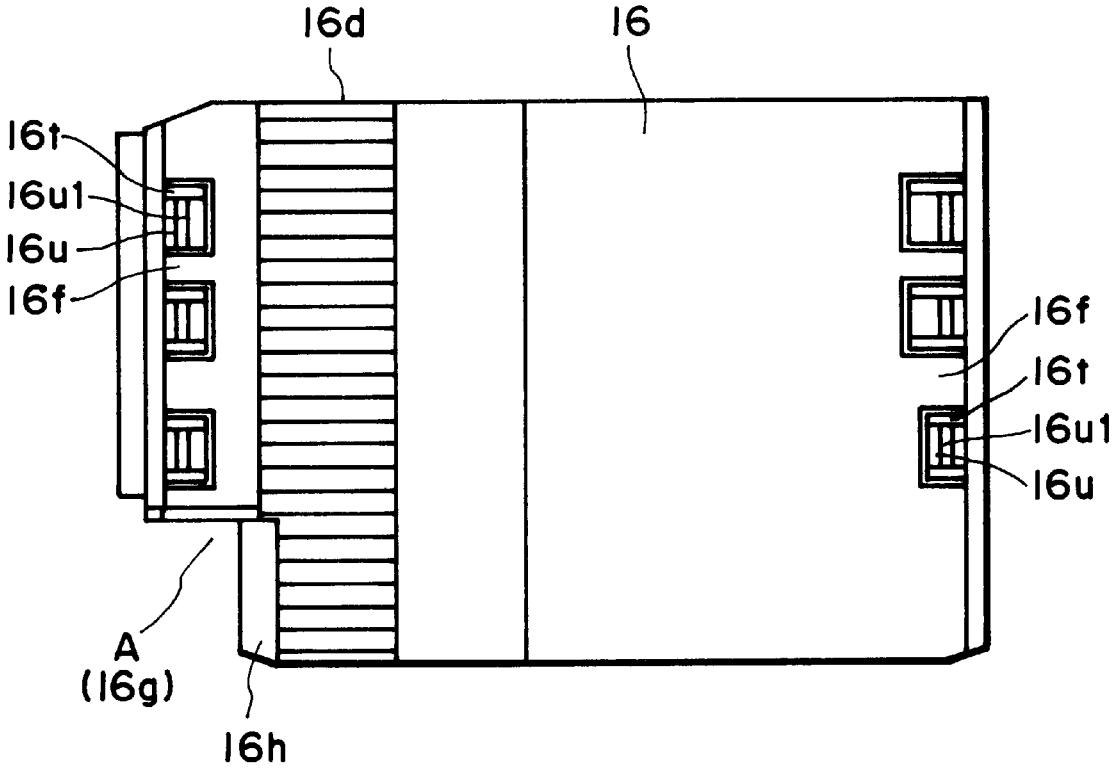
FIG. 44 is a top plan view of a container shutter.

Referring to FIGS. 20(*a*), 20(*b*), 21, 39, 40 and 44, the sliding portion 16*f* is provided with a plurality of small hook-like horizontal projections 16*u* which extend inward, relative to the toner outlet 11*a*, from the upright base portion of the sliding portion 16*f*. The locations of these hook-like horizontal projections 16*u* correspond one for one with the locations of the plurality of through holes 16*t* cut through the container shutter 16 along its curved edges. Referring to FIG. 44, each of these horizontal hook-like projections 16*u* is provided with a tiny projection 16*u*1 in the form of a character H or T (projects toward the reader side of this page), which is located on the surface of the projection 16*u*, which faces the shutter supporting member 11*e*. Each projection 16*u* functions as an elastic member which generates a predetermined amount of pressure for keeping the container shutter 16 tightly in contact with the elastic packing 35. Therefore, even if the pressure which each projection 16*u* receives from the elastic packing 35 varies depending upon the location of the container shutter 16 during the opening or closing of the container shutter 16, the presence of the plurality of projections 16*u* averages out the amount of pressure which keeps the container shutter 16 in contact with the elastic packing 35 (FIG. 21).

Referring to FIG. 10, the container shutter 16 is provided with the aforementioned driving force receiving engaging portion 16*d* as a member for receiving the rotational force which is enabled to engage with a gear as the aforementioned driving force transmitting engaging portion 21*g* as the toner supply container 1 is installed into the toner supplying apparatus 100. This engaging portion 16*d* is provided with a plurality of teeth, and is enabled to engage with the driving force transmitting engaging portion 21*g* through a sequence of operations for inserting the toner supply container 1 into the toner supplying apparatus 100. The driving force receiving engaging portion 16*d* is cut in the outer surface 16m of the container shutter 16. In other words, the diameter of the theoretical circle which includes the tooth tips of the segment gear, and the diameter of the theoretical circle which includes the outer surface of the container shutter 16 are rendered practically the same so that space can be saved in terms of the radial direction of the toner supply container 1. Since the engaging portion 16*d* must be engaged, or disengaged, with the driving force transmitting engaging portion 21*g*, it is cut in the outer surface of the container shutter 16, close to the curved edge on the coupling 26*a* side. With this arrangement, the engaging portion 16*d* engages with, or disengages from, the driving force transmitting engaging portion 21*g* when the container shutter 16 is in the closed state. As described before, the driving force transmitting engaging portion 21*g* with which the toner supplying apparatus 100 is provided, and the driving force receiving portion 16*d* with which the container shutter 16 is provided, are engaged through a sequence of operations for inserting the toner supply container 1 into the toner supplying apparatus 100. Therefore, the sliding portion 16*f* (16*f*1) of the container shutter 16, on the side where the coupling 26*a* is provided, is made shorter than the driving force receiving engaging portion 16*d* (portion designated by a referential character A in FIGS. 4, 10 and 44). In other words, the sliding portion 16*f*1 is desired to be configured so that the plane of the edge surface 16*h* of the container shutter 16, on the downstream side in terms of the longitudinal direction of the toner containing portion 11, which squarely faces the driving force transmitting engaging portion 21*g* when the toner supply container 1 is inserted into the toner supplying apparatus 100, coincides with the plane of the surfaces of the teeth of the driving force receiving engaging portion 16*d*, on the downstream side in terms of the inserting direction of the toner supply container 1. Therefore, in this embodiment, a portion 16*g* is removed to shorten the sliding portion 16*f*1. Of the two surfaces created by removing the portion 16*g*, the one perpendicular to the longitudinal direction of the toner containing portion 11 is the aforementioned edge surface 16*h*. With this arrangement, the driving force transmitting engaging portion 21*g* and the container shutter 16 do not interfere with each other.

When the container shutter 16 is thick, the sliding portion 16*f*1 is extended across the entire curved edge of the container shutter 16, and in order to prevent the driving force transmitting engaging portion 21*g* from colliding with the sliding portion 16*f*1, the sliding portion 16*f*1 is provided with an indentation as an equivalent of the aforementioned missing portion 16*g* to allow the driving force transmitting engaging portion 21*g* to pass.

Figure 11:
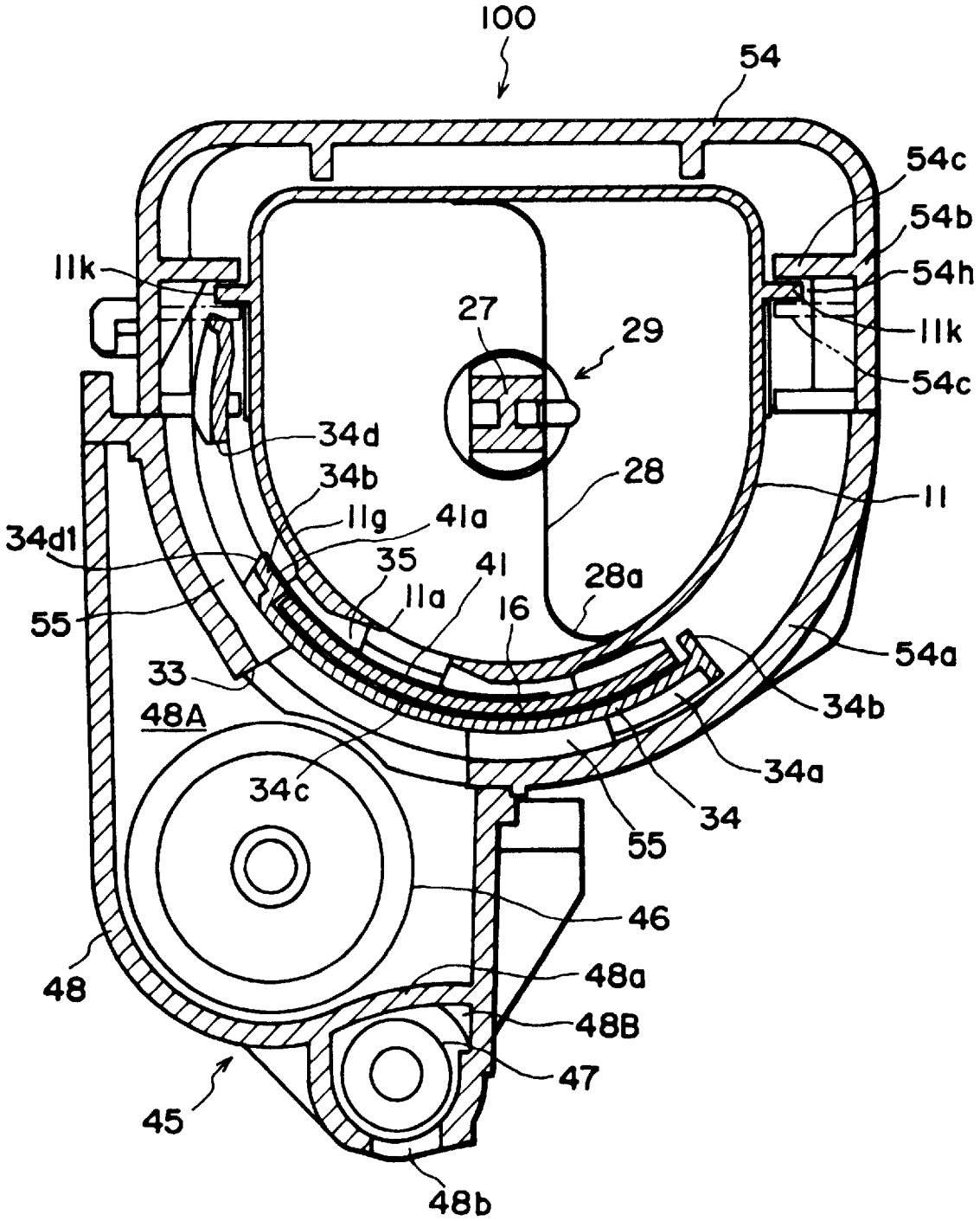
FIG. 11 is a front sectional view of the toner supply device wherein the shutter is in the closed position.

Referring to FIG. 11, the container shutter 16 fits in an indented portion 34*c* formed between the surfaces 34*b*1 of the shutter 34 on the main apparatus side, which exposes or seals the toner inlet 33 with which the toner supplying apparatus 100 is provided. Being fitted in the indented portion 34*c*, the container shutter 16 can cause the shutter 34 on the main apparatus side to slide as the container shutter 16, which is on the side of the toner supply container 1, is slid.

Figure 3:
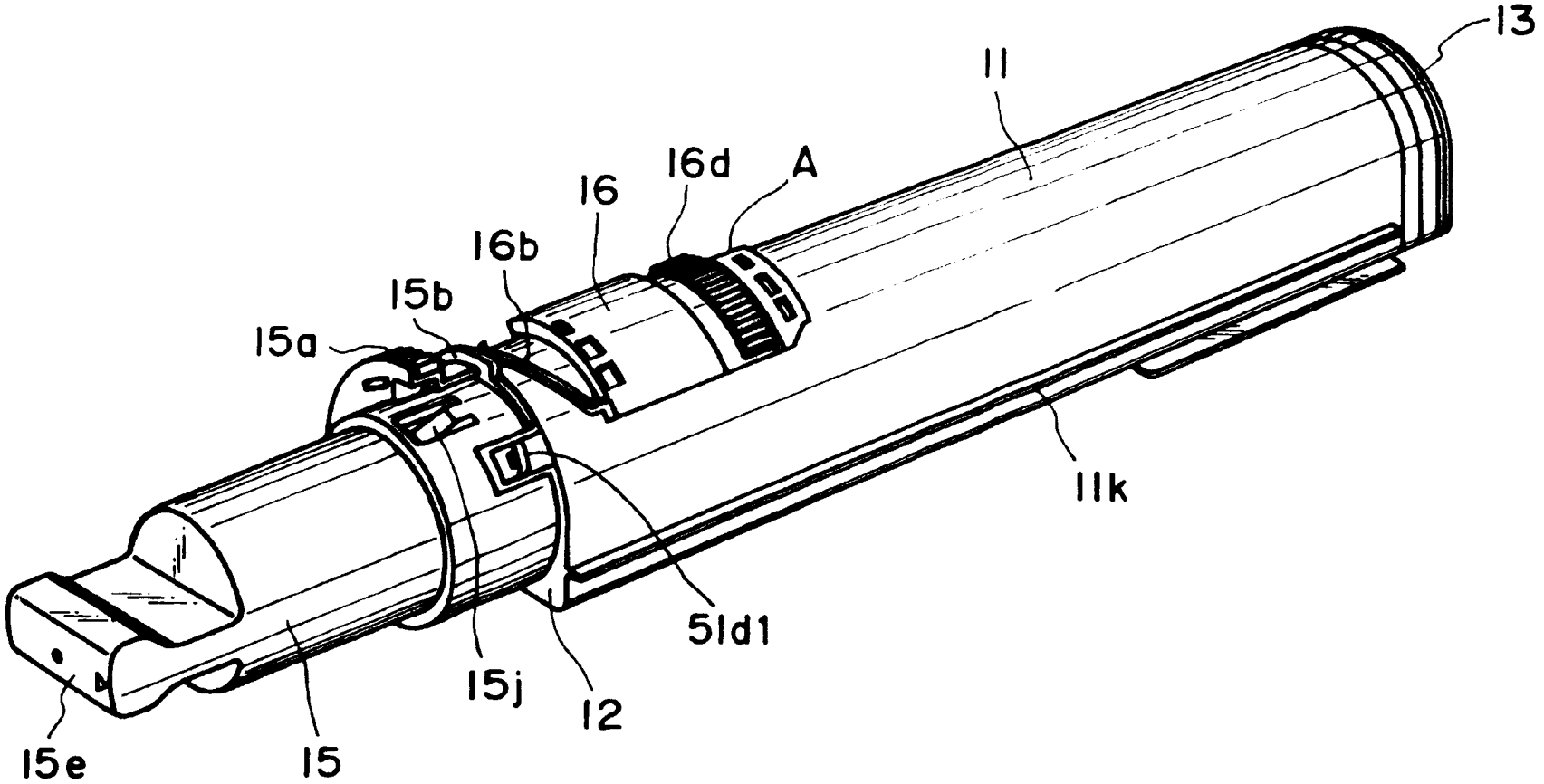
FIG. 3 is a perspective view of the toner supply container ,which is upside down.

In this embodiment, the engaging portion 21*b* and 21*g* on the driving force transmitting side, with which the apparatus main assembly 124 is provided, comprise two gears as shown in FIG. 6. However, as long as a driving force transmitting mechanism is provided, there is no specific restriction regarding its structure, or the number of gears it comprises. Referring to FIG. 3, the container shutter 16 is provided with an elastic portion 16*b* in the form of an arm which generates such pressure that constantly applies to the handle 15 in the longitudinal direction of the toner containing portion 11. The tip of this elastic portion 16*b* is in contact with the flange 15*b* of the handle 15.

Toner Supplying Apparatus

Figure 13:
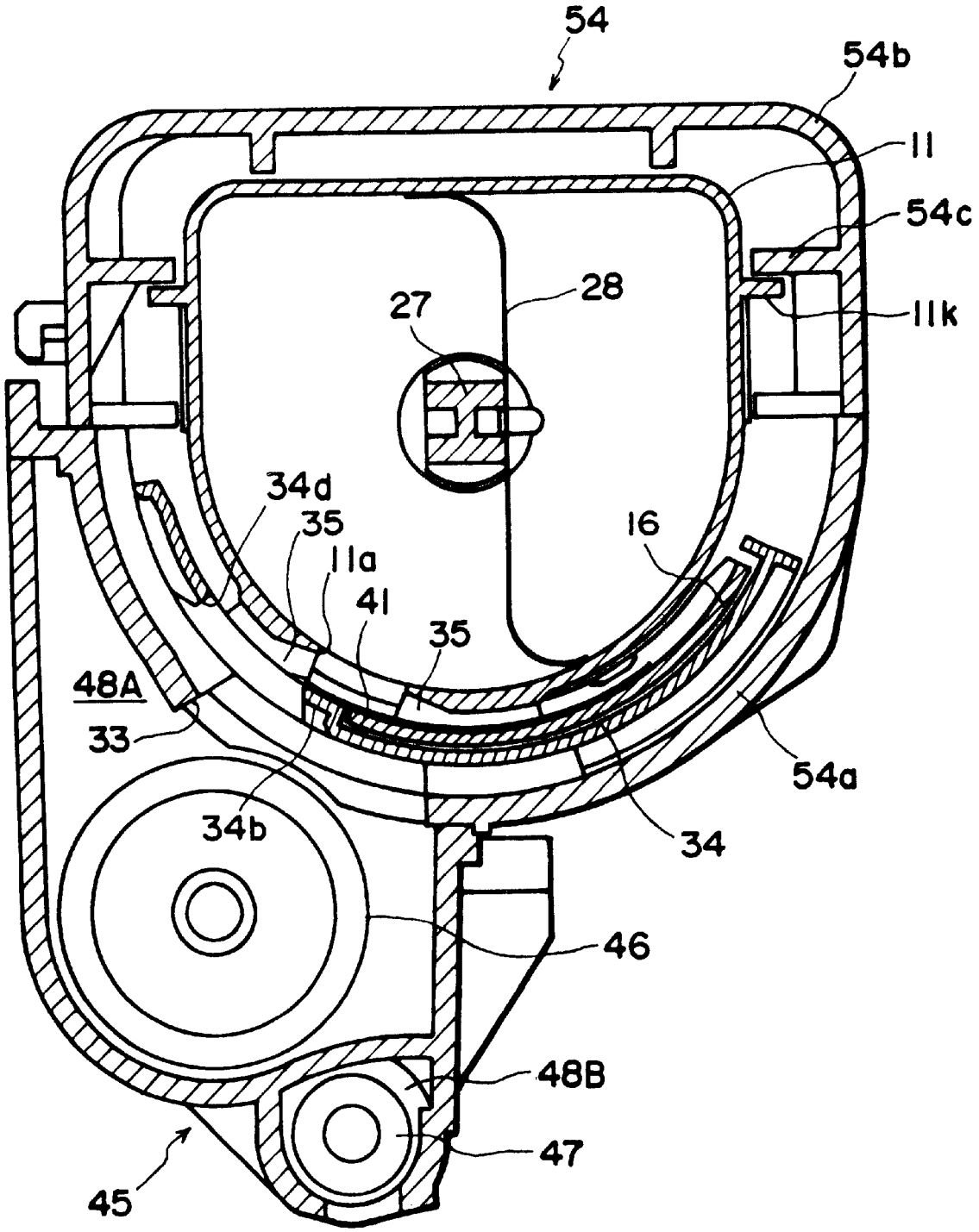
FIG. 13 is a front sectional view of the toner supply device wherein the shutter is moving.

Referring to FIGS. 11–13, the toner supplying apparatus 100 is provided with a toner supplying apparatus main assembly 54, a cartridge receiving portion, which comprises a bottom portion 54*a* and a top portion 54*b*, the cross sections of which in the direction perpendicular to their lengthwise directions are semicircular and rectangular, respectively, to accommodate the toner containing portion 11. The top portion 54*b* is provided with a plurality of projections 54*c* for guiding a pair of guide portions 11*k* of the toner supply container 1. The projections 54*c* are on the inner surface of the top portion 54*b*. One pair of the projections 54*c* are at the entrance of the toner supplying apparatus main assembly 54, one for each side, and the other pairs are aligned inward of the toner supplying apparatus main assembly 54, one half the pairs being above the line correspondent to the position of the guide portion 11*k* and the other half being below the same line. The bottom portion 54*a* is provided with a pair of parallel guide rails 55, which are in the inwardly facing surface of the bottom portion 54*a* and extend in the circumferential direction of the bottom portion 54*a*. The guides 34*a* of the main assembly shutter 34 are engaged one for one in these guide rails 55. The guide rails 55 and the guide 34*a* are hook-like in their cross section, and interlock with each other. As is evident from the above description, there are two guide rails 55 and two guides 34*a*, which are parallel to each other. In other words, the main assembly shutter 34 is supported by the toner supplying apparatus main assembly 54. The radius of the inwardly facing surface of the projection 34*b* of the main assembly shutter 34 is exactly or approximately the same as that of the inwardly facing surface of the container shutter 16. The main assembly shutter 34 is provided with a pair of projections 34*b*, which are located at both edges, one for one, perpendicular to the moving direction of the main assembly shutter 34. The main assembly shutter 34 is provided with a main assembly shutter opening 34*d*. This opening 34*d* has only to be able to expose or seal the toner supply inlet 33; there may be only one cross section, i.e., a section 34*d*1. The width of inwardly facing surface of the main assembly shutter 34, between the two projections 34*b*, in the circumferential direction of the main assembly 54, is approximately the same as the width of the inwardly facing surface of the container shutter 16 in the circumferential direction of the main assembly 54. Therefore, as the toner supply container 1 is inserted into the toner supplying apparatus 100, it perfectly fits into the space 34*c* between the two projections 34*b* of the main assembly shutter 34, which project inward in the radial direction of the toner supply container 1; the two edges of the container shutter 16, which extend in the longitudinal direction of the main assembly 54, come virtually in contact with the corresponding inwardly facing surfaces 34*b*1 of the projections 34*b*. Therefore, as the container shutter 16 is opened or closed, the main assembly shutter 34 moves with the container shutter 16. Thus, if the two shutters 16 and 34 are designed so that the toner outlet 11*a* and the toner supply inlet 33 align with each other, as the container shutter 16 is opened, the toner can be supplied into the developing device 204 by a toner stirring-conveying apparatus 45. The main assembly shutter opening 34*d* and the space 34*c* are immediately adjacent to each other in the circumferential direction of the main assembly shutter 34, being bordered by the projection 34*b*.

Packing Member

The leakage prevention member in the form of a packing member 35 is an elastic member (FIG. 4, FIG. 11–FIG. 17). It functions to provide sealing between the container shutter 16 and the toner discharging opening. Additionally, it prevents toner leakage from the inside of the toner container 11 due to impact thereto because of falling or the like. To accomplish this, the packing member 35 is stuck onto the outer surface of the toner container 11 so as to enclose the toner discharging opening 11*a*. More particularly, the material of the packing member 35 is a rubber material such as silicon, urethane, polyethylene foam or the like rubber material or sponge material, and preferably, it is high density polyurethane foam having a hardness of 20°–70°, a compression set of a not more than 10%, a cell size of 60–300m and a density of 0.15–0.50g with 5–50% compression.

Here, the packing member 35 is inclined, at the portion along the edge of the toner discharging opening 11*a* extending in the longitudinal direction thereof, in a downward direction toward the inside thereof.

The packing member 35 is bonded to the peripheral edge of the toner discharging opening 11*a* by a bonding material or the like.

Seal Member

When the toner supply container 1 is mounted to the toner supply device 100, the container shutter 16 is engaged with a recess 34*c* of the main assembly shutter 34. The recess 34*c* is extended in the longitudinal direction of the main assembly shutter 34, and a surface 34*b*1 functions as a guide for the container shutter 16. At this time, a container side surface of the container shutter 16 at the edge 34*b* of the main assembly shutter opening 34*d* is substantially flush with the container side surface of the main assembly shutter 34. As shown in FIGS. 11–17, the container side surface of the container shutter 16 is provided with a seal member 41. The seal member 41 functioning as a cover member is extended toward downstream with respect to a closing direction of the container shutter so as to cover a container side surface of the abutment edge 34*b* at the opening and closing side of the toner discharging opening 11*a* and the toner supply opening 33. The seal member 41 functions to prevent toner from entering a gaps (FIGS. 16, 17) formed at an engaging portion between the container shutter 16 and the main assembly shutter 34, and the material, the configuration, the dimension, the mounting method therefor may be any if the function is accomplished.

As for the preferable structure for the sealing member 41 in this embodiment, a piece of 125 $\mu$m thick polyester sheet is pasted, as a sealing member, to the container shutter 16 with the use of double-sided adhesive tape (#5000NC: Nitto Denko Co., Ltd. (FIG. 20).

More specifically, since the sealing member 41 is structured to cover the projection 34*b* of the main assembly shutter 34 as described before, it is desired not to interfere with the installation or removal of the toner supply container 11 by hanging up or colliding. The main assembly shutter 34 is not necessarily smooth on the container facing surface. But, the sealing member 41 is required to perfectly conform to the container facing surface of the main assembly shutter 34. Because of requirements such as the above, the sealing member 41 is desired to be formed of flexible sheet or sheet formed of elastic material.

As for the method for attaching the sealing member 41, any of various known attaching means may be employed in addition to the aforementioned double-sided adhesive tape as long as it satisfies the requirement that the sealing member 41 does not peels off in spite of repetitive opening and closing of the container shutter 16 which occurs as the toner supply container 1 is repeatedly installed or removed.

It is most preferable that elastomer be used as the material for the sealing member 41, and the sealing member 41 be integrally formed with the container shutter 16 by two color injection molding. In such a case, it is desired that the elastomer for the sealing member 41 and the material for the container shutter 16 are compatibly selected. Also, the sealing member 41 and container shutter 16 may be formed of the same material. In such a case, they can be integrally formed with the use of a simple method.

Figure 45:
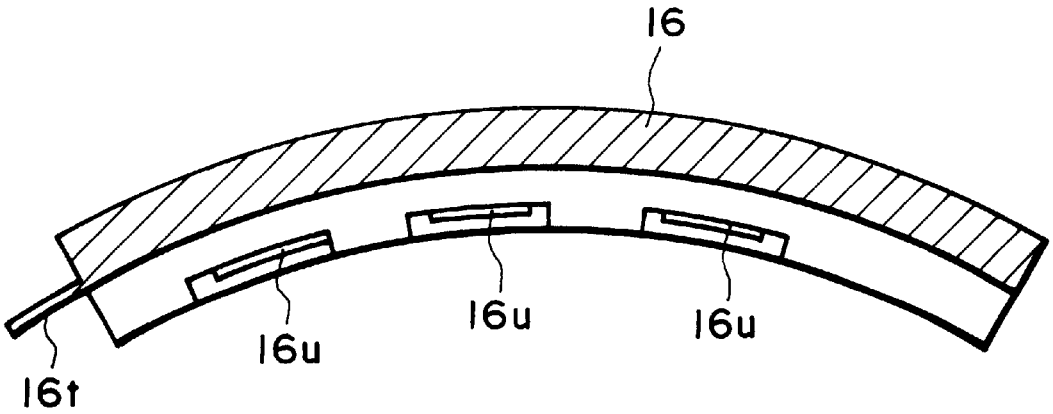
FIG. 45 is a front sectional view of a container shutter according to another embodiment of the present invention.

FIG. 45 is a front sectional view of a container shutter 16 having the same structure as the foregoing example, in which, however, the container shutter 16 and the seal member 41 are made of the same material and are completely integrally molded. More particularly, an end of the container shutter 16 is extended out in the form of a thin film toward the downstream with respect to the opening direction thereof (seal portion 16*t*). The thickness of the seal portion 16*t* is preferably 0.1 mm–0.3mm since then the close contactness relative to the main assembly shutter 34 is proper with proper elasticity. If the thickness of the seal portion 16*t* is larger than 0.3 mm, the follow-up property relative to the container shutter 16 is not enough with the result that sealing property is not sufficient, and if it is not more than 0.1 mm, stable molding is difficult. The material of the container shutter 16 having such a structure may be any synthetic resin material suitable for injection molding. However, polystyrene, acrylonitrile butadiene, styrene copolymer resin material, polyacetal, polypropylene or the like are preferable. Among them, polypropylene material is particularly preferable since it has proper flowability in the molding of the thin portion and proper flexibility for the seal portion.

Function of Sealing Member

Next, the function of the sealing member 41 will be described.

Figure 19:
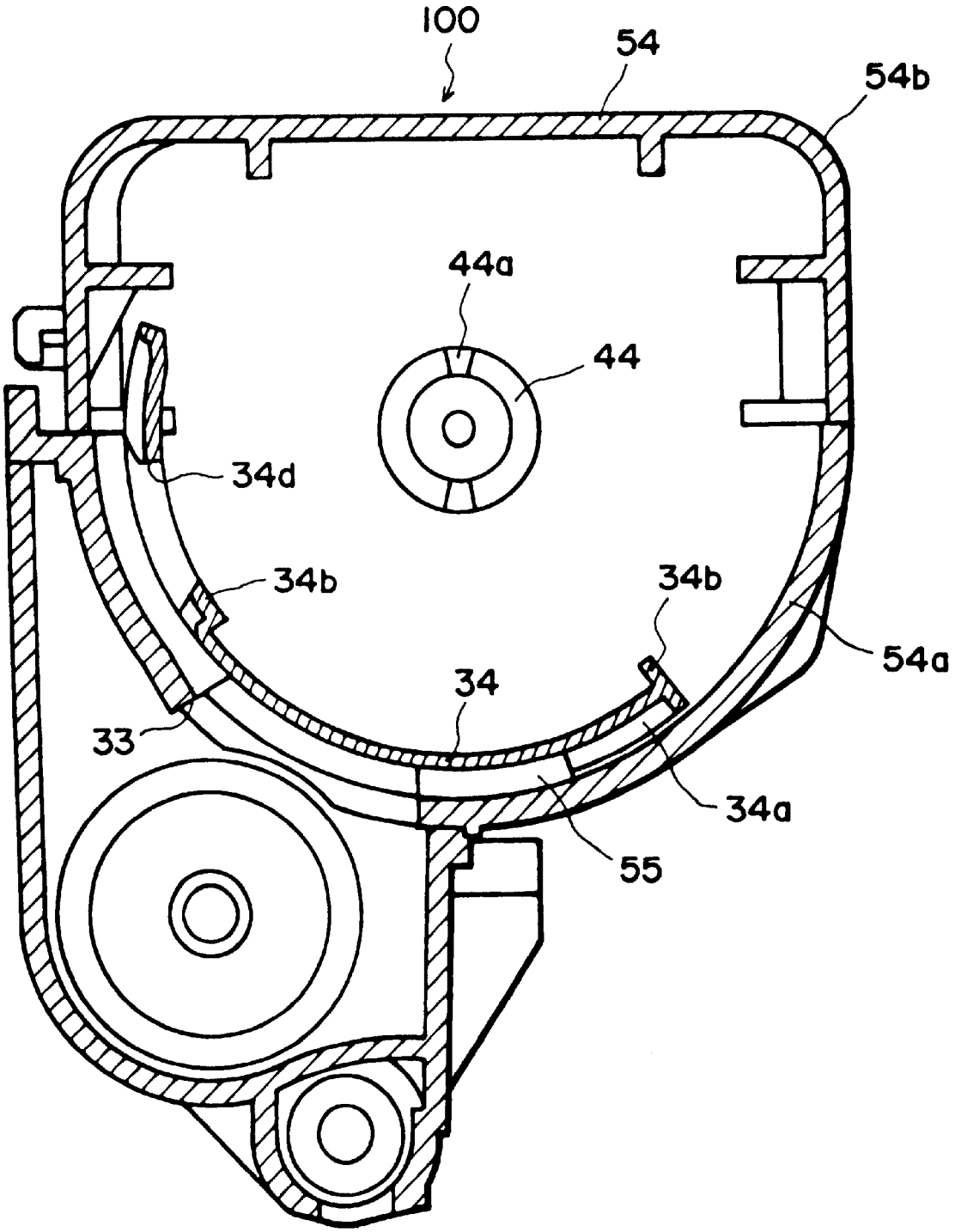
FIG. 19 is a front sectional view of a toner supply device which is not mounted.

The state of the main assembly of the toner supplying apparatus 100 when the toner supply container 1 has been removed, that is, when the container shutter 16 is not in engagement with the main assembly shutter 34 is as shown in FIG. 19. In this state, the main assembly shutter 34 is positioned to seal the toner inlet 33 to prevent foreign substances such as dust from entering the toner supply container 1 through the toner inlet 33.

FIG. 12 shows the state in which the toner supply container 1 has been installed, and the toner is being replenished. In this state, the container shutter 16 has retreated from the toner outlet 11*a*, allowing a passage to be formed through the toner outlet 11*a*, main assembly shutter opening 34*d*, and toner inlet 33. Also in this state, the plane of the container facing surface of the container shutter 16 and the plane of the container facing surface of the projection 34*b* next to the opening 34*d* of the main assembly shutter 34 is at approximately the same level. Therefore, the sealing member 41 is in contact with the projection 34*b* of the main assembly shutter 34, keeping the toner passage airtight, and at the same time, preventing the toner from adhering to the surface of the projection 34*b* of the main assembly shutter 34. Also in this state, the toner having been stored in the toner supply container 1 is conveyed toward the toner stirring-conveying apparatus 45, i.e., a toner receiving apparatus, by the function of the toner conveying member 29 contained in the toner supply container 1 through the toner outlet 11*a*, opening 34*d*, and toner inlet 33 through which the toner passage has been established.

Figure 14:
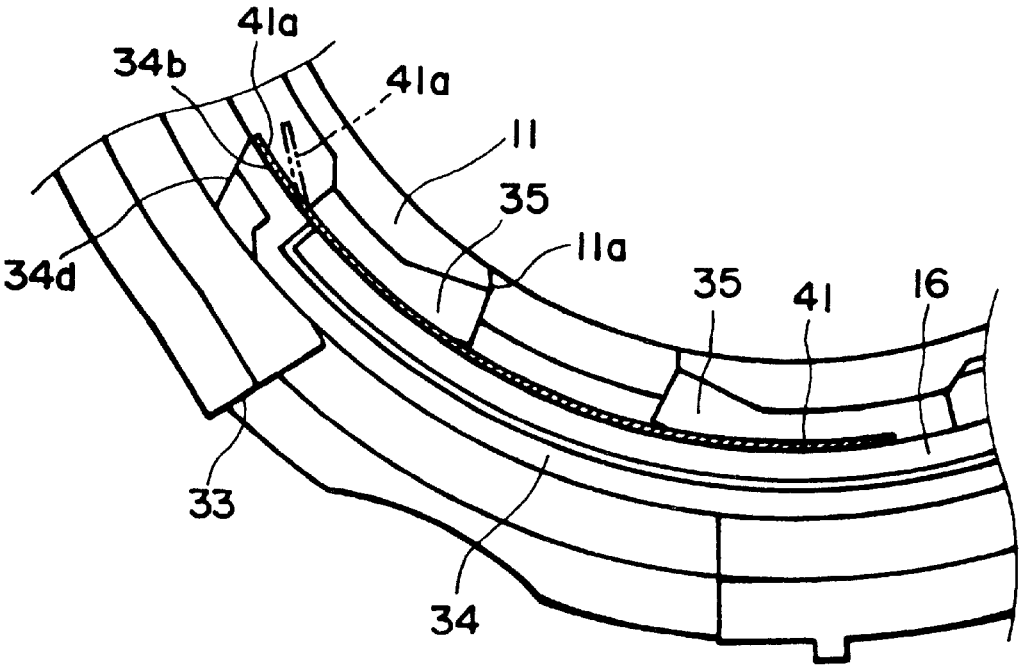
FIG. 14 is a part enlarged view of the device shown in FIG. 11.
Figure 15:
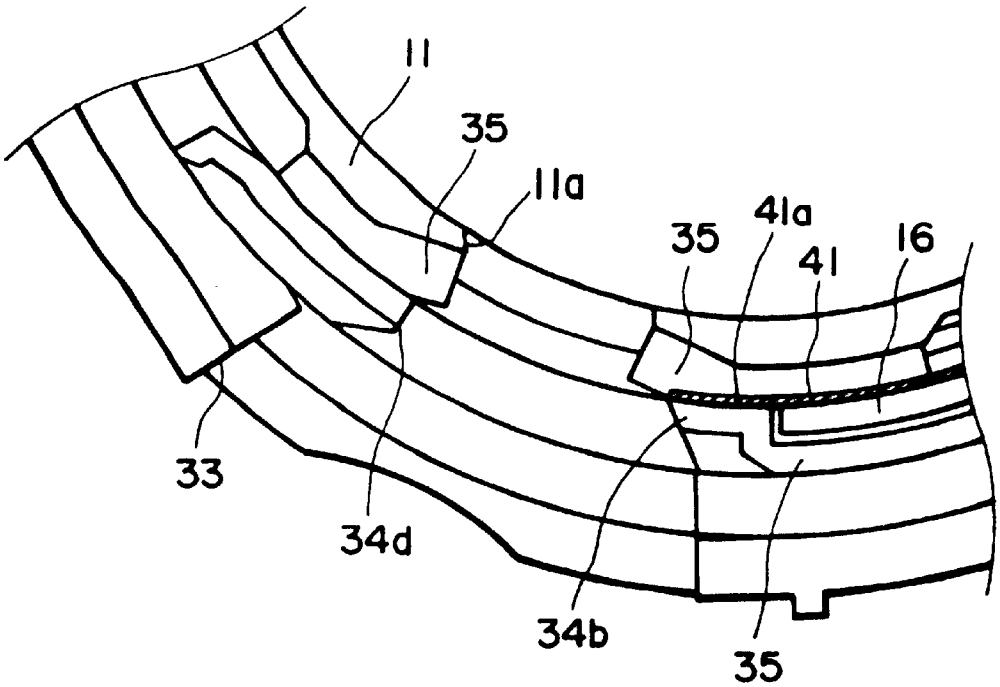
FIG. 15 is a part enlarged view of the device shown in FIG. 12.

Referring to FIGS. 14 and 15, which are enlarged drawings of the portions in FIGS. 11 and 12, respectively, even if the end portion of the sealing member 41 is pinched between the projection 34*b* of the main assembly shutter 34 and the packing member 35 while the shutters 16 and 34 are moved in the opening direction from the positions in FIG. 14 to the positions in FIG. 15, the airtightness of the toner passage at this location is not broken, because the sealing member 41 is formed of thin PET sheet. For assurance, the thickness of the sealing member 41 is desired to be no less than 50 $\mu$m and no more than 300 $\mu$m, preferably, no less than 70 $\mu$m and no more than 200 $\mu$m, and ideally, 125 $\mu$m. If the sealing member is excessively thick, it fails to properly seal the gap between the main assembly shutter 34 and toner supply container 1. On the other hand, if it is excessively thin, it fails to properly perform its primary function, that is, the function to prevent the toner from entering between the container shutter 16 and main assembly shutter 34. As a result, various problems occur while the toner supply container 1 is handled, in particular, while the toner supply container 1 is installed into, or removed from, the toner supplying apparatus 100. For example, the sealing member 41 is peeled back or wrinkled.

The requirement regarding the thickness of the sealing member 41 can be eliminated by the provision of the structure in which the sealing member 41 is retracted to a point where the sealing member 41 does not contact the packing member 35. However, such a structure makes the shutter stroke substantially longer, making it difficult to give a toner supplying apparatus and a toner supplying container a compact design.

Figure 16:
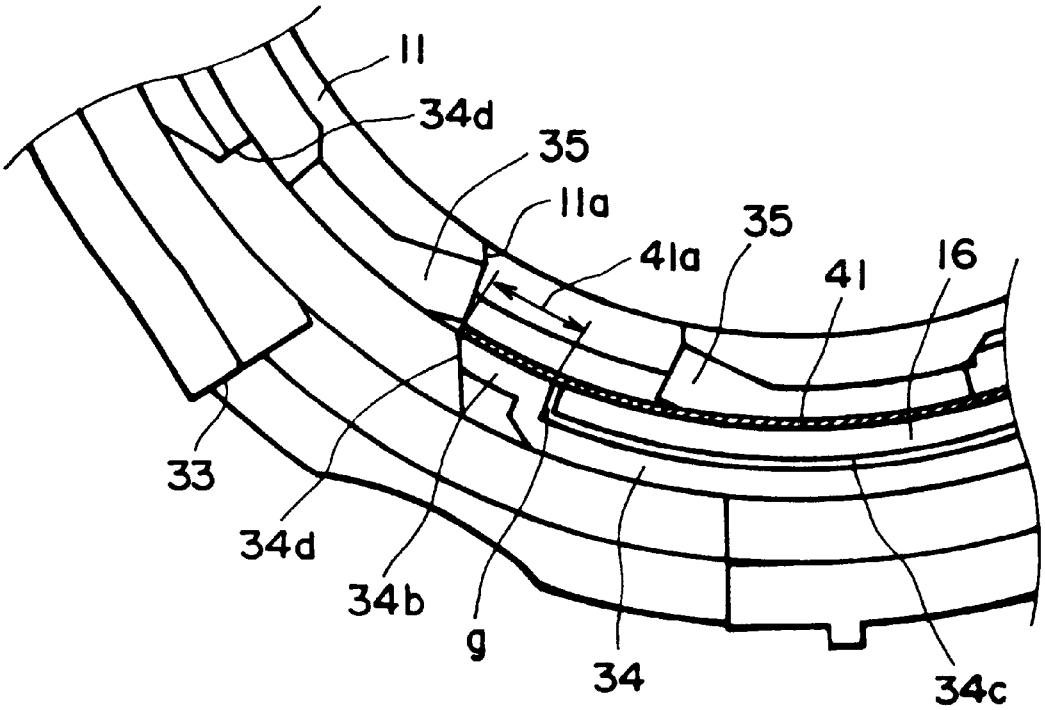
FIG. 16 is a part enlarged view of the device shown in FIG. 13.
Figure 17:
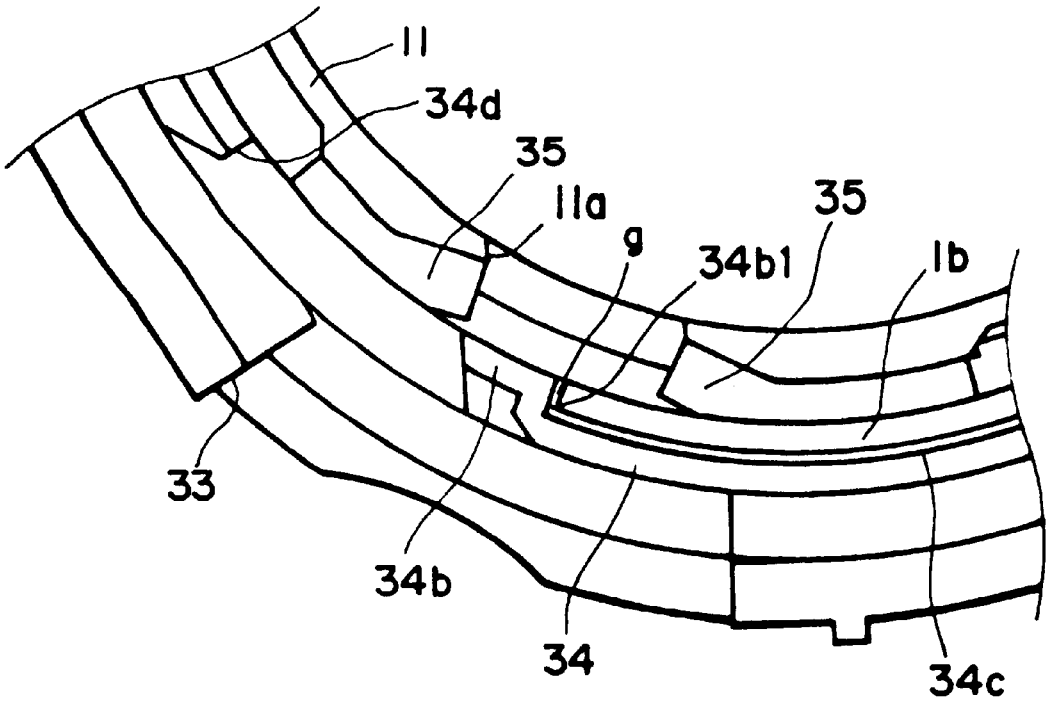
FIG. 17 is a front sectional view of a device which is comparison example corresponding to the device of FIG. 16.
Figure 18:
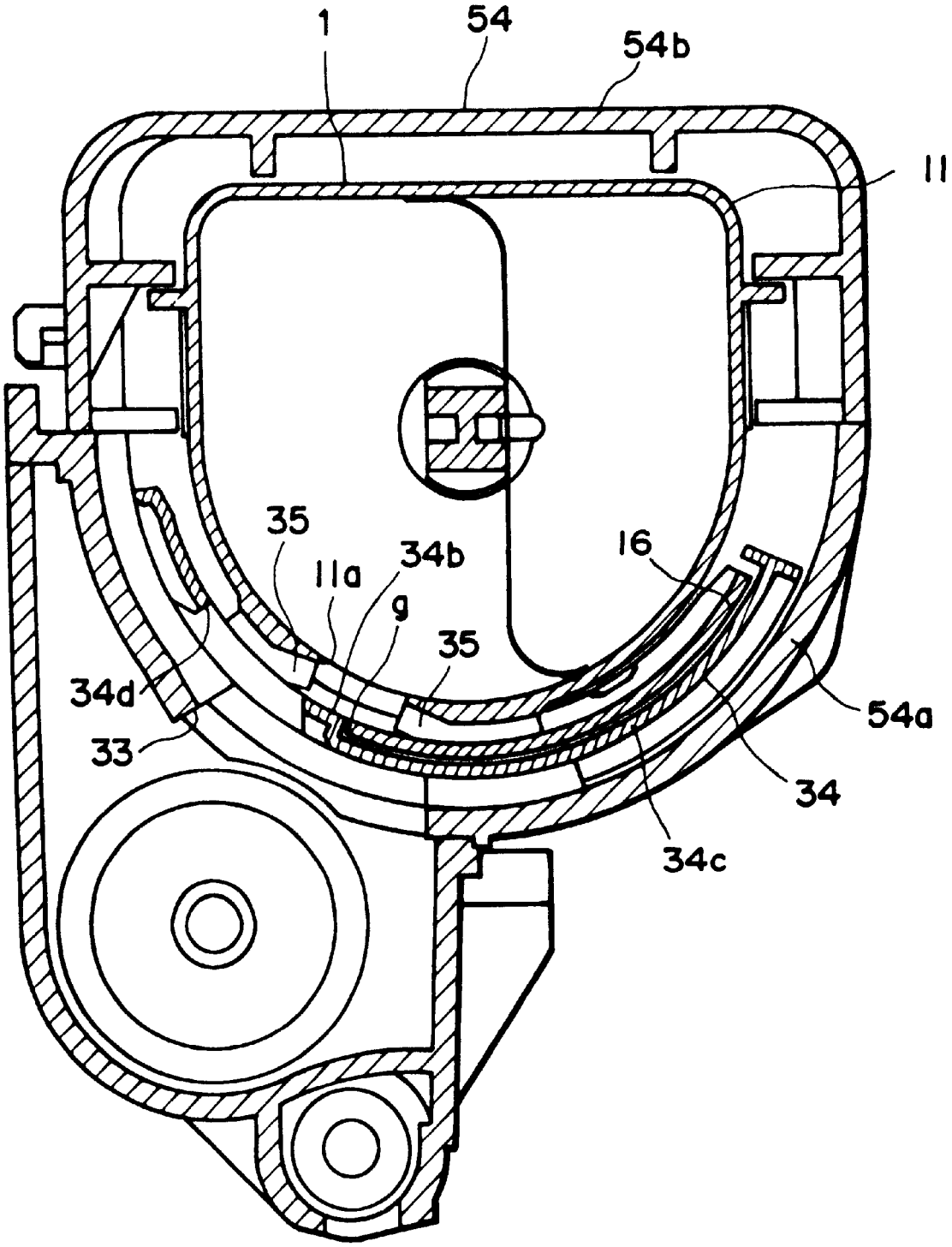
FIG. 18 is a front sectional view of a device which is a comparison example corresponding to the device of FIG. 13.

The description will be made as to a function of the seal member 41 and the removal of the toner supply container 1 before the emptiness of the toner is detected. In such a case, quite a large amount of the toner remains in the toner supply container 1, and the inside portions of the toner discharging opening 11*a* of the toner supply container 1, the main assembly shutter opening 34*d* and the toner supply opening 33, are filled with toner. With this state, the toner supply container 1 is taken out, the first thing to be done is to seal the opening. The container shutter 16 is moved in the closing direction, and then, the main assembly shutter 34 engaged therewith abundance in the container closing direction integrally. As shown in FIG. 16, the toner filling the main assembly shutter opening 34*d* moves in the closing direction, by which the toner is divided out of the toner in the toner supply container 1 and the toner in the toner stirring and feeding device 45. During the period of the closing process, as shown in FIG. 16, the gap formed in the engaging portion between the main assembly shutter 34 and the container shutter 16 passes right below the toner discharging opening 11*a*, and at this time, if the seal member is not provided, as shown in FIG. 17 and FIG. 18, the toner in the toner supply container 1 rushes toward the gap. However, in FIG. 16, the seal member 41 covers the gap, and therefore, the toner is prevented from entering the gap.

During this process, the seal member 41 and the container shutter 16 receive force in the vertical direction in the drawing by the restoring force of the packing member 35 so that extended portion 41*a* of the seal member 41 extended from the container shutter 16 is press-contacted to the container side surface of the main assembly shutter 34, thus providing good sealing property and prevention of deposition of the toner to the surface of the abutment edge 34*b* of the main assembly shutter 34.

FIG. 14 shows the state in which the main assembly shutter 34 and the container shutter 16 are in the closed position. In the toner supply container 1, the toner deposition onto the outer surface of the toner container 11 and onto the outer surface of the container shutter 16 can be prevented, although the toner is deposited to the toner supply container 1 side surface of the extended portion 41*a* of the seal member 41. The deposition of the toner to the inside of the extended portion 41*a* of the seal member 41 is not large in the amount, and in addition, the toner is in a pocket-like portion formed with the toner container 11, so that toner does not scatter out.

The length of the extension of the extended portion 41*a* is preferably substantially equal to the width of the abutment edge 34*b* of the main assembly shutter 34, and as the specific dimension, it is preferably not less than 2 $\mu$m and not more than 10 $\mu$m, and further preferably, it is not less than 4 $\mu$m and not more than 8 $\mu$m, and even further preferably, it is about 6 $\mu$m. If the extended portion 41*a* is too short, the performance of preventing enters of the toner is not sufficient, and the pocket-like portion formed between the seal member 41 and the toner container 11 is shallow, and therefore, the retention of the toner therein is also insufficient. Additionally, the performance of preventing the deposition of the toner onto the surface of the abutment edge 34*b* of the main assembly shutter 34.

On the other hand, if the extended portion 41*a* is too long, the portion obstructs mounting and demounting of the toner supply container 1, and the toner supply container 1 may hit various parts of the inside of the toner supply device 100. Additionally, the urging force from the packing member 35 is not sufficiently transmitted to the end portions of the extended portion 41*a* with the result of deterioration of the hermeticality. If the rigidity of the seal member 41 is increased, the transmission of the urging force is possible even if the extended portion 41*a* is long, but the follow-up property to the main assembly shutter 34 is not sufficient also with the result of deterioration of the hermeticality. Furthermore, the main assembly shutter opening 34*d* becomes narrow so that passage of the toner is impeded.

{Comparison Example}

As a comparison example, FIG. 17 and FIG. 18 show structures without the seal member. When the emptiness is detected, it is displays on the notification portion 124*a*. If the main assembly shutter 34 is closed before the notification, the gap g between the main assembly shutter 34 and the container shutter 16 is exposed to the toner so that it receives the toner. The outer surface of the container shutter 16 is contaminated with the toner having entered. There is not outlet for the toner having entered the recess 34*c* formed with the surface of the main assembly shutter 34, and therefore, the toner only accumulates with the result that contamination of the toner supply container 1 increases unless the cleaning is carried out upon the maintenance operation of the image forming apparatus. Additionally, the toner is deposited on the abutment edge 34*b* of the main assembly shutter 34, and the toner is transferred onto the outer surface of the toner supply container 1 opposing thereto after the container shutter 16 and the main assembly shutter 34 are opened.

[Sealing Member Design 1 Different from Preceding Design]

In the case of this design, a material low in friction is placed on the surface of the sealing member.

In order to gain in sealing performance, the ratio with which the packing member 35 is compressed is desired to be as high as possible, since the compressive stress of the packing member 35 is proportional to the compression ratio. In other words, when the compression ratio is small, the compressive stress of the packing is also small, and therefore, the sealing performance of the packing member 35 is at an unsatisfactory level. Thus, when the compression ratio is small, the toner leak due to the impact caused by a fall or the like of the toner supply container. On the other hand, if the compression ratio is excessively increased, the compression stress of the packing member 35 also becomes excessively high. This improves the packing member 35 in sealing performance, and at the same time, increases load in terms of sliding. As a result, the force required to open or close the container shutter 16 increases.

Thus, in order to improve the sealing performance while reducting, or at least without increasing, the force necessary to drive the shutters, a piece of flexible film 42 as a low friction material is pasted to the sealing member 41, on the surface which faces the packing member 35, as shown in FIGS. 20 and 21, so that the amount of the frictional resistance between the surfaces of the sealing member 41 and packing member 35 is reduced. More specifically, flexible film created by coating silicon oil, silicone wax, silicone containing paint, or the like, on a base film, for example, film comprising a single layer of polyester, biaxially stretched polypropylene (OPP), polyamide, polyethylene, or fluorinated resin, or film comprising mixed layers of preceding materials, is used as the material for the flexible film 42.

The thickness of the layer of the silicone oil on the aforementioned flexible film 42 is desired to be in a range of 0.05–2 μm, preferably, 0.1–0.5 μm. If the thickness of the coated layer of silicone oil is excessively thick, the toner in the toner containing portion 11 is negatively affected, whereas if it is excessively thin, the flexible film 42 is not effective to satisfactorily reduce the force necessary to open or close the shutters.

The toner supply container 1 with the above described structure was installed in the toner supplying apparatus 100, and the operation for removing the toner supply container 1 before the "no toner" light is lit was repeated. However, just as in the case of the sealing member illustrated in FIG. 20, (*b*), there was no sign of contamination traceable to the toner adhesion to the outwardly facing surface of the container shutter 16 and its adjacencies, and no sign of toner accumulation, providing that the above described structure improved the sealing performance of the sealing member without increasing the driving force necessary to open or close the container shutter 16.

[Sealing Member Design 2 Different from Preceding Two Designs]

In this version, as the toner supply container 1 is inserted into the toner supplying apparatus 100, the extension portion 41*a* of the sealing member 41 rides onto the projection 34*b* of the main assembly shutter 34 from the one of the longitudinal ends of the projection 34*b* of the main assembly shutter 34.

Figure 27:
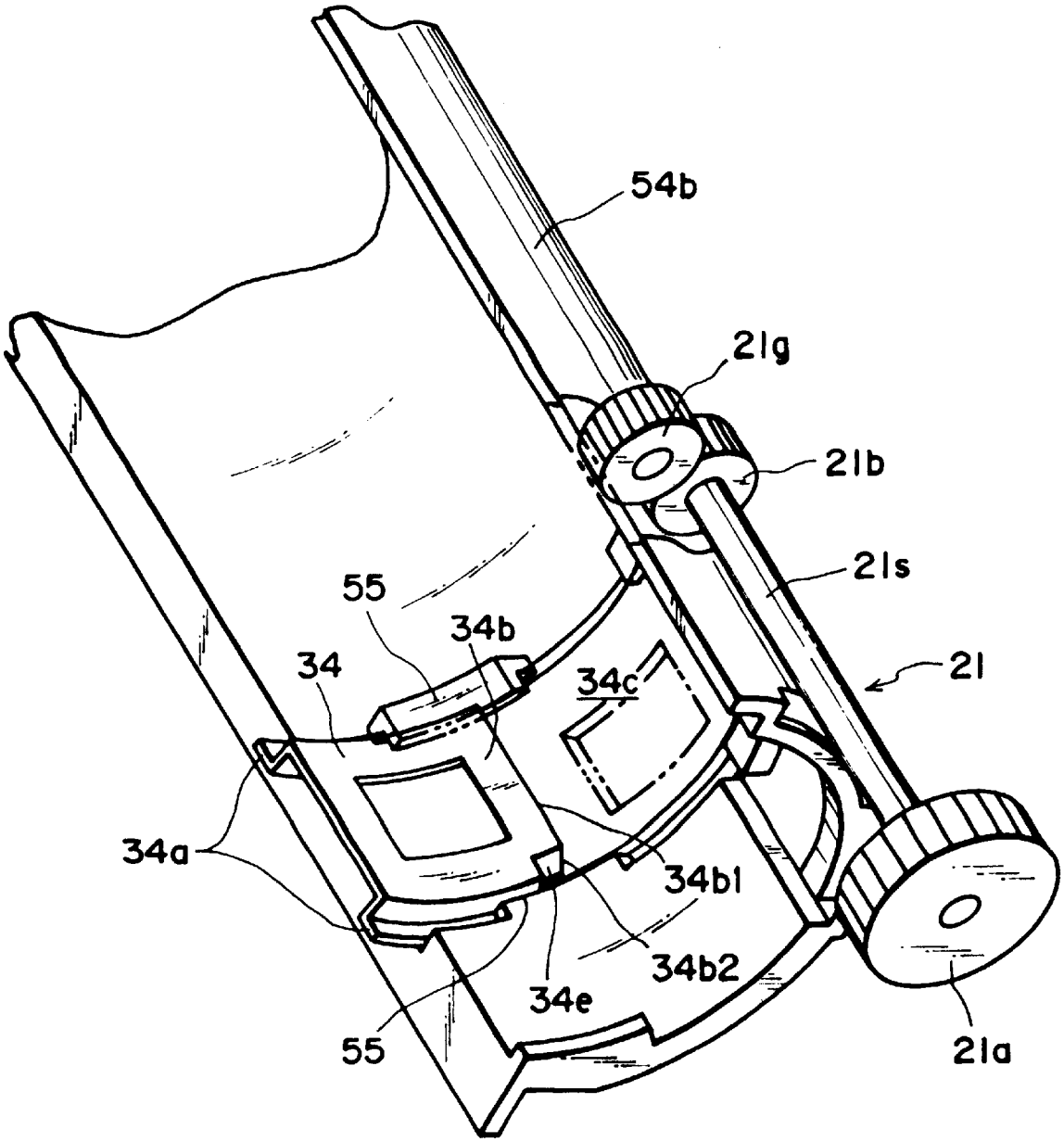
FIG. 27 is a perspective view of a main assembly shutter portion of the toner supply device.
Figure 39:
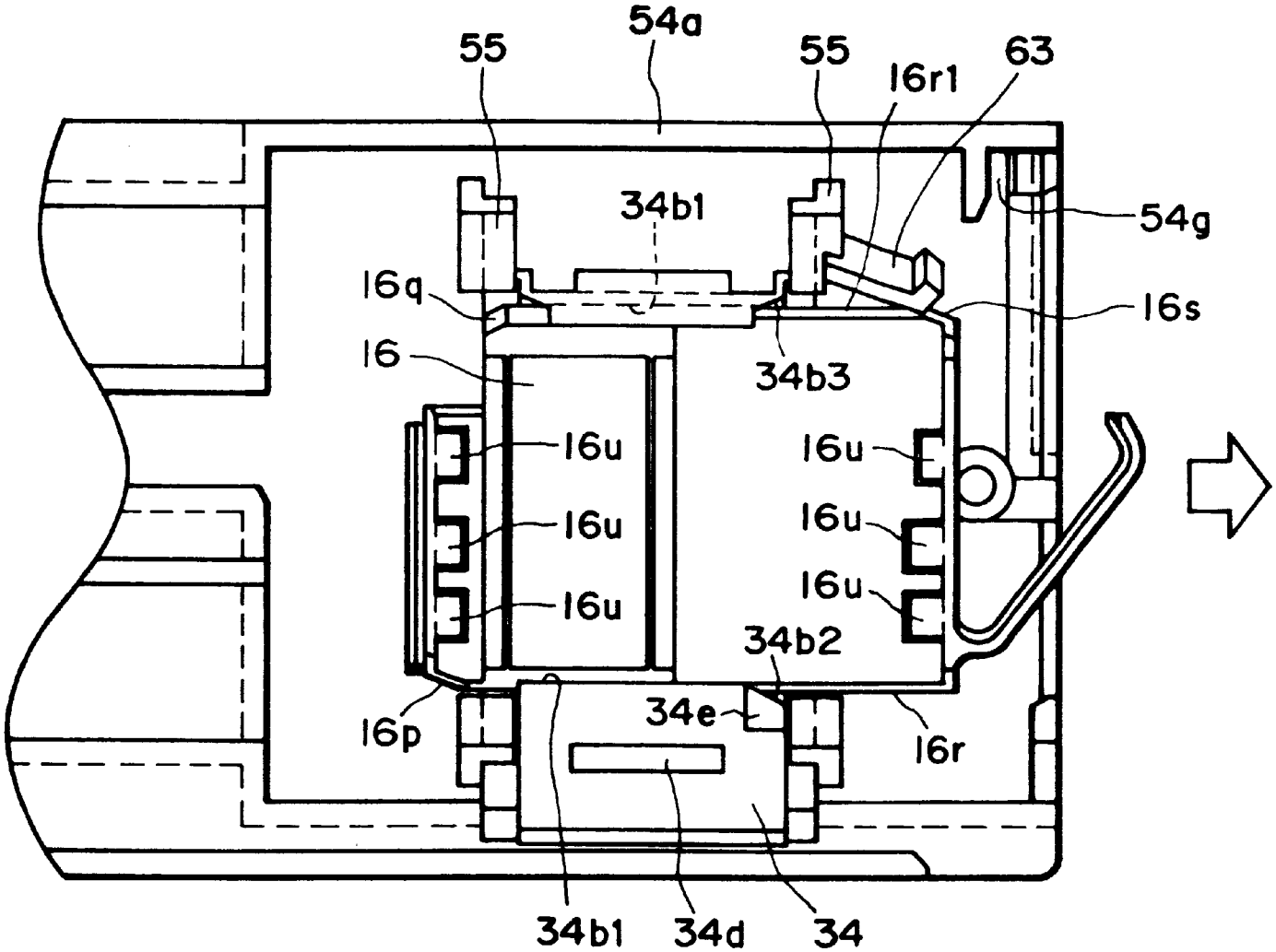
FIG. 39 is a horizontal sectional view of the toner supply device.
Figure 40:
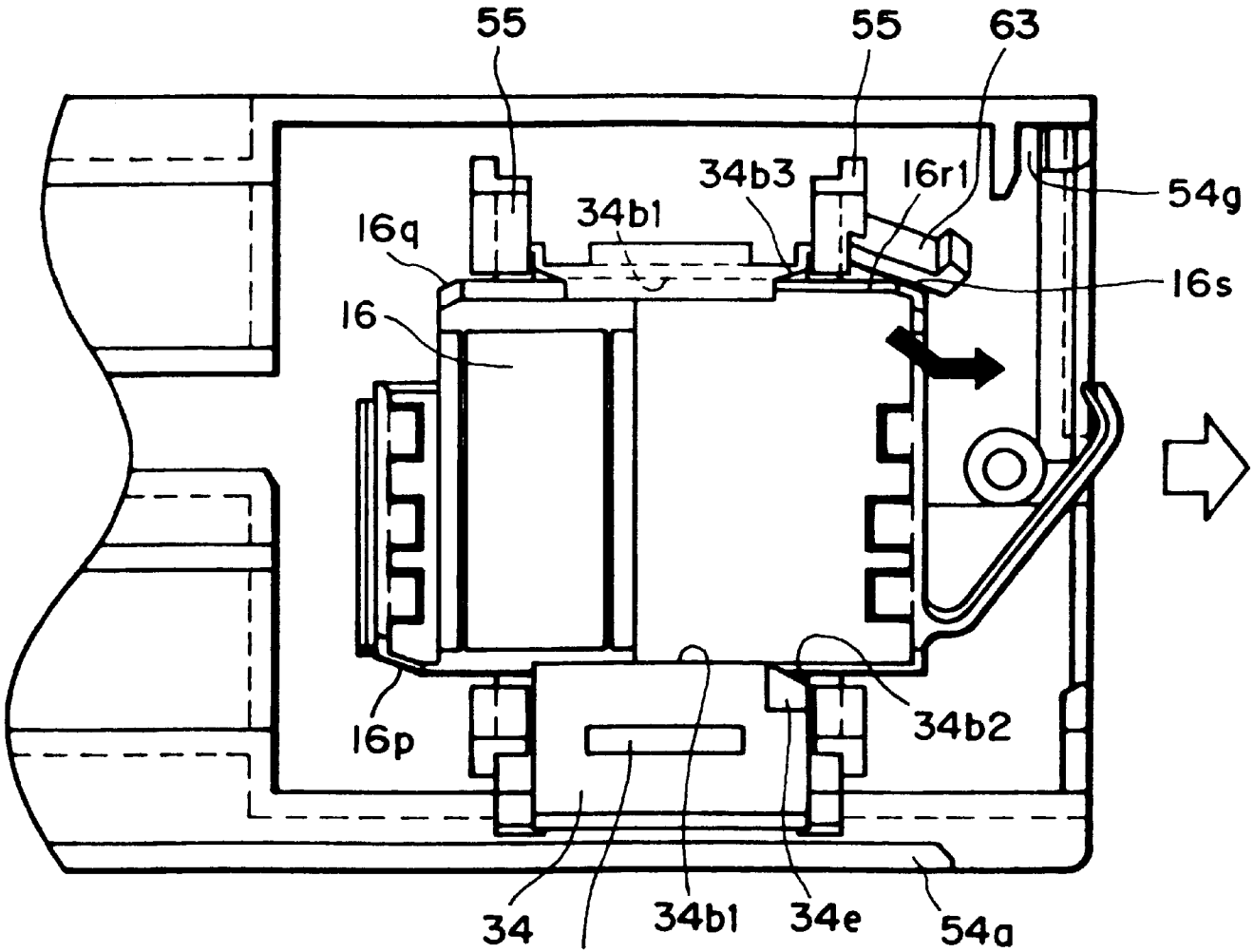
FIG. 40 is a horizontal sectional view of the toner supply device.

Thus, in order to make it easier for the container shutter 16 to slide into the indentation 34*c* (space) between the opposing surfaces 34*b*1 of the projections 34*b* of the main assembly shutter 34, the projection 34*b* of the main assembly shutter 34 is chamfered at the opposing downstream corners in terms of the inserting direction, i.e., both downstream corners in FIG. 27 (right-hand corner is behind the bottom portion 54*b* of the toner supplying apparatus main assembly 54), creating the surface 34*b*2, and the corresponding corners of the container shutter 16 are also chamfered, creating surfaces 16*p* and 16*q* (FIGS. 39 and 40).

Further, referring to FIG. 27, the main assembly shutter 34 is provided with an entrance guide portion 34*e*, which is located at the upstream corner of the projection 34*b* of the main assembly shutter 34 to allow the extension portion 41*a* of the sealing member 41 to smoothly ride onto the projection 34*b*. This entrance guide portion 34*e* is a slanted surface, which is located on the upstream corner of the projection 34*b*, and inclines in the downward and upstream direction from the container facing surface of the projection 34*b*.

The provision of an entrance guide portion such as the one described above is effective in preventing the extension portion 41*a* from being damaged at the corners as the extension portion 41*a* of the sealing member 41 rides onto the projection 34*b* of the main assembly shutter 34.

FIGS. 22–26 show the structure for helping the extension portion 41*a* of the sealing member 41 more smoothly advance onto the projection 34*b* from the entrance guide portion 34*e* of the projection 34*b* of the main assembly shutter 34.

Figure 22:
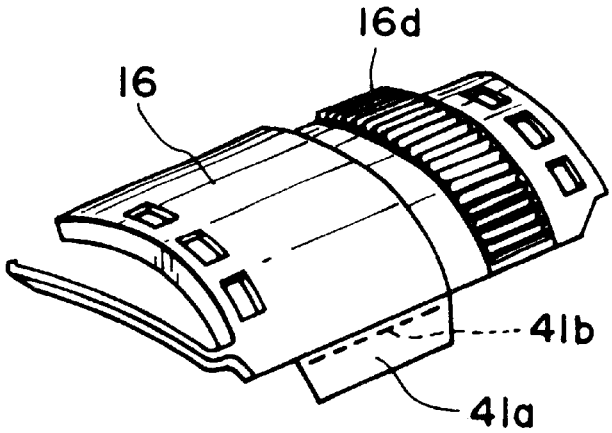
FIG. 22 is a perspective view of the container shutter (perforation).
Figure 25:
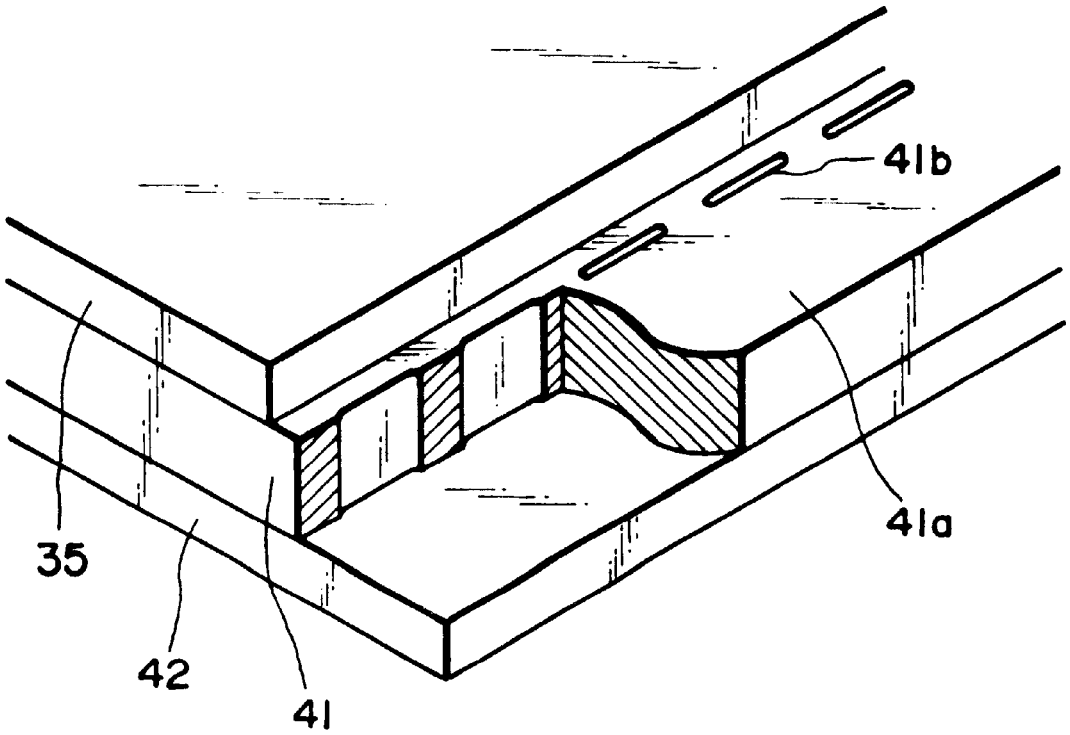
FIG. 25 is a perspective view of a seal member of the container shutter.
Figure 26:
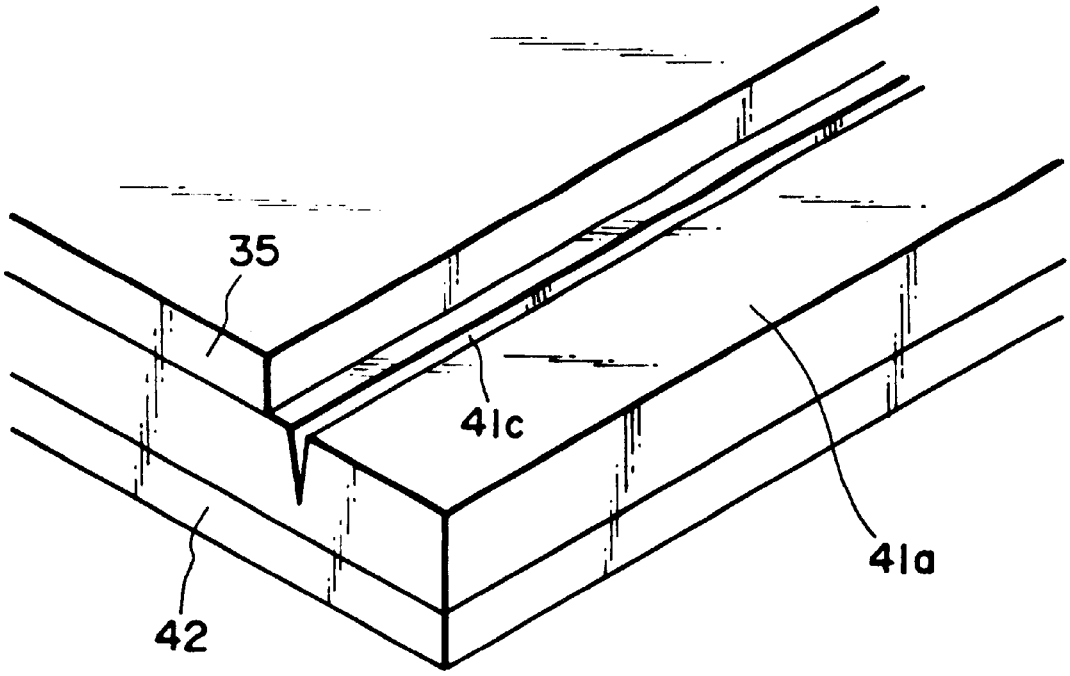
FIG. 26 is a perspective view of a seal member of the container shutter.

Referring to FIG. 22, the sealing member 41 is provided with a single line of perforation 41*b*, which extends along the base portion of the extension portion 41*a*. FIG. 25 is a perspective view of the sealing member 41 provided with the perforation 41*b*. Referring to FIG. 26, instead of being provided with the perforation 41*b*, the sealing member 41 may be provided with a groove 41*c* which extends along the extension portion 41*a* of the sealing member 41 in the longitudinal direction. In this embodiment, the groove 41*c* may be V-shaped or U-shaped in cross section.

With the provision of the above arrangement, as the extension portion 41*a* of the sealing member 41 comes in contact with the entrance guide portion 34*e* of the main assembly shutter 34 before it rides onto the projection 34*b* of the main assembly shutter 34, it bends at the perforation or groove, preventing its longitudinal end from being damaged.

Figure 23:
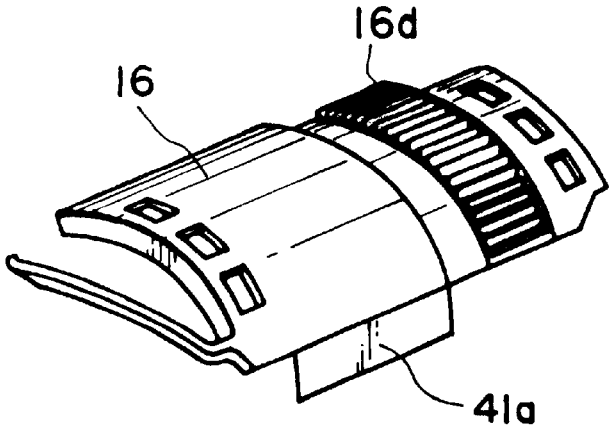
FIG. 23 is a perspective view of the container shutter.
Figure 24:
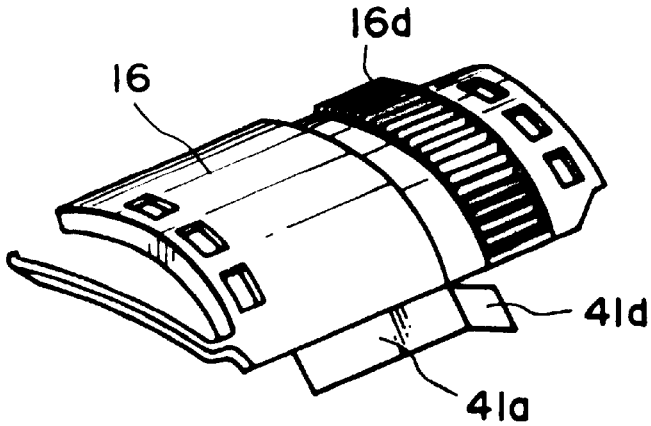
FIG. 24 is a perspective view of the container shutter.

In the preceding description of the sealing member 41, the sealing member 41 inclusive of the extension portion 41*a* was arc-shaped in cross section. However, the extension portion 41*a* of the sealing member 41 may be bent at its base line toward the toner containing portion 11, as shown in FIG. 23. Being bent as described above, the extension portion 41*a* can smoothly rides onto the projection 34*b* of the main assembly shutter 34 as depicted by the double dot chain line in FIG. 14. Even if the extension portion 41*a* is bent in this manner, when the container shutter 16 and main assembly shutter 34 open the toner outlet 11*a* and main assembly shutter opening 34*d*, the extension portion 41*a* is pinched at both longitudinal edges between the packing member 35 and the other projections of the main assembly shutter 34, perpendicular to the projection 34*b*. Therefore, the projection 34*b* and the extension portion 41*a* tightly contact with each other. In the case of the design illustrated in FIG. 23, since the extension portion 41*a* is bent, its tip portion remains firmly in contact with the packing member 35, sliding on the packing member 35, during the opening or closing of the container shutter 16. Therefore, it is liable that the extension portion 41*a* becomes damaged. The design illustrated in FIG. 24 is a design in which the above concern has been eliminated. In this design, the extension portion 41*a* is provided with a sub-extension portion 41*d*, which extends at an angle from the downstream edge, in terms of the toner supply container 1 installation direction, of the extension portion 41*a*. In this case, extension portion 41*d* is positioned not to contact the packing member 35. Therefore, the aforementioned problems do not occur. In other words, this embodiment is the ideal one.

Locking Member

The toner cartridge is provided with a locking member 51 in the form of a ring so that the handle 15 is locked to the toner containing portion 11 before the toner supply container 1 is installed into the main assembly 124 of an image forming apparatus, and after the toner supply container 1 has been removed from the apparatus main assembly 124 (FIGS. 7 and 8).

The locking member 51 is rotationally fitted around the first flange 12, more specifically, the locking member engagement portion 12*g* of the first flange portion, that is, the portion immediately next to the end plate 12*b* of the first flange 12. It is also movable in the direction in which the toner supply container 1 is inserted into, or removed from, the toner supplying apparatus 100 (direction indicated by an arrow mark in FIG. 7, and also the opposite direction).

The locking member 51 comprises a cylindrical ring portion 51*a*, i.e., the portion which fits around the locking member engagement portion 12*g*, and is provided with a notch 51*b* which faces the aforementioned end plate 12*b*. The notch 51*b* is in engagement with the locking projection 12*h* with which the first flange 12 is provided. The locking member 51 integrally comprises an arm-like springy portion 51*c* which presses upon the end surface 15*i* of the handle 15. The first flange 12 is provided with a circumferential ridge 12*i* which is on the cylindrical portion 12*e*, and circles around the cylindrical portion 12*e*. Further, the handle 15 integrally comprises a stopper 15*j*, which is formed by outwardly bending a portion of the handle 15. The tip of the stopper 15*j* is kept in contact with the ridge 12*i* by the resiliency of the aforementioned springy portion 51*c*, to prevent the handle 15 from slipping off the cylindrical portion 12*e* of the first flange 12 (FIG. 3). Further, the locking member 51 is kept in contact with the end plate 12*b* of the first flange 12 by the resiliency of the springy portion 51*c*.

The springy portion 51*c* is gradually reduced in cross section toward its tip, being enabled to evenly bend across its entire length, to prevent the base portion of the springy portion 51*c* from turning white due to the concentration of the bending stress to the base portion. In other words, when the cross section of the springy portion 51*c* is rectangular, it is made gradually smaller in the width or thickness direction toward the tip. Therefore, the springy portion 51*c* gradually reduces in cross section from its base portion to its tip.

A pair of engagement ribs 51*d* provided on the outwardly facing surface of the locking member 51 are enabled to move in the installation-removal direction of the toner supply container 1 by being loosely fitted, one for one, in grooves 15*k* and 15*m* which are cut in the handle 15 in the installation-removal direction of the toner supply container 1. The engagement rib 51*i* of the locking member 51 is engaged in the groove 15*j* of the handle 15. Therefore, the handle 15 and locking member 51 are prevented from moving relative to each other in their circumferential direction, but are allowed to move relative to each other in their axial direction (FIGS. 37 and 38).

The length, in terms of the installation removal direction of the toner supply container 1, of the locking projection 12*h* provided on the first flange 12 is less than the length of the stroke of the engagement ribs 51*d* through the grooves 15*k* and 15*m*, one for one, in the installation-removal direction of the toner supply container 1. Further, the length, in terms of the installation-removal direction of the toner supply container 1, of the locking projection 12*h* is less than the length of the stroke of the engagement rib 51*i* of the locking member 51 through the groove 15*j* of the handle 15.

With the provision of the above structure, the notch 51*b* of the locking member 51 is kept engaged with the locking projection 12*h* of the first flange 12 by the resiliency of the springly portion 51*c* of the locking member 51. Therefore, whatever state the toner supply container 1 is in, the state in which it is being inserted into the toner supplying apparatus 100, the state in which it is being removed from the toner supplying apparatus 100, or the state in which it is out of the toner supplying apparatus 100, the handle 15 is not allowed to move in its circumferential direction relative to the toner containing portion 11. More specifically, in this embodiment, the handle is allowed to slip in its circumferential direction by six degrees, which is equivalent to the amount of the play between the projection 12*h* provided on the first flange 12 and the notch 51*b* of the locking portion 51. It should be noted here that the projection 12*h* of the first flange 12 is provided also as a means for properly aligning the handle 15 relative to the toner supplying apparatus 100 in terms of the circumferential direction of the handle 15 when installing the toner supply container 1 into the toner supplying apparatus 100. This subject will be described later. In other words, when the toner supply container is out of the image forming apparatus main assembly, the handle 15 is rotatable relative to the toner containing portion 11, by six degrees, which is equivalent to the distance between a first position, or the one end of the rotatable range, and a second position, or the other end of the rotatable range.

The locking member 51 is provided with a latch 51*e*, which is a thin piece of projection and projects outward in the radial direction from the engagement rib 51*d* which is adjacent to the springy portion 51*c*. The latch 51*e* prevents the toner supply container 1 from coming out of the main assembly 54.

[Function of locking member]

Next, the function of the locking member 51 will be described. As the toner supply container 1 is inserted into the toner supplying apparatus 100 by engaging the guide portion 11*k* of the toner supply container 1 between the projections 54*d* of the toner supplying apparatus main assembly 54, the container shutter 16 and main assembly shutter 34 engage with each other. While the container shutter 16 engages with the main assembly shutter 34, the driving force receiving engaging portion 16*d* of the container shutter 16 partially meshes with the driving force transmitting engaging portion 21*g*, and immediately thereafter, the driving force transmitting engaging portion 15*a* of the handle 15 partially meshes with the driving force receiving engaging portion 21*a*. After the container shutter 16 partially engages with the main assembly shutter 34, the aforementioned extension portion 41*a* of the sealing member 41 rides onto the projection 34*b* past the entrance portion 34*e* of the main assembly shutter 34.

Figure 33:
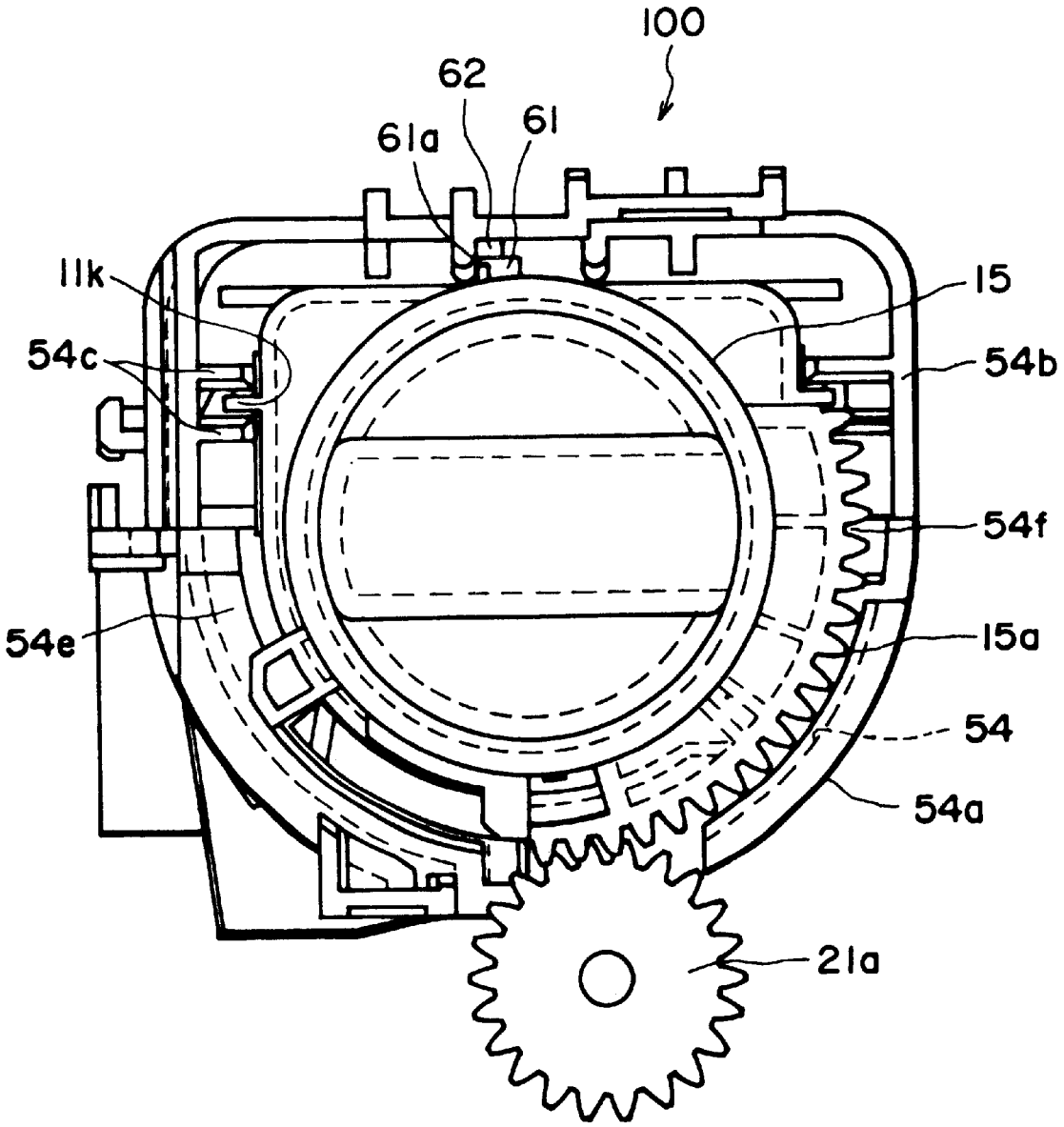
FIG. 33 is a front view illustrating a mounting operation of the toner supply container to the toner supply device.

Then, as the handle 15 is pushed-in the installing direction, the projection 51*d*1 provided on the engagement rib 51*d* comes in contact with the striking surface 54*e* of the toner supplying apparatus main assembly 54, and at the same time, the latch 51*e* comes in contact with the contact surface 54*f*, as shown in FIG. 8 (FIGS. 37 and 33). Then, as the handle 15 is pushed in further, the handle 15, first flange 12, toner containing portion 11, second flange 13, and the like, advance together in the same direction indicated by the arrow mark in FIG. 7, and causes the locking projection 12*h* of the first flange 12 to move out of the notch 1*b* as shown in FIG. 8. In other words, the handles 15 is unlocked from the toner containing portion 11, being allowed to rotate.

Therefore, the handle 15 can be rotated clockwise as seen from the upstream side in terms of the toner supply container 1 installing direction (arrow direction in FIG. 8). Then, as the handle 15 is rotated, the locking member 51 rotates together with the handle 15, and immediately, the latch 51*e* engages into the groove 54*g* integrally provided in the strike surface 54*f* of the bottom portion 54*a* of the toner supplying apparatus main assembly 54 (FIGS. 39 and 40). This groove 54*g* extends in the circumferential direction on the cylindrical wall of the bottom portion 54*a* of the toner supplying apparatus main assembly 54, forming an arc. After engaging into the groove 54*g*, the latch 51*e* remains in the groove 54*g* when the toner outlet 11*a* and main assembly shutter 34 are opened or closed. Therefore, while the toner supplying operation is carried out after the installation of the toner supply container 1 into the toner supplying apparatus 100, the toner supply container 1 cannot be simply pulled out of the toner supplying apparatus 100. In other words, the toner supply container 1 can be removed from the toner supplying apparatus 100 only when the container shutter 16 and main assembly shutter 34 are closed, because the latch 51*e* is allowed to come out of the arc-like groove only when the container shutter 16 and main assembly shutter 34 are closed.

Regarding this locking mechanism, if the number of the lock releasing projection is only one, moment and/or deformation occurs to the locking member 51, preventing the locking member 51 from smoothly sliding. Further, even if the number of the lock releasing projection is plural, if they are unevenly distributed, the same problem occurs. Therefore, it is desired that a plurality of lock releasing projections are distributed in the circumferential direction with as even as possible intervals. In this embodiment, two projections are provided, being apart from each other by approximately 180 deg. In this embodiment, the latch 51*e* functions also as a lock releasing projection, the angle formed by the radial line connecting the projection 51*d*1 and the center of the locking member 51 and the radial line connecting the latch 51*e* and the center of the locking member 51 is approximately 150 deg.

Next, referring to FIG. 38, the lock releasing timing of the locking member 51 will be described. The locking projection 12*h* for regulating the angle the locking member rotates is provided with a projection 12*h*1, which projects from the outwardly facing surface of the locking projection 12*h* in the radial direction of the locking member 51, and is enabled to engage with the handle 15. The angle B the handle 15 rotates from the position at which the projection 12*h* is engaged in the notch 51*b* to the position at which the projection 12*h*1 contacts one of the groove walls 15*n* of the groove 15*m* of the engagement rib, is approximately 90 deg. As stated before, the groove 15*m* is the groove in which the engagement rib 51*d* (on the side where the latch 51*e* is located) of the handle 15. As for the relationship between the notch 51*b* of the locking member 51 and the locking projection 12*h*, the notch 51*b* is made wide enough in terms of its central angle A so that a play of 6 deg. is afforded for the handle 15 in terms of its circumferential direction.

In order to exchange the toner supply container 1 with a fresh one after the toner in the toner supply container 1 was depleted, the handle 15 must be turned to its original position by turning it in the direction opposite to the direction in which the handle 51 is turned during the installation of the toner supply container 1 (counterclockwise as seen from the upstream side in terms of the direction in which the toner supply container 1 is inserted into the toner supplying apparatus 100). With this action, the latch 51*e* becomes disengaged from the arc-shaped groove 51*e*, and the locking member 51 slides back, on the locking member engagement portion 12*g*, to its original position, i.e., the position at which the locking projection 12*h* remains engaged in the notch 51*b* of the ring portion 51*a* of the locking member 51, due to the resiliency of the springy portion 51*c*.

As stated before, because the locking member 51 is under the pressure generated by the springy portion 51*c* in the direction of the toner containing portion 11, it slides in the direction to cause the aforementioned locking projection 12*h* and the notch 51*b* of the locking member 51 to engage with each other, and lock the handle 51.

Toner Supplying Operation

Next, a toner supplying operation which employs a toner supply container 1 in this embodiment will be described in general terms.

(1) Installation of Toner Supply Container 1

First, the lid 121 with which the apparatus main assembly 124 is provided is opened by 90 deg. toward an operator. Then, the guide portion 11*k* of the toner supply container 1 is engaged into the groove 54*h* (FIG. 11) between the projections 54*c* of the toner supplying apparatus 100. Then, the toner supply container 1 is inserted into the toner supplying apparatus 100 from the side where the coupling 26*a* is provided. With this action, first, the container shutter 16 of the toner supply container 1 and the main assembly shutter 34 within the toner supplying apparatus 100 engage with each other. Next, the driving force transmitting engaging portion 21*g* and the driving force receiving engaging portion 16*d* of the container shutter 16 engage with each other. Lastly, the driving force receiving engaging portion 21*a* on the toner supplying apparatus 100 side and the driving force transmitting engaging portion 15*a* of the handle 15 engage with each other.

(2) Positioning of Toner Supply Container and Supplying of Toner

With the toner supply container 1 being in the toner supplying apparatus 100, as an operator manually rotates the handle 15 by 90 deg. in the clockwise direction (handle 15 will be moved to the third position), the rotational driving force, i.e., the force applied by the operator, is transmitted from the driving force transmitting engaging portion 15*a* of the handle 15, as a driving force transmitting portion, to the driving force transmitting member 21, as a rotational force transmitting portion, through the driving force receiving engaging portion 21*a* of the toner supplying apparatus 100. Then, this force is further transmitted from the driving force transmitting engaging portion 21*g* to the driving force receiving engaging portion 16*d*, as a rotational force receiving portion, of the container shutter 16. By the driving force transmitted in the above described manner, the container shutter 16 is slid in the circumferential direction of the toner containing portion 11 while engaging with the shutter supporting member 11*e* of the toner containing portion 11. During this sliding movement of the container shutter 16, the main assembly shutter 34 moves with the container shutter 16. Therefore, the toner outlet 11*a* of the tone containing portion 11, the opening 34*d* of the main assembly shutter 34, and the toner inlet 33 in the toner supplying apparatus 100, are all opened at the same time. Then, toner supplying is started by rotating the toner conveying member 29 through the coupling 26*a* which receives the driving force from the coupling 44 of the apparatus main assembly 124.

During the above described operation, the toner containing portion 11 does not rotate. Therefore, the toner supply container 1 does not rotate with the handle 15; it remains fixed in the toner supplying apparatus 100.

(3) Removal of Toner Supply Container

An operator rotates the handle 15 by 90 deg. in the counterclockwise direction. With this action, driving force different in direction from the driving force applied during the installation (2) of toner cartridge is transmitted in the same order as in the installation of the toner supply closes the toner outlet 11*a*, and the main assembly shutter 34 closes the opening 34*d* of the main assembly shutter 34 and the toner inlet 33, to complete the toner replenishment sequence.

The toner supply container 1 is installed into the toner supplying apparatus 100 from the coupling 26*a* side. This requires that the engaging portion 16*d* of the container shutter 16 passes by the engaging portion 21*a* of the apparatus main assembly 124, and engages with the engaging portion 21*g*, i.e., the inward one, of the apparatus main assembly 124. Therefore, the diameter of the theoretical circle which connects the tips of the teeth of the engaging portion 16*d* in the form of a segment gear is desired to be smaller than the diameter of the theoretical circle which connects the bases of the teeth of the engaging portion 15*a* in the form of a segment gear.

With the provision of the above described structure, a toner containing portion is not required to move during the toner supplying sequence. Therefore, there is no restriction regarding the shape of a toner containing portion. Therefore, a shape which offers the highest spatial efficiency to a toner containing portion may be employed as the shape for a toner containing portion. In addition, a shutter and a handle are made into two separate components. Therefore, it is unnecessary for a toner outlet to be next to a handle. Therefore, more latitude can be afforded in designing a toner supply container.

Further, in the case of the toner supply container in this embodiment, the driving force applied to the handle is transmitted to the driving force receiving engaging portion of the shutter through a plurality of engaging portions: the engaging portion of the handle, the engaging portion of the driving force transmitting member, and the engaging portion of the shutter. Therefore, it is possible to more freely design these engaging portion in terms of engagement ratio (gear ratio).

Thus, when the distance the shutter is slid to be opened or closed is long, the angle by which the handle must be rotated can be reduced by increasing the engagement ratio (gear ratio) of the handle, and when the torque required to open or close the shutter is high, the torque required to operate (rotate) the handle can be reduced by reducing the engagement ratio (gear ratio) of the handle.

Also in this embodiment, the angle by which the handle is rotated to open or close the shutter is made to be 90 deg., so that when installing the toner supply container into the toner supplying apparatus, the thick end 15*e* is vertically positioned, and after the toner is discharged by rotating the handle clockwise by 90 deg., the thick end 15*e* of the handle 15 is horizontally positioned. This arrangement makes it easier for an operator to operate the toner supply container, and also to recognize the state of the toner supply container 1. For operational efficiency and convenience, the angle by which the handle 15 is rotated to open or close the shutter is desired to be in a range of 60–120 deg.

Toner Stirring-conveying Apparatus

The toner supplying apparatus 100 is provided with the toner stirring-conveying apparatus 45. Referring to FIGS. 11 and 12, the toner supplying apparatus 100 is also provided with the case 48, which is fixed to the toner supplying apparatus main assembly 54 in a manner to cover the toner inlet 33 from below. The case 48 is approximately the same as the toner supplying apparatus 100 in the longitudinal dimension. In the case 48, the stirring screws 46 and 47 are disposed, being supported by the case 48 so that they can be rotationally driven.

The stirring screws 46 and 47 are separated by a partition wall 48*a* which divides the internal space of the case 48 into two chambers 48A and 48B, which are connected to each other through the hole provided in the partition wall 48*a* on the side opposite to the toner inlet 33, and in which the stirring screws 46 and 47 are disposed, respectively, the stirring screw 46 being diagonally above the stirring screw 47. The case 48 is provided with a toner outlet 48*b*, which is located at the same longitudinal end as the toner inlet 33, and leads to the developing apparatus 201.

With the provision of the above structural arrangement, as the toner is supplied through the toner inlet 33, the rotating toner stirring screw 46 conveys the toner, while stirring, through the chamber 48A in the longitudinal direction from the toner inlet 33 side to the opposite side, causing the toner to fall into the chamber 48B through the opening (unillustrated) provided in the partition wall 48*a*. The toner stirring screw 47, i.e., the one at the bottom, conveys, while stirring, the toner in the direction opposite to the toner conveying direction of the toner stirring crew 46. As a result, the toner is supplied into the developing apparatus 201 through the toner outlet 48B.

Precise Positioning Means

If cost is spared in producing a toner supply container and components related thereto, in other words, if highly precise components are not used for the production of a toner supply container and the related components, it is inevitable that the drive train, i.e., the driving force transmitting juncture from the rotatable handle to the shutter, suffers from an excessive amount of play and/or deformation which results in, for example, the gear backlash or the like. With the presence of such a large amount of play and/or deformation, the output stroke of the drive train does not correspond to the input stroke one to one. Therefore, there occurs sometimes such a condition that after the shutter is opened, it fails to come back all the way to its original position. If the toner supply container, the shutter of which is in this condition, is removed once from the apparatus main assembly, and reinstalled into the apparatus main assembly, the distance between the final position of the shutter of the toner supply container after the closing stroke, and the original position becomes greater than that in the previous installation. In other words, the distance continues to increase with the repetition of the installation and removal.

In the case of the above described design, according to which the main assembly shutter and container shutter are integrally engaged with each other, shutter misalignment such as the one described above makes it impossible to remove the toner supply container from the apparatus main assembly, or to install a fresh toner supply container (shutter is at its original position) into the apparatus main assembly, which is a serious problem.

This problem can be solved by providing a toner supply container and the related structure of the apparatus main assembly with such a feature that requires that when installing a toner supply container, the handle is rotated in the opening direction of the shutter by a predetermined angle, in addition to the theoretically necessary angle, before the handle and shutter begin to engage with the driving train gears on the apparatus main assembly side, and when removing the toner supply container, the handle is rotated in the closing direction of the shutter by the aforementioned predetermined angle, in addition to the theoretically necessary angle. This feature compensates for the additional length of stroke which the gear backlash or the like resulting from the excessive play requires, assuring that the shutters are returned to their original positions.

Next, a means for providing the above described feature will be described in detail.

Figure 41:
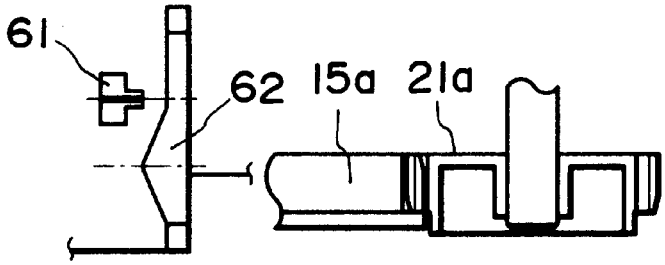
FIG. 41 is a schematic view illustrating a function of mounting and positioning means.
Figure 42:
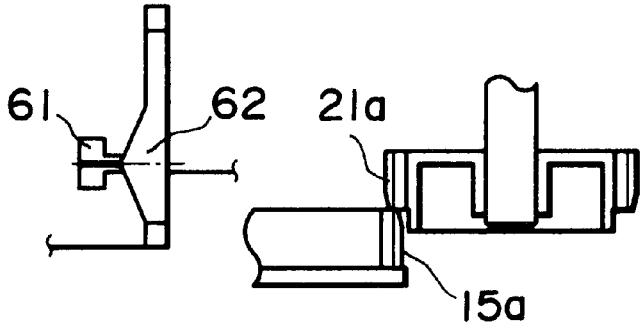
FIG. 42 is a schematic view illustrating a function of the mounting and positioning means.
Figure 43:
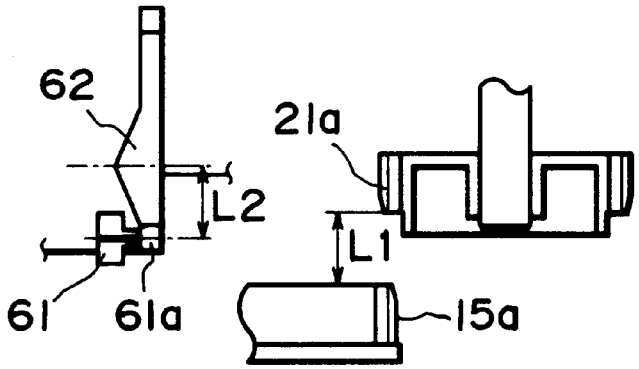
FIG. 43 is a schematic view illustrating a function of the mounting and positioning means.

Referring to FIGS. 1, 2, 33 and 34, the handle 15 is provided with a handle projection 61, as a contact portion, which is located on the outwardly facing surface of the handle 15. Referring to FIGS. 41–43, which are a schematic plan of the handle projection 61 and its adjacencies as seen from above, the handle projection 61 is shaped like a cam follower, and its portion with a contact surface 61*a* is narrower than the base portion in terms of the vertical direction in FIGS. 41–43. It is positioned to come in contact with the main assembly projection 62 provided on the inwardly facing surface of the top plate of the bottom portion 54*b* of the toner supplying apparatus main assembly 54. The projections 61 and 62 work in combination as a follower and a cam, respectively.

The cam portion of the main assembly projection 62 is angled in profile. The lift of this cam surface is just enough to make the center angle of the cam portion of the main assembly projection 62, that is, the angle formed by the line connecting the highest point of the cam surface and the center of the toner supplying apparatus main assembly 54 (center of the semicylindrical bottom portion 54*a*), and the line connecting the base of the cam surface and the center of the toner supplying apparatus main assembly 54, large enough to compensate for the play in the rotational direction between the toner supply container 1 and toner supplying apparatus 100. This center angle is no less than 6 deg. In this embodiment, it is 6 deg.

Next, the handle projection 61 and main assembly projection 62 will be described in positional relationship and function. Referring to FIGS. 33 and 43, as the toner supply container 1 is inserted into the toner supplying apparatus 100, the handle projection 61 reaches a point at which it comes in contact with the main assembly projection 62, on the cam surface, at the point with no lift. In this state, the driving force transmitting engaging portion 15*a* of the handle 15 and the driving force receiving engaging portion 21*a* on the main assembly side are apart from each other by a distance L1, which is equal to a distance L2 by which the handle projection 61 in this state must be moved to receive the highest lift.

Figure 34:
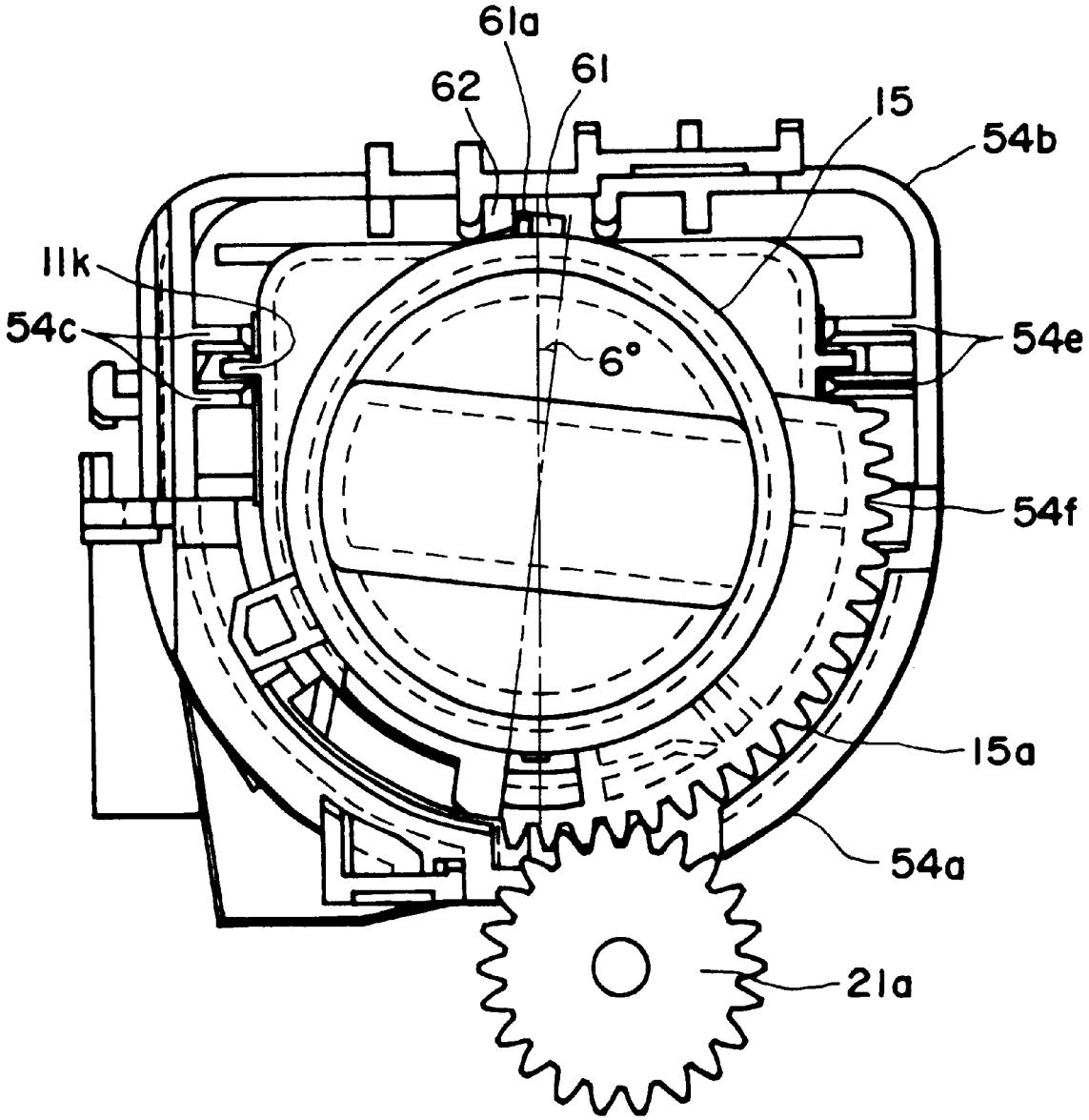
FIG. 34 is a front view illustrating a mounting operation of the toner supply container to the toner supply device.
Figure 35:
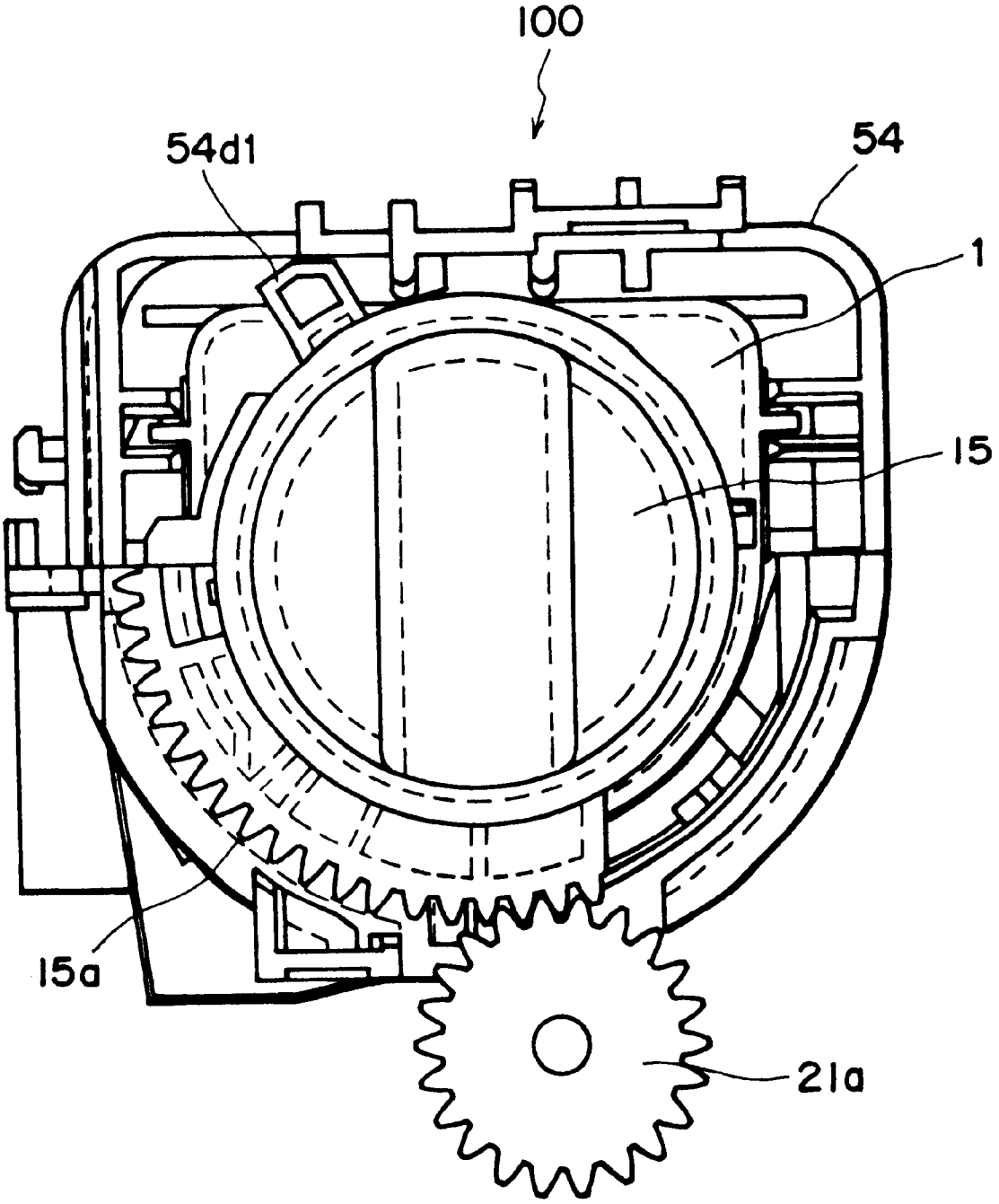
FIG. 35 is a front view of a mounting operation of the toner supply container to the toner supply device.

As the toner supply container 1 is further inserted into the toner supplying apparatus 100 from the point (handle is at the first rotational position) illustrated in FIGS. 33 and 43, the handle projection 61 slides on the main assembly projection 62 while rotating the handle 15. By the time the handle projection 61 slides to the cam crest of the main assembly projection 62, the handle 15 is rotated by 6 deg. The tooth tips of the engaging portion 15*a* of the handle 15 come in contact with the counterparts of the engaging portion 21*a* of the toner supplying apparatus 100 at the same time the handle projection 61 reaches the cam crest of the main assembly projection 62. In other words, at the moment the engaging portion 15*a* engages with the engaging portion 21*a*, the handle 15 is always at the second rotational position as shown in FIGS. 34 and 42. The tooth tips of the engaging portion 16*d* of the container shutter 16 come in contact with the counterparts of the engaging portion 21*g* on the main assembly side slightly before the contact between the engaging portions 15*a* and 21*a* by their tooth tips. In other words, the engagement of the engaging portion 16*d* of the container shutter 16 with the engaging portion 21*g* on the main assembly side occurs slightly ahead of the engagement of the engaging portion 15*a* of the handle 15 with the engaging portion 21*a* of the toner supplying apparatus 100.

Referring to FIG. 41, as the toner supply container 1 is further inserted into the toner supplying apparatus 100, the driving force transmitting engaging portion 15*a* of the handle 15 and the driving force receiving engaging portion 21*a* of the toner supplying apparatus 100 mesh with each other. On the other hand, the driving force receiving engaging portion 16*d* of the container shutter 16 meshes with the driving force transmitting engaging portion 21*g* illustrated in FIG. 10, across the entire ranges of their teeth. Therefore, while the toner supply container 1 moves from the position illustrated in FIG. 42 to the position illustrated in FIG. 41, the handle 15 does not rotate, and the handle projection 61 remains at the floating position a shown in FIG. 41, which corresponds to the cam crest of the main assembly projection 62. In other words, the handle 15 is led to the second rotational position illustrated in FIG. 34, regardless of the positional relationship between the handle 15 and toner containing portion 11 during the period in which the toner supply container 1 is not in the main assembly of the image forming apparatus.

As the handle projection 61 is displaced by the main assembly projection 62 as described above, the handle 15 rotates by 6 deg. Therefore, a certain amount of play is provided between the mutually facing surfaces of he handle 15 and first flange 12. More specifically, referring to FIGS. 7 and 8, when the toner supply container 1 is not in the main assembly of the image forming apparatus, a play large enough to allow the handle 15 to rotate by 6 deg. is provided in the circumferential direction of the handle 15 between the side surfaces of the notch 51*b* of the locking member 51, and the locking projection 12*h* of the first flange 12, and also between the surfaces of the grooves 15*k* and 15*m*, and the corresponding engagement ribs 51*d* of first flange 12.

Further, in order to make the container shutter 16 engage with the main assembly shutter 34 at a predetermined position before the handle 15 is rotated by the handle projection 61 and main assembly projection 62, the bottom portion 54*a* of the toner supplying apparatus main assembly 54 is provided with a positioning projection 63, which is located on the inwardly facing surface of the bottom portion 54*a*, and against which the end surface of the container shutter 16, on the leading side in terms of the installing direction of the toner supply container 1, slides, as shown in FIGS. 39 and 40. This projection 63 has a cam surface which is angled in profile, and the position of the cam crest of this projection 63 corresponds to the timing with which one of the mutually facing surfaces 34*b*1 of the indentation of the main assembly shutter 34, in which the container shutter 16 fits, comes to a predetermined point.

As the toner supply container 1 is inserted into the toner supplying apparatus 100, the chamfer surface 16*q* of the container shutter 16 comes in contact with the projection 63. As a result, the container shutter 16 is controlled in its positional relationship relative to the main assembly shutter 34 in the circumferential direction of the toner supply container 1. Then, as the toner supply container 1 is further inserted into the toner supplying apparatus 100, the longitudinal edge 16*r*1 of the container shutter 16, connected to the chamfer surface 16*q*, slides against the projection 63 while the container shutter 16 fits into the indentation of the main assembly shutter 34. During this movement of the container shutter 16, the chamfer surface 16*p* of the container shutter 16, on the opposite side of the container shutter 16, comes in contact with the chamfered surface 34*b*2 located at the corner of the projection 34*b*, on the corresponding side, of the main assembly shutter 34, also controlling the container shutter 16 in its positional relationship relative to the main assembly shutter 34. As the toner supply container 1 is further inserted, the chamfered surface 16*q* engages with the chamfered surface 34*b*3 of the main assembly shutter 34, and thereafter, the container shutter 16 advances into the indentation (space) between the mutually facing surfaces 34*b*1 of the projections 34*b* of the main assembly shutter 34. Then, as the container shutter 16 advances into the indentation of the main assembly shutter 34 to a point illustrated in FIG. 39, the engaging portions 15*a* and 16*d* on the toner supply container 1 side begin to mesh with the engaging portions 21*a* and 21*g* on the toner supplying apparatus 100 side. As the corresponding engaging portions mesh with each other by a predetermined margin in terms of the width direction of the gears, the positional relationship between the container shutter 16 and main assembly shutter 34 becomes as shown in FIG. 40. In this state, the chamfer surface 16*s* at the upstream end, in terms of the advancing direction of the container shutter 16 relative to the main assembly shutter 34, of the longitudinal edge 16*r* on the container shutter 16 sides has separated from the projection 63.

During the above described process, the resistance against the movement of the container shutter 16 for opening or closing the toner outlet of the toner containing portion 11 is large enough in comparison to the resistance against the opening or closing of the main assembly shutter 34, because the container shutter 16 is under the pressure generated by the packing member 35. Therefore, the projection 63 regulates the position of the container shutter 16, and the container surface 16 regulates the position of the main assembly shutter 34.

With the provision of the above described structure and its functions, the positions of the main assembly shutter 34 and container shutter 16 are always the same after their engagement. In this state, as a user rotates the handle 15 by 84 deg. in the clockwise direction as seen from the upstream side of the direction in which the toner supply container 1 is inserted in the toner supplying apparatus 100, both shutters 16 and 34 rotate 50 deg. in their opening direction; they fully open.

When removing the toner supply container 1 from the toner supplying apparatus 100, a user is required to rotate the handle 15 by 90 deg. in the counterclockwise direction, i.e., the direction opposite to the aforementioned direction. As the handle 15 is rotated, the both shutters 16 and 34 rotate by 50 deg. in their closing direction to their original positions.

As described above, the relations among the rotational angle of the handle 15 during the opening of the shutters 15 and 34, the rotational angle of the handle 15 during the closing of the shutters 15 and 34, the rotational angles of the shutters 16 and 34 during the closing of the shutters 16 and 34, and the rotational angles of the shutters 16 and 34 during the closing of the shutters 16 and 34, do not exactly correspond. This discrepancy occurs because the toner supply container rotates relative to the toner supplying apparatus due to the aforementioned gear backlash, deformation or bending of the handle, shutters, and shafts, and the like. Therefore, the shutters can be returned to their original positions by causing the rotational member 15 to rotate by 6 deg. to compensate for the backlash and/or deformation before the handle is turned for installation.

Also when pulling the toner supply container 1 out of the toner supplying apparatus 100, the handle 15 is pre-rotated by 6 deg. in the opening direction, as when installing the toner supply container 1, by the engagement of the handle projection 16 and the main assembly projection 62, to prepare the toner supply container 1 for the next usage. Should an attempt be made to pulled out the toner supply container 1 without rotating the handle 15 by 90 deg. in the counterclockwise direction (for example, rotating by only 80 deg.), it is possible that the container shutter 16 and main assembly shutter 34 might not return to their original positions. In the case of this embodiment, however, as the toner supply container 1 is pulled, the chamfered surface 16*s* of the container shutter 16 engages with the projection 63 of the toner supplying apparatus 100, and forces the container shutter 16 and main assembly shutter 34 back to their original positions. Therefore, the aforementioned inconvenience can be avoided.

{Embodiment 2}

In this embodiment, the toner discharging opening is sealed when there is no packing member between the toner discharging opening and the container shutter. FIGS. 46–51 show this embodiment.

Figure 46:
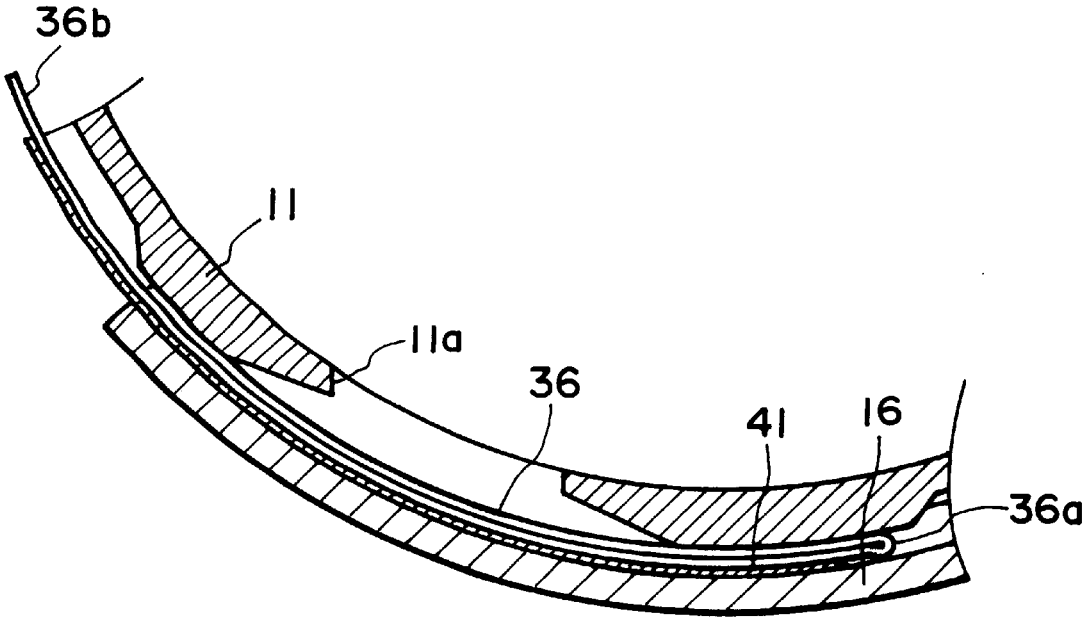
FIG. 46 is an enlarged view of a portion of a toner supply device according to Embodiment 2.

FIG. 46 is a longitudinal sectional view of a toner discharging opening of the toner supply container. In Embodiment 2, there is not a packing member 35 (FIG. 13) which encloses the toner discharging opening 11*a*. Even in this case, the same advantageous effects are provided.

FIG. 46 shows a sealed state before start of use, and the toner discharging opening 11*a* is sealed by sealing film 36 in place of the packing member 35 in Embodiment 1. The film 36 is heat-welded around the toner discharging opening 11*a* so as to be removable therefrom. The material of the film may be any known heat-weldable film. In this embodiment, the use is made with a seal bar (unshown) comprising a polyester film having a thickness of 16 $\mu$m, a biaxial orientation Nylon film having a thickness of 25 $\mu$m and an ethylene vinylacetate sealant film having a thickness of 60 $\mu$m which are laminated.

The material for sealing the toner discharging opening 11*a* is not limited to the welded film, but another method is usable, for example, a film to which an adhesive material is applied may be stuck.

The sealing film 36 heat-welded around the toner discharging opening 11*a* may be folded back at a bent portion 36*a* and is overlaid, and then, one end thereof may be extended out of the container shutter 16 to provide a grip portion 36*b*.

Figure 47:
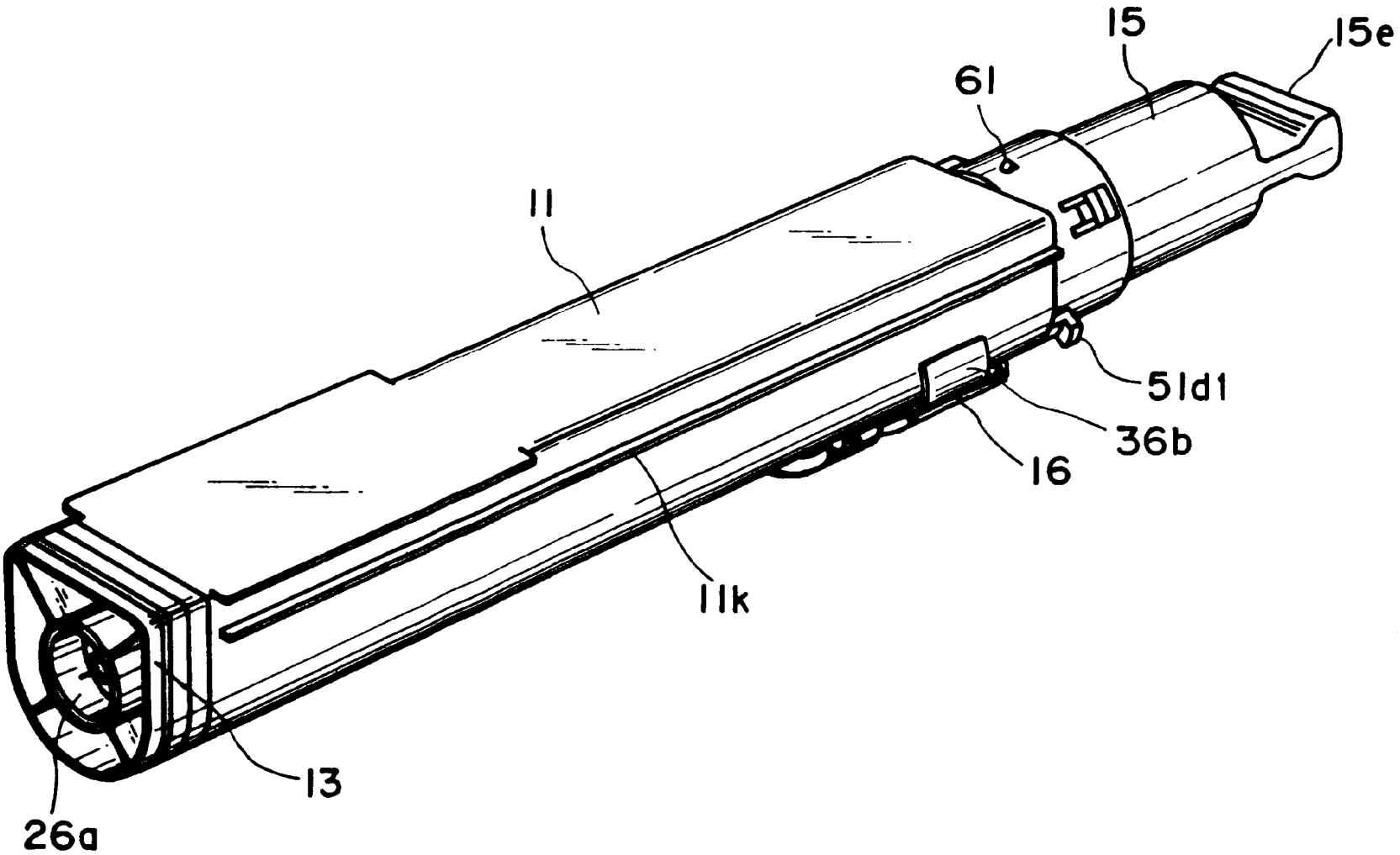
FIG. 47 is a perspective view of a toner supply container according to Embodiment 2 of the present invention.

FIG. 47 shows a toner supply container 1 which is sealed by the sealing film 36. As shown in the Figure, the grip portion 36*b* of the sealing film 36 is extended outward from between the container shutter 16 and the toner accommodating container. The grip portion 86*b* is extended along the main body 11 of the toner accommodating container or peelably pasted to the main body 11 of the toner accommodating container.

Upon removal of the sealing film 36, the grip portion 36*b* is gripped and is pulled in a substantially tangential direction of the cylindrical portion of the main body 11 of the toner accommodating container, by which the sealing film 36 is removed from the main body 11 of the toner accommodating container.

Figure 29:
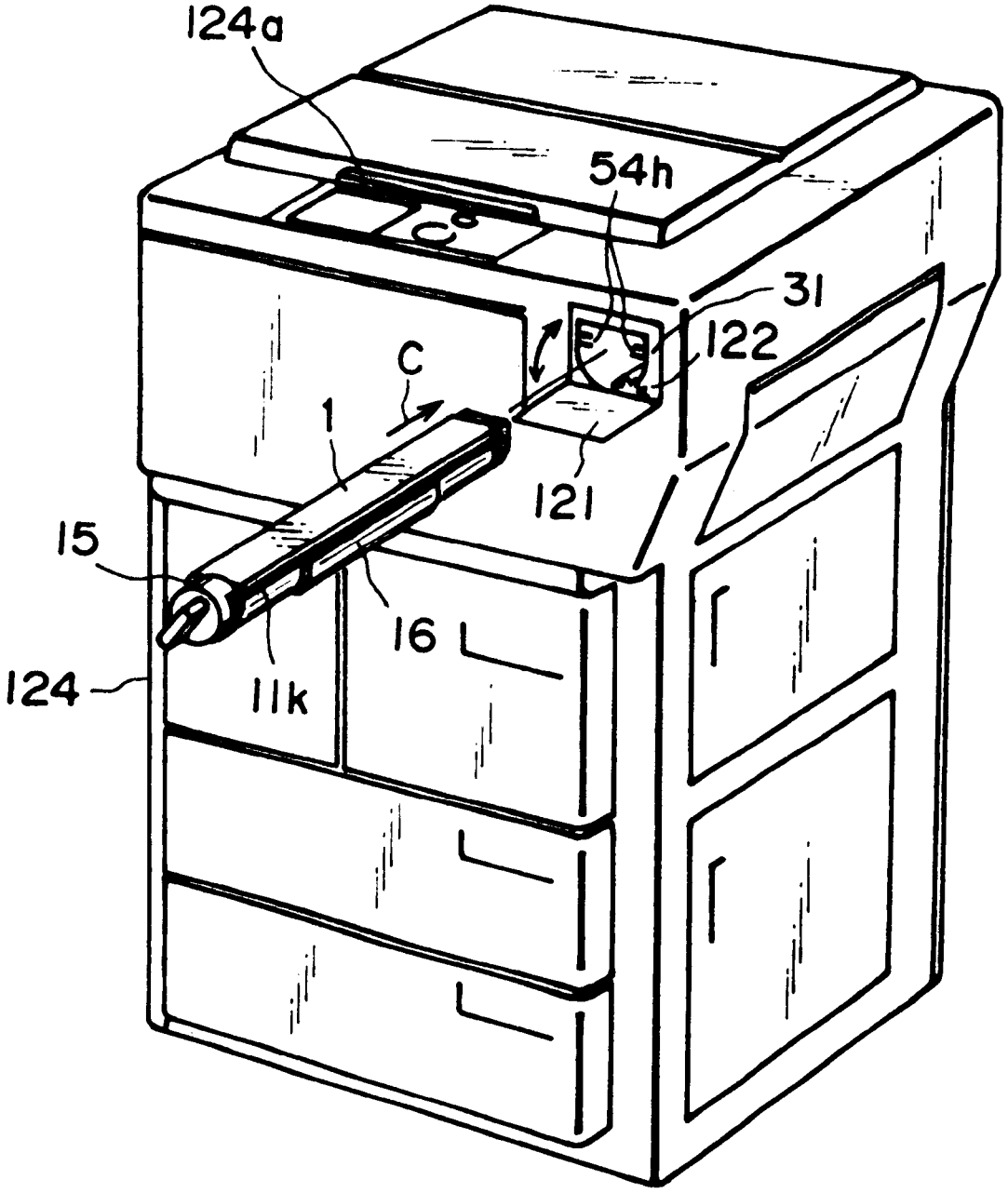
FIG. 29 is a perspective view of the electrophotographic image forming apparatus.
Figure 30:
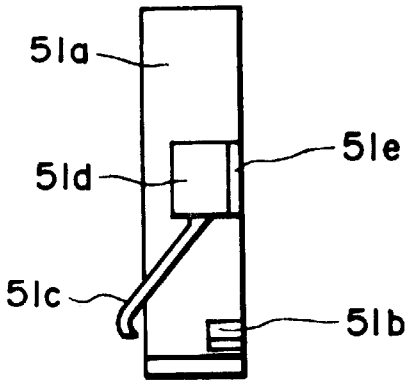
FIG. 30 is a side view of a handle locking member.
Figure 31:
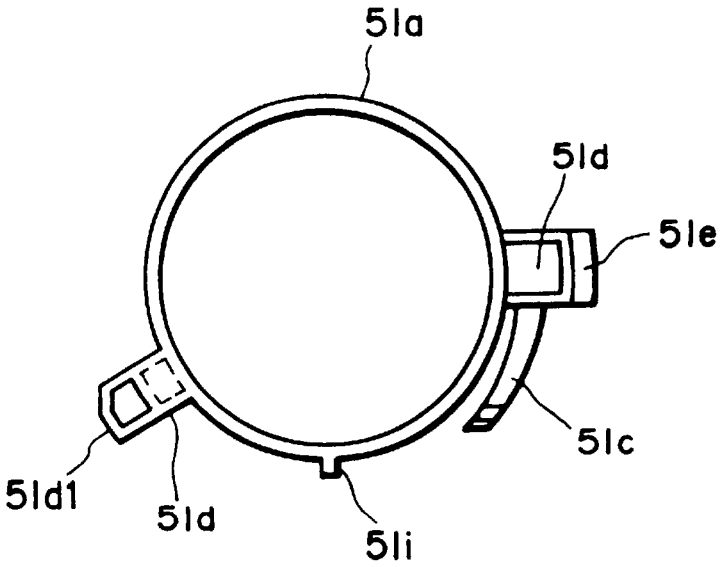
FIG. 31 is a front view of the handle locking member.
Figure 32:
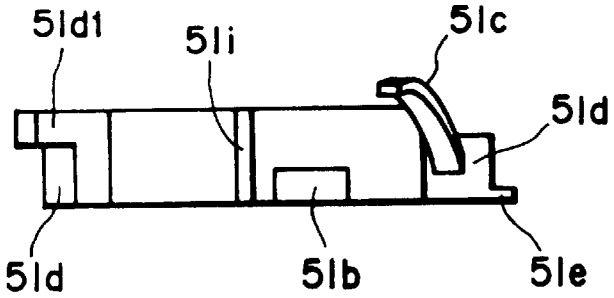
FIG. 32 is a bottom view of the handle locking member.

When the container is mounted to the main assembly 124 of the image forming apparatus as shown in FIG. 29, the removal of the sealing film 36 is carried out before the toner supply container 1 is mounted to the main assembly 124 of the image forming apparatus.

Figure 48:
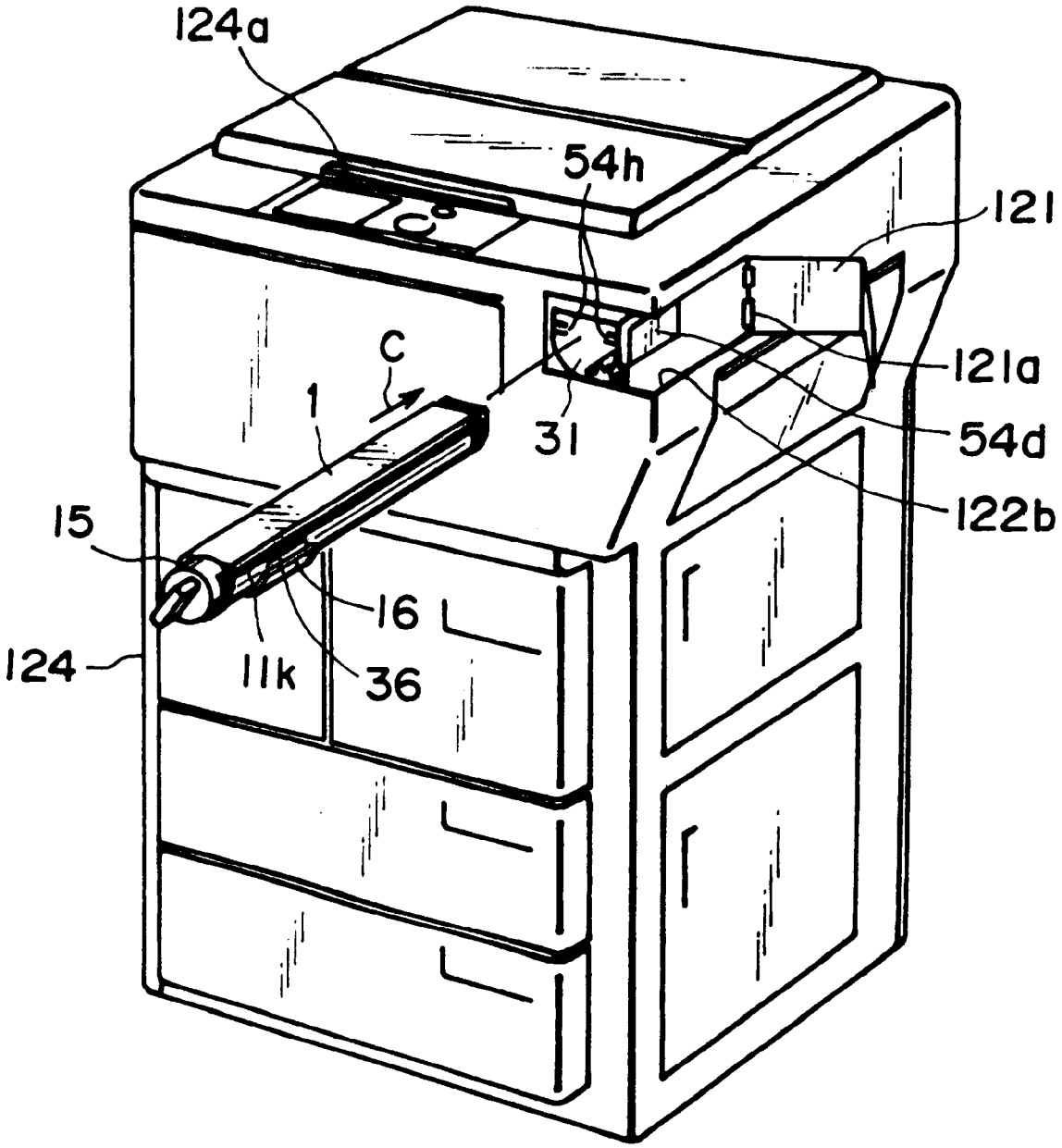
FIG. 48 is a perspective view of an electrophotographic image forming apparatus according to another embodiment of the present invention.

When it is mounted to the main assembly 124 of the image forming apparatus as shown in FIG. 48, the toner supply container 1 is inserted half away into the main assembly 124 of the image forming apparatus, and then the removable is carried out. In any case, the container shutter 16 and the main assembly shutter 34 are opened after the sealing film 36 is removed.

In the case of the main assembly 124 of the image forming apparatus, the openable member 121 is rotatably mounted by a hinge 121*a* to the side surface of the main assembly 124 of the image forming. The opening of the main assembly 124 of the image forming apparatus which is opened and closed by the openable member 121 is formed at a corner portion between the front side and the lateral side of the main assembly 124 of the image forming apparatus, and the openable member 121 is in the form of an angle. As shown in FIG. 48, an opening 54*d* for permitting pulling of the seal is formed at a side of the main body 54 of the toner supply device adjacent the inlet. An opening 124*b* actuated by the openable member 121 is formed in the main assembly 124 of the image forming apparatus in substantial alignment with the opening 54*d*. It is a possible alternative to provide the opening for permitting pulling of the seal at the position of the main assembly shutter 34, and in this case, the pulling of the sealing film 36 is enabled after the toner supply container 1 is mounted to the main assembly 124 of the image forming apparatus.

When the toner supply container 1 is mounted to the main assembly 124 of the image forming apparatus as shown in FIG. 48, the toner supply container 1 is inserted into the main assembly 54 of the toner supply device until the alignment is reached between the container shutter 16 and the opening 54*d*, and the sealing film 36 is pulled out through the opening 54*d* and the opening 124*b* of the main assembly 124 of the image forming apparatus.

Figure 49:
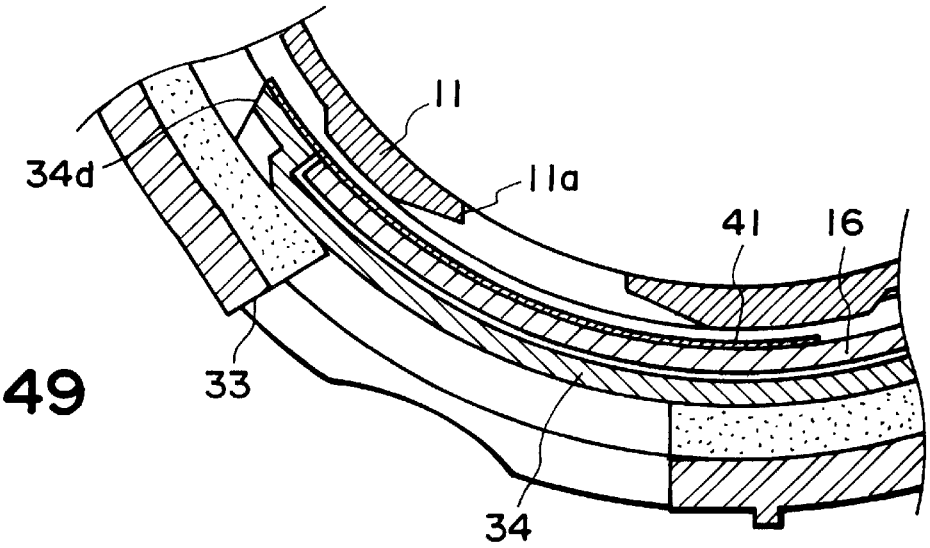
FIG. 49 is an enlarged view of a part of the toner supply device according to Embodiment 2.

After the removal of the sealing film which may be before or after the mounting of the toner supply container 1, the toner supply container 1 is completely mounted to the main assembly 54 of the toner supply device, and then, as shown in FIG. 49, the toner discharging opening 11*a* is sealed through the seal member 41 or the container shutter 16 integral with the seal portion. By the removal of the sealing film 36, a gap which is twice as large as the thickness of the sealing film 36 between the seal member 41 or the container shutter 16 integral with the seal portion and the periphery of the toner discharging opening 11*a*, but since the sealing film 86 is thin, the toner does not leak out of the toner supply container 1 before the container shutter 16 and the main assembly shutter 34 are opened.

Figure 50:
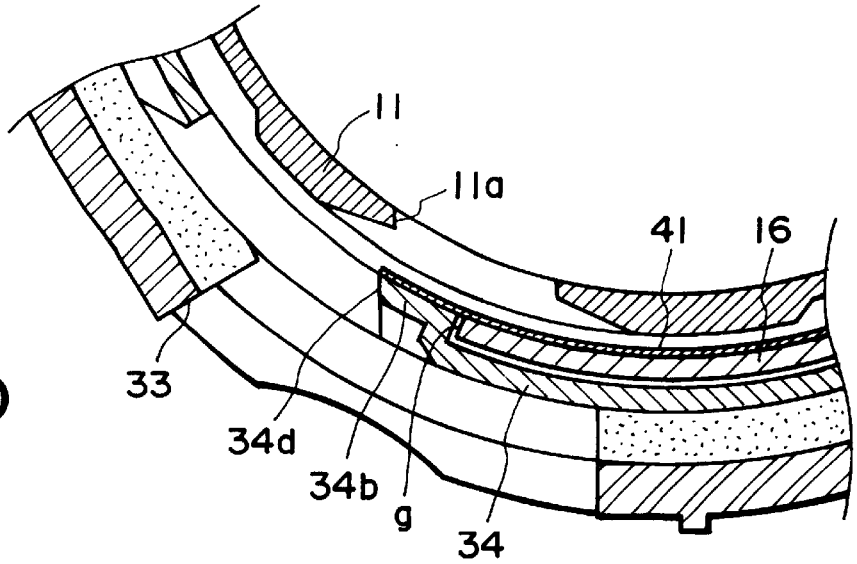
FIG. 50 is an enlarged view of a portion of the toner supply device according to Embodiment 2 of the present invention.

Subsequently, similarly to Embodiment 1, the container shutter 16 and the main assembly shutter 34 are opened, and then, the toner discharging opening 11*a* and the toner supply opening 33 are partly opened as shown in FIG. 50. Here, the gap between the main assembly shutter 34 and the container shutter 16 passes by the portion right below the toner discharging opening 11*a*, but the seal member 41 covers the portion, so that toner is prevented from entering the gap g. In this manner, the contamination by the deposition of the, onto the portion corresponding to the outer surface of the toner supply container.

Figure 51:
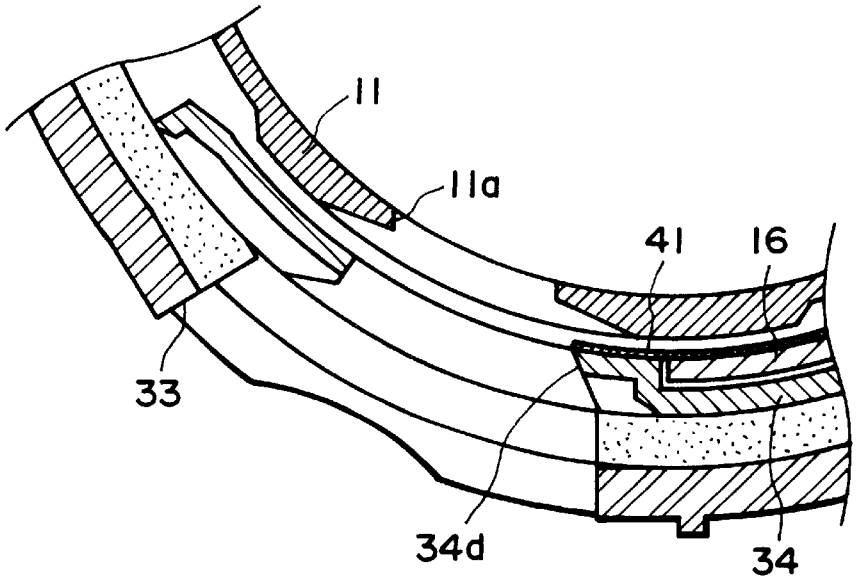
FIG. 51 is an enlarged view of a portion of the toner supply device according to Embodiment 2 of the present invention.

FIG. 51 shows a state in which the container shutter 16 and the main assembly shutter 34 are fully opened. Now, the toner discharging opening 11*a* and the main assembly shutter opening 34*d* are in fluid communication with each other so that toner is discharged from the main body 11 of the toner accommodating container and is supplied into the main assembly of the apparatus.

The toner is gradually discharged by a function of a toner feeding member 29 provided within the toner supply container 1. Even if quite a large amount of toner remains in the toner supply container 1, and the toner supply container is to be taken out, the situation is the same as the one shown in FIG. 49. In such a case, the toner discharging opening 11*a*, the main assembly shutter opening 34*d* and the toner supply opening 33 are all filled with toner. Even in such a state, the seal member 41 covers the gap g, so that toner is prevented from entering the gap g, and therefore, the toner contamination of the outer surface of the toner supply container can be avoided.

It is preferable for the same reason as with Embodiment 1 that, the length of the extension of the seal portion 16*t* is substantially the same as the width of the abutment edge 34*b* of a main assembly shutter 34. More specifically, it is preferably not less than 2 mm and not more than 10 mm, further preferably not less than 4 mm not more than 8 mm, and even further preferably about 6 mm.

If the seal portion 16*t* is too short, the function of preventing the toner entering the gap is not sufficient, and in addition, the pocket-like portion formed by the seal portion 16*t* and the toner container 11 is shallow, and therefore, the function of retaining of the deposited toner is not sufficient. Furthermore, the function of preventing the toner deposition to the surface of the abutment edge 34*b* of the main assembly shutter 34, is not sufficient.

{Embodiment 3}

Figure 52:
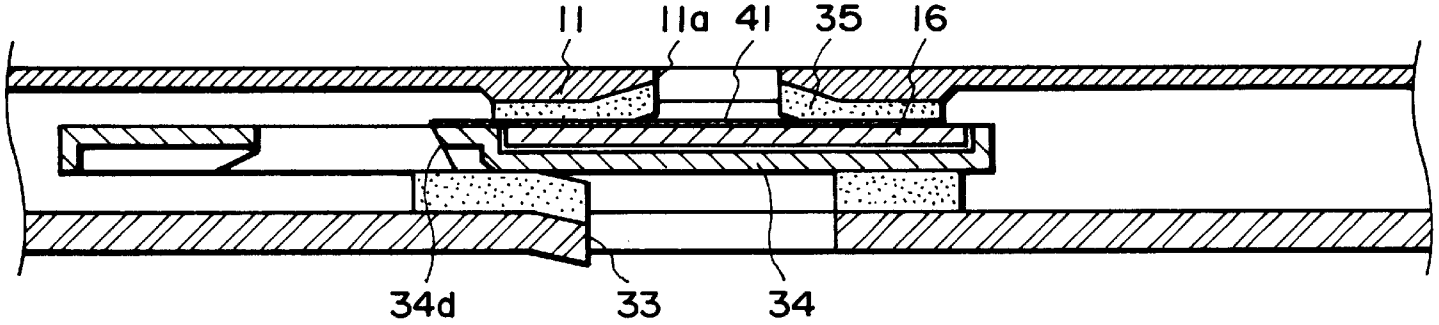
FIG. 52 is an enlarged view of a portion of the toner supply device according to Embodiment 3 of the present invention.
Figure 53:
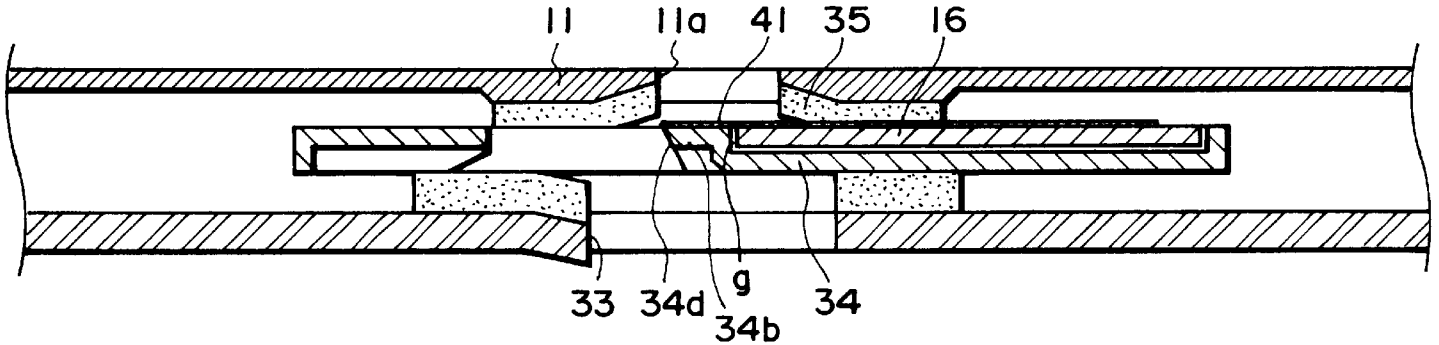
FIG. 53 is an enlarged view of a portion of the toner supply device according to Embodiment 3 of the present invention.
Figure 54:
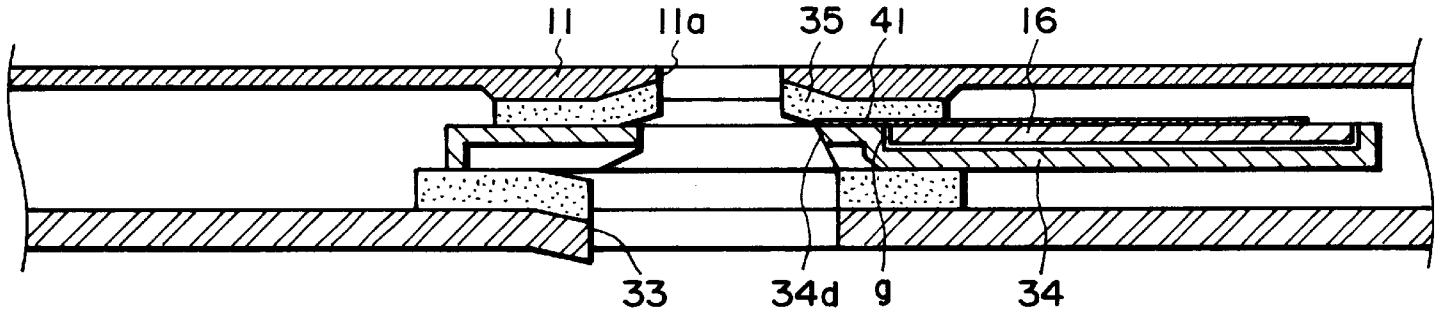
FIG. 54 is an enlarged view of a portion of the toner supply device according to Embodiment 3.

FIGS. 52–54 are enlarged front sectional views of a toner supply device according to Embodiment 3 of the present invention, in which FIG. 52 shows a state in which the toner discharging opening is closed during mounting and demounting of the toner supply container, and FIG. 53 shows a state in which the shutter is being opened, and FIG. 54 shows a state in which the toner is being supplied out.

In this embodiment, the outer surface of the toner supply container 1 is not cylindrical but is a simply flat surface. With this structure, the same advantageous effects as with Embodiment 1 can be provided.

FIG. 52 shows the sealed state before start of use, and in the Figure, the same reference numerals as Embodiment 1 are assigned to the elements having the corresponding functions, and the detailed description thereof are omitted.

During the toner supply operation, the toner supply container is mounting into the toner receiving device, and the container shutter 16 is brought into engagement with the main assembly shutter 34. Specifically, in the same manner as with Embodiment 1, the container shutter 16 and the main assembly shutter 34 are opened, by which the toner discharging opening 11*a* and the toner supply opening 33 are partly aligned as shown in FIG. 53. Here, the gap g between the container shutter 16 and the main assembly shutter 34 passes by the portion right below the toner discharging opening 11*a*, but since the seal member 41 covers the portion, and therefore, the toner is prevented from entering the gap g. In this manner, the contamination by the toner deposition to the corresponding part of the outer surface of the toner supply container, can be avoided.

During this process, the seal member 41 and the container shutter 16 receive force in the vertical direction in the drawing by the restoring force of the packing member 35 so that extended portion 41*a* of the seal member 41 extended from the container shutter 16 is press-contacted to the container side surface of the main assembly shutter 34, thus providing good sealing property and prevention of deposition of the toner to the surface of the abutment edge 34*b* of the main assembly shutter 34.

The toner is gradually discharged by a function of a toner feeding member 29 provided within the toner supply container 1. Even if quite a large amount of toner remains in the toner supply container 1, and the toner supply container is to be taken out, the situation is the same as the one shown in FIG. 54. In such a case, the toner discharging opening 11*a*, the main assembly shutter opening 34*d* and the toner supply opening 33 are all filled with toner. Even in such a state, the seal member 41 covers the gap g, so that toner is prevented from entering the gap g, and therefore, the toner contamination of the outer surface of the toner supply container can be avoided.

The above-described embodiments of the present invention are summarized as follows.

1. A toner supply container 1 for supplying toner to the main assembly 124 of the electrophotographic image forming apparatus, comprising:

a toner container 11 including a main body for accommodating the toner to be supplied into the main assembly 124 of the electrophotographic image forming apparatus;

a toner discharging opening 11*a* provided in the main body of the toner accommodating container to discharge the toner accommodated in the main assembly 11 of the toner accommodating container;

a container shutter 16 for unsealably sealing the toner discharging opening 11*a*, said container shutter 16 being effective to open and close a toner discharging opening 11*a* and a toner supply opening 33 by engagement with the main assembly shutter 34 having an opening 34*d* for opening and closing the toner supply opening 33 of the main assembly 124 of the electrophotographic image forming apparatus;

an elastic packing member 35, provided in the main body 11 of the toner accommodating container around the toner discharging opening 11*a*, for sealing the container shutter 16 and a periphery of the toner discharging opening 11*a;* a seal member 41, fixed to the container shutter 16 between the elastic packing member 35 and the container shutter 16, for providing sealing between the container shutter 16 and the main assembly shutter 34.

2. A container according to Paragraph 1, wherein said seal member 41 includes a flexible sheet.

3. A container according to Paragraph 2, wherein said seal member 41 includes a polyester film.

4. A container according to Paragraph 3, wherein said seal member 41 includes a polyester film having a thickness not less than 50 $\mu$m and not more than 300 $\mu$m.

5. A container according to any one of Paragraphs 1–4, wherein said seal member 41 is disposed at a container side of said container shutter 16, and said seal member 41 has an extended portion 41*a* projected at a downstream position with respect to a closing direction of the container shutter 16.

6. A container according to Paragraph 5, wherein the extended portion 41*a* is projected by not less than 2 mm and not more than 10mm from an end surface of said container shutter 16.

7. A container according to Paragraph 7, wherein an end edge of the extended portion 41*a* is substantially parallel with an end surface of said container shutter 16.

8. A container according to any one of Paragraphs 1–7, wherein a width of said seal member 41 measured in a direction perpendicular to an opening and closing direction of said container shutter 16 is substantially equal to or larger than a width of an opening 34*d* of the main assembly shutter 34 measured in the same direction and a width of a toner discharging opening 11*a* measured in the same direction.

9. A container according to Paragraph 1, wherein said container shutter 16 seals said toner discharging opening 11*a* by compressing a packing member 35 of elastic material provided around said toner discharging opening 11*a*.

10. A container according to Paragraph 9, wherein said seal member 41 is press-contacted to the main assembly shutter 34 by restoring force of said packing member 35.

11. A container according to Paragraph 1, wherein at least a portion of the main body 11 of said toner accommodating container adjacent said toner discharging opening 11*a* is substantially cylindrical, and corresponding portions of said container shutter 16 and said main assembly shutter 34 are arcuate correspondingly.

12. A container according to Paragraph 1, wherein when said toner supply container 1 is mounted to the main assembly 124 of said electrophotographic image forming apparatus, said container shutter 16 is substantially nested in a recess 34 formed between surfaces 34*b*1 in said main assembly shutter 34 to be opened or closed integrally with each other.

13. A container according to Paragraph 12, wherein when the main assembly shutter 34 is opened or closed, the container shutter 16 follows thereto to be opened or closed, and tsugigyotunagu. A gear which is a driving force transmission side engaging portion 21*g* of a driving force transmission member 21 is brought into meshing engagement with a segment gear provided at an outer periphery of the main assembly shutter 34 through an opening provided at a lower portion 54*a* of the main body 54 of the toner supply device.

14. A container according to Paragraph 12, wherein when the container shutter 16 of said toner supply container is opened or closed, the main assembly shutter 34 follows to be opened or closed.

15. A container according to Paragraph 14, wherein said container shutter 16 is provided with a driving force reception side engaging portion 16*d* as a driving force receiving portion for receiving opening and closing driving force.

16. A container according to Paragraph 14, wherein said driving force receiving portion include a gear.

17. A container according to Paragraph 1, wherein an opening and closing direction of the container shutter 16 and said main assembly shutter 34 is perpendicular to a mounting direction of said toner supply container 1 relative to the main assembly 124 of the electrophotographic image forming apparatus.

18. A container according to Paragraph 12, wherein said main assembly shutter 34 is provided with an opening 34*d* for permitting passage of the toner supplied from the container shutter 16, and the opening 34*d* is disposed upstream, with respect to an opening direction of a main assembly shutter 34, of a recess 34*c* formed between surfaces 34*b*1 of the main assembly shutter 34 which is an o engaging portion between the main assembly shutter 34 and said container shutter 16.

19. A container according to any one of Paragraphs 1–18, wherein said seal member 41 is large enough to cover the packing member 35 when said container shutter 16 is in its closed position, and said seal member 41 is provided at a packing member 35 contacting side with a low friction resistance material.

20. A container according to Paragraph 19, wherein said low friction resistance material is one of silicone oil, silicone wax or silicone paint.

21. A container according to Paragraph 5, wherein said extended portion 41*a* is provided with perforations 41*b*.

22. A container according to Paragraph 21, wherein the perforations 41*b* are arranged substantially parallel with a mounting direction of said toner supply container 1 relative to the main assembly 124 of the electrophotographic image forming apparatus.

23. A container according to Paragraph 21, wherein said perforations 41*b* are provided at a base portion of the extended portion 41*a*.

24. A container according to Paragraph 21–23, wherein when said toner supply container 1 is mounted to the main assembly 124 of the electrophotographic image forming apparatus, said seal member 41 is bent at the perforations 41*b* by interference between said extended portion 41*a* and the main body 64 of said toner supply device of the main assembly 124 of the electrophotographic image forming apparatus.

25. A container according to Paragraph 24, wherein the extended portion 41*a* is bent toward said toner container 11 which is a main body of the toner accommodating container.

26. A container according to Paragraph 21–25, wherein a main body side of said seal member 41 is provided with a flexible film 42 laminated thereto.

27. A container according to Paragraph 26, wherein a low friction resistance material, for example, silicon oil, is applied to a surface of said film.

28. A container according to Paragraph 27, wherein said low friction resistance material penetrates the perforations 41*b* to close them.

29. A container according to any one of Paragraphs 21–27, wherein a groove 41*c* is formed in place of the perforation 41*b*.

30. A container according to Paragraph 29, wherein the groove 41*c* is provided at a side opposite from a bending side.

31. A container according to any one of Paragraphs 5–30, wherein said extended portion 41*a* is bent toward a main body 11 of the toner accommodating container beforehand.

32. A container according to Paragraph 31, wherein the extended portion is bent by heat bending.

33. A container according to Paragraph 31 or 32, wherein the extended portion 41*a* is bent.

34. A container according to any one of Paragraphs 5–33, wherein the extended portion 41*a* is bent at a downstream end thereof with respect to a direction of insertion of said toner supply container.

35. A container according to any one of Paragraph 5–33, wherein said toner supply container 1 is provided at said extended portion 41*a* with a convex segment 41*d* at a downstream side with respect to an inserting direction, and the projected portion is bended toward the main body 11 of said toner accommodating container.

36. An electrophotographic image forming apparatus for formation in an image on a recording material, to which a toner supply container 1 is detachably mountable, said apparatus comprising:

a. toner supply device for receiving a toner supply container 1, said toner supply container including: kaigyo a toner container 11 which is a main body of a toner accommodating container for accommodating toner to be supplied to the main assembly 124 of the electrophotographic image forming apparatus;

a toner discharging opening 11*a*, provided in a main body 11 of said toner accommodating container to permit discharge of the toner accommodated in the main assembly 11 of said toner accommodating container;

a container shutter 16 for unsealably sealing said toner discharging opening 11*a*, said container shutter 34 is engageable with a main assembly shutter 34 having an opening 34*d* for opening and closing said toner supply opening 33 of said main assembly 124 of said electrophotographic image forming apparatus to open and close said toner discharging opening 11*a* and said toner supply opening 33 together;

an elastic packing member 35, provided in the main body 11 of the toner accommodating container around the toner discharging opening 11*a*, for sealing the container shutter 16 and a periphery of the toner discharging opening 11*a*;

a seal member 41, fixed to the container shutter 16 between the elastic packing member 35 and the container shutter 16, for providing sealing between the container shutter 16 and the main assembly shutter 34;

said image forming apparatus further comprising:

b. image forming means for forming an image on the recording material.

c. feeding means for feeding the recording material.

37. An image forming apparatus according to Paragraph 36, wherein said toner supply device 100 includes a rotating force transmission member 21 (21*a*, 21*b*, 21*g*) for transmitting rotating force to said container shutter 16 of said toner supply container 1 from outside when toner supply container 1 is mounted to said toner supply device 100.

38. An apparatus according to Paragraph 36 or 37, wherein said main assembly shutter 34 is provided at a portion contacting to said seal member 41 with an inclined introducing portion 34*e* for smoothly introducing said seal member 41 when said toner supply container 1 is mounted to said toner supply device 100.

40. A toner supply container 1 for supplying toner to a main assembly 124 of an electrophotographic image forming apparatus, said toner supply container 1 comprising: a main body 11 of toner accommodating container for accommodating toner to be supplied to the main assembly 124 of the electrophotographic image forming apparatus; a toner discharging opening 11*a*, provided in the main body 11 of said toner accommodating container, for permitting discharging of the toner accommodated in the main body 11 of said toner accommodating container; a container shutter 16 for unsealably sealing the toner discharging opening 11*a*, said container shutter 16 being effective to open and close a toner discharging opening 11*a* and a toner supply opening 33 by engagement with the main assembly shutter 34 having an opening 34*d* for opening and closing the toner supply opening 33 of the main assembly 124 of the electrophotographic image forming apparatus; a seal portion 16*t*, in the form of a thin projection configuration integrally extended from said container shutter 16, for covering a portion between said container shutter 16. and said.

41. A container according to Paragraph 40, further comprising an elastic packing 35 for providing sealing for said container shutter 16 and a portion around toner discharging opening 11*a*.

42. A container according to Paragraph 41, wherein said container shutter 16 compresses a packing member 35 of an elastic material provided around said toner discharging opening 11*a*.

43. A container according to Paragraph 42, wherein said seal portion 16*t* is press-contacted to said main assembly shutter 34 by restoring force of said packing member 35.

44. A container according to Paragraph 40, wherein said seal portion 16*t* has a thickness not less than 50 $\mu$m and not more than 300 $\mu$m.

45. A container according to Paragraph 40, wherein said seal portion 16*t* has an extended portion projected toward a downstream side with respect to an opening direction of said container shutter 16.

46. A container according to Paragraph 40, wherein the extended portion is projected by not less than 2 mm and not more than 10 mm from an end surface of said container shutter 16.

47. A container according to Paragraph 40, wherein an end edge of said extended portion is substantially parallel with the end surface of said container shutter 16.

48. A container according to Paragraph 40, wherein wherein a width of said seal member 41 measured in a direction perpendicular to an opening and closing direction of said container shutter 16 is substantially equal to or larger than a width of an opening 34*d* of the main assembly shutter 34 measured in the same direction and a width of a toner discharging opening 11*a* measured in the same direction.

49. An electrophotographic image forming apparatus for forming an image on a recording material P, which is detachably mountable to a toner supply container 1, said apparatus comprising:

a. toner supply device for receiving a toner supply container 1, said toner supply container including: kaigyo a main body 11 of a toner accommodating container for accommodating toner to be supplied to a main assembly 124 of said electrophotographic image forming apparatus; A toner discharging opening 11*a*, provided in the main body 11 of said toner accommodating container to permit discharging of the toner accommodated in the main body 11 of said toner accommodating container; A container shutter 16 for unsealably sealing said toner discharging opening 11*a*, said container shutter 16 being engageable with a main assembly shutter 34 having an opening for opening and closing said toner supply opening 33 of said main assembly 124 of said electrophotographic image forming apparatus to opening and closing said toner discharging opening 11*a* and said toner supply opening 33 together; A seal portion 16*t* in the form of a thin projection configuration integrally extended from said container shutter 16 to cover a portion between said container shutter 16 and said main assembly shutter 34;

b. image forming means for forming an image on the recording material P; and c. feeding means for feeding the recording material P.

50. An image forming apparatus according to Paragraph 49, wherein wherein said toner supply device 100 includes a rotating force transmission member 21 (21*a*, 21*b*, 21*g*) for transmitting rotating force to said container shutter 16 of said toner supply container 1 from outside when toner supply container 1 is mounted to said toner supply device 100.

51. An image forming apparatus according to Paragraph 49 or 50, wherein wherein said main assembly shutter 34 is provided at a portion contacting to said seal member 41 with an inclined introducing portion 34*e* (FIG. 27) for smoothly introducing said seal member 41 when said toner supply container 1 is mounted to said toner supply device 100.

52. A toner supply container 1 for supplying toner to a main assembly 124 of an electrophotographic image forming apparatus, said toner supply container 1 comprising: A main body 11 of said toner accommodating container for accommodating the toner to be supplied to the main assembly 124 of the electrophotographic image forming apparatus; A toner discharging opening 11*a*, provided in the main body 11 of said toner accommodating container, for discharging the toner accommodated in the main body 11 of said toner accommodating container; A container shutter 16 for unsealably sealing said toner discharging opening 11*a*, said container shutter 16 being engageable with a main assembly shutter 34 having an opening for opening and closing said toner supply opening 33 of said main assembly 124 of said electrophotographic image forming apparatus to opening and closing said toner discharging opening 11*a* and said toner supply opening 33 together; A seal member 41, fixed to the container shutter 16 between the elastic packing member 35 and the container shutter 16, for providing sealing between the container shutter 16 and the main assembly shutter 34.

53. An image forming apparatus for forming an image on a recording material, to which a toner supply container 1 is detachably mountable, said apparatus comprising:

a. toner supply device for receiving a toner supply container 1, said toner supply container including: kaigyo a main body 11 of a toner accommodating container for accommodating toner to be supplied to the main assembly 124 of the electrophotographic image forming apparatus; A toner discharging opening 11*a*, provided in the main body 11 of said toner accommodating container, for discharging the toner accommodated in the main body 11 of said toner accommodating container; A container shutter 16 for unsealably sealing said toner discharging opening 11*a*, said container shutter 16 being engageable with a main assembly shutter 34 having an opening for opening and closing said toner supply opening 33 of said main assembly 124 of said electrophotographic image forming apparatus to opening and closing said toner discharging opening 11*a* and said toner supply opening 33 together; A seal member 41, fixed to the container shutter 16 between the elastic packing member 35 and he container shutter 16, for providing sealing between the container shutter 16 and the main assembly shutter 34;

said apparatus further comprising: kaigyob. Image forming means for forming an image on the recording material P; and c. teeding means for feeding the recording material P.

While the invention has been described with reference to the structures disclosed herein, it is not confined to the details set forth and this application is intended to cover such modifications or changes as may come within the purposes of the improvements or the scope of the following claims.

What is claimed is:

1. A toner supply container, detachably mountable to a main assembly of an image forming apparatus, for supplying toner to the main assembly of the image forming apparatus, said toner supply container comprising:

a main body for accommodating the toner;

a discharging opening for permitting discharging of the toner accommodated in the main body of said container;

a container shutter member for opening and closing said discharging opening, said container shutter member being provided with an engaging portion engageable with a main assembly shutter member provided in the main assembly of said apparatus, wherein said main assembly shutter member is openable and closable relative to a toner reception opening of the main assembly of said apparatus while said container shutter member and said main assembly shutter member are interrelated with each other, and wherein said engaging portion is capable of passing by a position corresponding to said discharging opening;

a cover part for covering said engaging portion relative to said discharging opening.

2. A toner supply container according to claim 1, wherein said cover part is supported by said container shutter member.

3. A toner supply container according to claim 1, wherein said cover part includes a flexible sheet member.

4. A toner supply container according to claim 1, wherein said cover part is a part of said container shutter member, and a thickness of said cover part is smaller than a thickness of a part of said shutter member corresponding to said discharging opening when said container shutter member is in a closing position relative to said discharging opening.

5. A toner supply container according to claim 3, wherein said sheet member is provided on a main body side surface of said container shutter member and is provided with a projected portion projected downstream of said container shutter member with respect to a closing direction of said container shutter member.

6. A toner supply container according to claim 5, wherein said projected portion is projected beyond said container shutter member by not less than 2 mm and not more than 10 mm.

7. A toner supply container according to claim 3, wherein said sheet member includes a polyester film.

8. A toner supply container according to claim 3, wherein said sheet member has a thickness not less than 50 $\mu$m and not more than 300 $\mu$m.

9. A toner supply container according to claim 1, further comprising an elastic leakage prevention member, provided adjacent said discharging opening of the main body of said container, for preventing leakage of the toner through said discharging opening.

10. A toner supply container according to claim 1, wherein said leakage prevention member is compressed between said main body of said container and said container shutter member.

11. A toner supply container according to claim 10, wherein said cover part includes a flexible sheet member which is pressed against said main assembly shutter member by elastic force of said leakage prevention member.

12. A toner supply container according to claim 3, wherein said sheet member has a width which is not less than a width of said discharging opening, measured in a direction perpendicular to a direction in which said container shutter member is opened and closed.

13. A toner supply container according to claim 1, wherein said engaging portion is engageable with a recess of said main assembly shutter member.

14. A toner supply container according to claim 1, wherein said main assembly shutter member is provided with a passing opening for passage of the toner, said passing opening is provided upstream of said engaging portion with respect to an opening direction of said main assembly shutter member.

15. A toner supply container according to claim 1, wherein the direction of opening and closing of said container shutter member is perpendicular to a mounting and demounting direction of said toner supply container relative to the main assembly of the apparatus.

16. A toner supply container according to claim 5, wherein said projected portion is provided with perforations arranged in a mounting direction of said toner supply container relative to the main assembly of the apparatus.

17. A toner supply container according to claim 16, wherein when said toner supply container is mounted to the main assembly of the apparatus, said projected portion is contacted to the main assembly of the apparatus by which it is bent at the perforations.

18. A toner supply container according to claim 17, wherein said projected portion is bent toward the main assembly of the container at the perforations.

19. A toner supply container according to claim 5, wherein said projected portion is provided with a groove portion extended in a mounting direction of the toner supply container to the main assembly of the apparatus.

20. A toner supply container according to claim 19, wherein when said toner supply container is mounted to the main assembly of the apparatus, said projected portion is bent at said groove portion by abutment to the main assembly of the apparatus.

21. A toner supply container according to claim 20, wherein said groove portion is formed in a side opposite from said projected portion with respect to a bending direction of said projected portion.

22. A toner supply container according to claim 5, wherein said projected portion is bent toward the main assembly of the container before said toner supply container is mounted to the main assembly of the apparatus.

23. A toner supply container according to claim 5, wherein said sheet member is provided with a second projected portion provided downstream of said container shutter member with respect to a mounting direction of said toner supply container to the main assembly of the apparatus, wherein said second projected portion is bent toward the main body side of said container shutter.

24. An image forming apparatus comprising:

a toner supply container for supplying toner to the main assembly of the apparatus, said toner supply container being detachably mountable to the main assembly of the apparatus;

a main assembly shutter member provided in the main assembly of the apparatus and capable of opening and closing a toner reception opening for receiving a supply of the toner from said toner supply container;

wherein said toner supply container includes:

a main body for accommodating the toner;

a discharging opening for discharging the toner accommodated in the main body;

a container shutter member for opening and closing said discharging opening, said container shutter member being provided with an engaging portion engageable with a main assembly shutter member provided in the main assembly of said apparatus, wherein said main assembly shutter member is openable and closable relative to a toner reception opening of the main assembly of said apparatus while said container shutter member and said main assembly shutter member are interrelated with each other, and wherein said engaging portion is capable of passing by a position corresponding to said discharging opening;

a cover part for covering said engaging portion relative to said discharging opening.

25. An apparatus according to claim 24, wherein said cover part includes a flexible sheet member.

26. An apparatus according to claim 24, further comprising a guiding portion for guiding said sheet member to a portion of the main assembly of the apparatus to which said sheet member is brought into contact when said toner supply container is mounted to the main assembly of the apparatus.

* * * * *

UNITED STATES PATENT AND TRADEMARK OFFICE

CERTIFICATE OF CORRECTION

PATENT NO. : 6,438,345 B1
DATED : August 20, 2002
INVENTOR(S) : Yutaka Ban et al.

It is certified that error appears in the above-identified patent and that said Letters Patent is hereby corrected as shown below:

Column 1,
Line 33, “in which” should read -- for --;
Line 39, “prevented” should read -- permitted --;
Line 40, “supplied.” should read -- being supplied. --;
Line 46, “following” should read -- the following --;
Line 52, “apparatus,this” should read -- apparatus, this --; and
Line 54, “the is” should be deleted and “during” should read -- while --.

Column 2,
Line 6, “compe-” should read -- contamination --;
Line 7, “tition” should be deleted;
Line 12, “bidding” should be deleted;
Line 13, “ton, container” should read -- toner supply container --;
Line 25, “These” should read -- ¶These --; and
Line 36, “container,s” should read -- container as --.

Column 4,
Line 22, “relates” should read -- relate --; and
Line 65, “pair 16” should read -- pair 116 --.

Column 5,
Line 9, “pair 16” should read -- pair 116 --; and
Line 51, “FIG. 38” should read -- FIG. 29 --.

Column 7,
Line 6, “shutter 11” should read -- shutter 16 --; and
Line 65, “toner outlet 12a,” should read -- toner inlet 12a, --.

Column 8,
Line 45, “an” should read -- and --.

Column 12,
Line 63, “a not” should read -- not --.

Column 13,
Line 25, “a” should be deleted; and
Line 50, “peels” should read -- peel --.

UNITED STATES PATENT AND TRADEMARK OFFICE

CERTIFICATE OF CORRECTION

PATENT NO. : 6,438,345 B1
DATED : August 20, 2002
INVENTOR(S) : Yutaka Ban et al.

It is certified that error appears in the above-identified patent and that said Letters Patent is hereby corrected as shown below:

Column 15,
Line 26, “abundance” (?)
Line 64, “2 μm” should read -- 2 mm --;
Line 65, “10 μm” should read -- 10 mm, --; and “4 μm” should read -- 4 mm --;
Line 66, “8 μm,” should read -- 8 mm, --; and
Line 67, “6 μm.” should read -- 6 mm. --.

Column 16,
Line 1, “enters” should read -- entry --; and
Line 25, “providing” should read -- displayed --.

Column 17,
Line 25, “providing” should read -- proving --.

Column 18,
Line 24, “rides” should read -- ride --.

Column 19,
Line 39, “installation removal” should read -- installation-removal --; and
Line 53, “springly” should read -- springy --.

Column 20,
Line 35, “pushed-in” should read -- pushed in --; and
Line 46, “handles 15” should read -- handle 15 --.

Column 21,
Line 45, “handles 51” should read -- handle 15 --; and
Line 61, “handle 51.” should read -- handle 15. --.

Column 22,
Line 41, “tone” should read -- toner --.

Column 23,
Line 23, “portion” should read -- portions --.

Column 26,
Line 12, “he” should read -- the --.

UNITED STATES PATENT AND TRADEMARK OFFICE

CERTIFICATE OF CORRECTION

PATENT NO. : 6,438,345 B1
DATED : August 20, 2002
INVENTOR(S) : Yutaka Ban et al.

It is certified that error appears in the above-identified patent and that said Letters Patent is hereby corrected as shown below:

Column 27,
Line 19, “surface 16” should read -- shutter 16 --;
Line 37, “shutters 15” should read -- shutters 16 --;
Line 39, “shutters 15” should read -- shutters 16 --;
Line 56, “projection 16” should read -- projection 61 --; and
Line 58, “pulled” should read -- pull --.

Column 28,
Line 54, “half away” should read -- halfway --;
Line 56, “removable” should read -- removal --; and
Line 62, “forming.” should read -- forming apparatus. --.

Column 29,
Line 31, “86” should read -- 36 --;
Line 42, “the,” should read -- the toner, --; and
Line 44, “container.” should read -- container is prevented. --.

Column 30,
Line 26, “description” should read -- descriptions --.

Column 32,
Line 9, “tsugigyotunagu.” should be deleted;
Line 25, “include” should read -- includes --; and
Line 38, “o” should be deleted.

Column 33,
Line 4, “Paragraph 21-25,” should read -- Paragraphs 21-25, --;
Line 30, “Paragraph 5-33,” should read -- Paragraphs 5-33, --;
Line 37, “in” should read -- of --;
Line 41, “kaigyo” should be deleted; and
Line 51, “shutter 34” should read -- shutter 16 --.

Column 34,
Line 62, “wherein” should be deleted.

UNITED STATES PATENT AND TRADEMARK OFFICE

CERTIFICATE OF CORRECTION

PATENT NO. : 6,438,345 B1
DATED : August 20, 2002
INVENTOR(S) : Yutaka Ban et al.

It is certified that error appears in the above-identified patent and that said Letters Patent is hereby corrected as shown below:

Column 35,
Lines 6 and 67, “kaigyo” should be deleted.

Column 36,
Line 17, “he” should read -- the --;
Line 20, “kaigyob.” should be deleted; and
Line 23, “teeding” should read -- feeding --.

Signed and Sealed this

Seventeenth Day of August, 2004

JON W. DUDAS
*Acting Director of the United States Patent and Trademark Office*